US005452045A

United States Patent [19]

Koboshi et al.

[11] Patent Number: 5,452,045

[45] Date of Patent: Sep. 19, 1995

[54] APPARATUS FOR PROCESSING A LIGHT-SENSITIVE SILVER HALIDE PHOTOGRAPHIC MATERIAL

[75] Inventors: Shigeharu Koboshi; Masao Ishikawa; Yoshimasa Komatsu; Hideo Ishii; Yorikatsu Miyazawa; Yoshifumi Tsubaki; Kaneo Saito; Tsuyoshi Haraguchi; Wataru Satake, all of Hino, Japan

[73] Assignee: Konica Corporation, Tokyo, Japan

[21] Appl. No.: 142,797

[22] Filed: Oct. 25, 1993

[30] Foreign Application Priority Data

Oct. 30, 1992 [JP] Japan ..... 4-293274
Nov. 24, 1992 [JP] Japan ..... 4-313784
Nov. 24, 1992 [JP] Japan ..... 4-313785

[51] Int. Cl.[6] ..... G03D 3/02

[52] U.S. Cl. ..... 354/324; 430/398; 430/602; 430/523; 159/47.3

[58] Field of Search ..... 354/321–324, 354/328, 331, 336; 430/450, 456, 398–400, 602, 523, 465; 134/64 R, 64 P, 122 P, 122 R; 159/47.3, 29

[56] References Cited

U.S. PATENT DOCUMENTS 2,482,546 9/1949 Kasruba .
2,494,903 1/1950 Sheidler .
2,596,926 5/1952 Gunther et al. ..... 430/523
2,610,122 9/1952 Oakley et al. .
3,128,182 4/1964 Bard et al. .
3,128,183 4/1964 Jones et al. ..... 430/602
3,253,919 5/1966 Beavers et al. .
3,532,501 10/1970 Mackey et al. .
3,582,346 6/1971 Dersch ..... 430/602
3,995,298 11/1976 Vandeputte et al. ..... 354/324
4,119,462 10/1978 Hodes .
4,230,796 10/1980 Gunther et al. ..... 430/523
4,816,384 3/1989 Fruge et al. ..... 430/465
4,874,530 10/1989 Kobayashi et al. ..... 210/718
4,959,122 9/1990 Kurematsu et al. ..... 354/324 X
5,004,522 4/1991 Koboshi et al. ..... 159/47.3
5,011,571 4/1991 Kobayashi et al. ..... 354/299 X
5,040,013 8/1991 Kurokawa et al. ..... 354/322
5,057,191 10/1991 Kurematsu et al. ..... 203/3
5,237,360 8/1993 Patton ..... 354/324
5,240,822 8/1993 Tanaka et al. ..... 430/465 X
5,351,103 9/1994 Komatsu et al. ..... 354/324
5,353,085 10/1994 Kurematsu et al. ..... 354/324

FOREIGN PATENT DOCUMENTS 92-20013 11/1992 WIPO ..... 354/328

*Primary Examiner*—D. Rutledge
*Attorney, Agent, or Firm*—Frishauf, Holtz, Goodman, Langer & Chick

[57] ABSTRACT

An apparatus for processing a light-sensitive silver halide photographic material and which has a solid agent replenisher, is provided with a water producing device to recover water from the air or from used processing solution. The apparatus also is provided with a water replenisher which delivers recovered water to a processing tank to replenish the water in the processing solution contained therein.

26 Claims, 47 Drawing Sheets

SOLUBILITY TEST UNIT ( A )

SOLUBILITY TEST UNIT ( B )

FIG. 20 ( A )
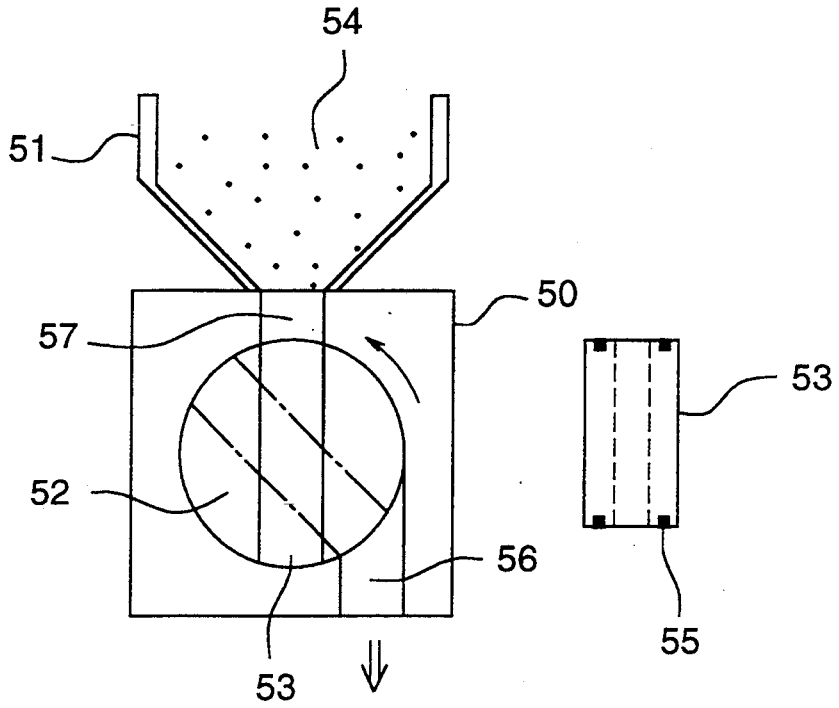
FIG. 20 ( B )
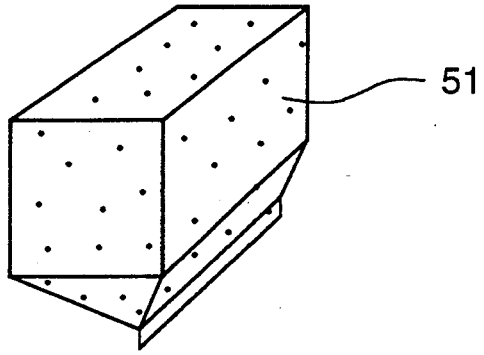

FIG. 27 (A)
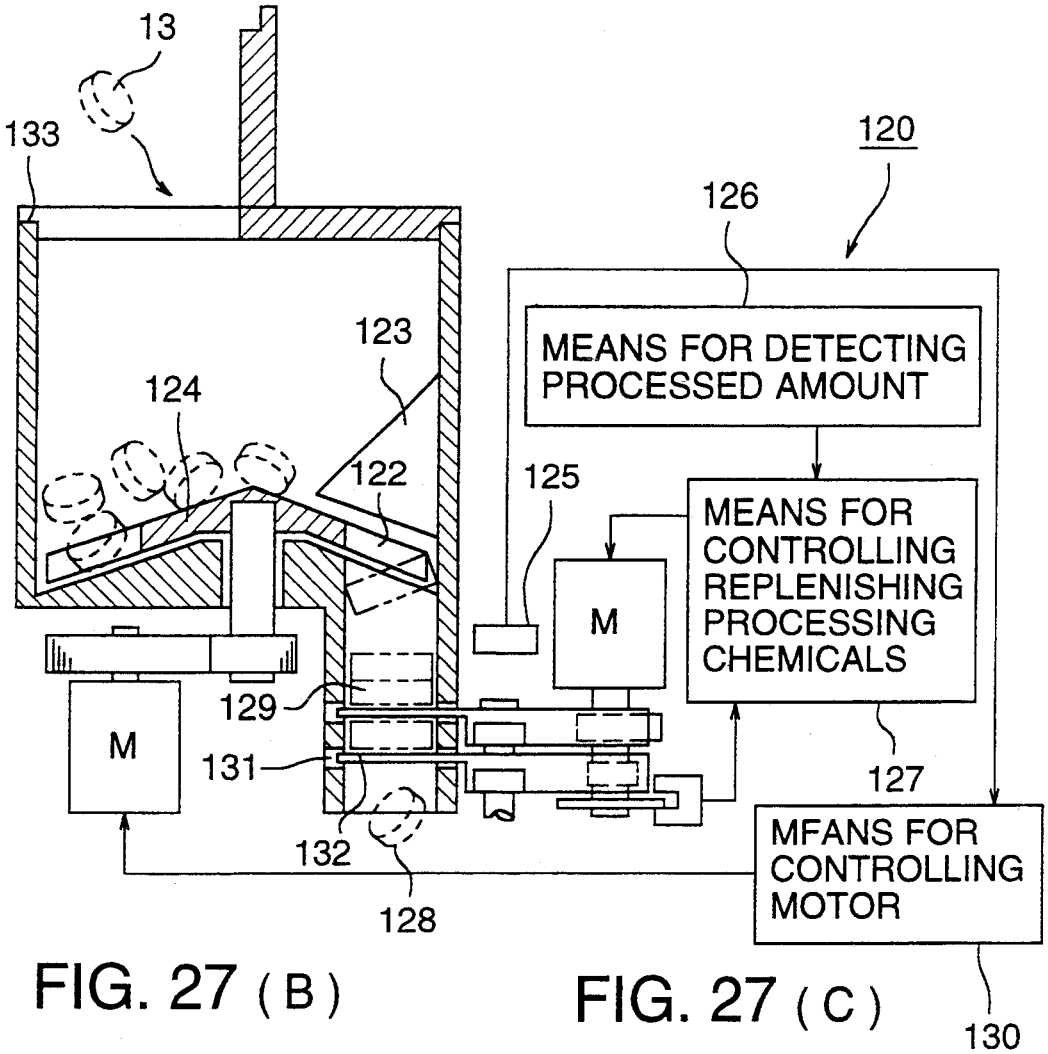
FIG. 27 (B)
FIG. 27 (C)
PACKED TABLETS OF PROCESSING CHEMICALS
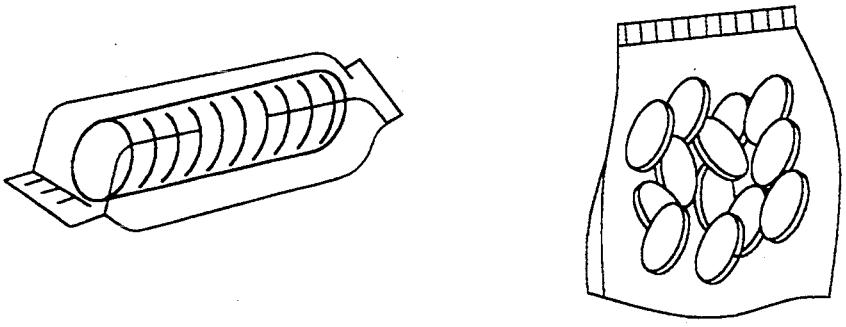

FIG. 35 ( F )
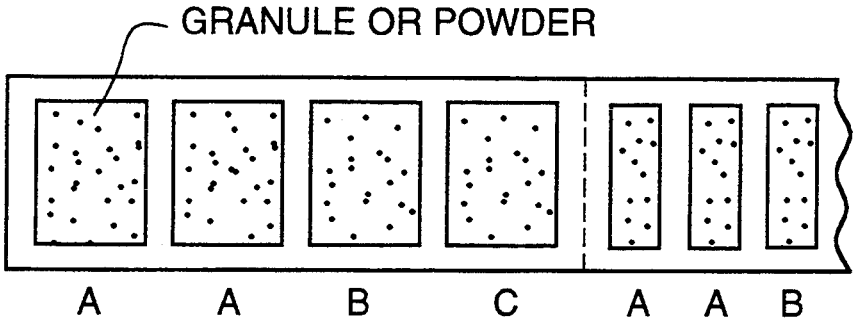
FIG. 35 ( G )
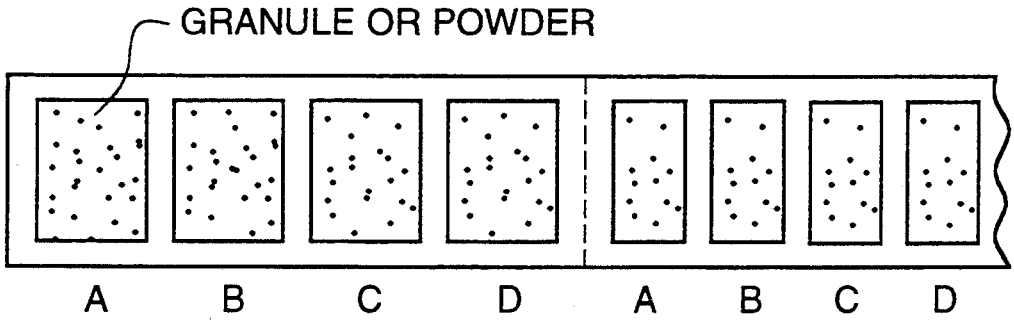

FIG. 35 ( M )
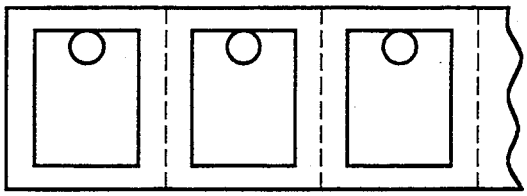
FIG. 35 ( N )
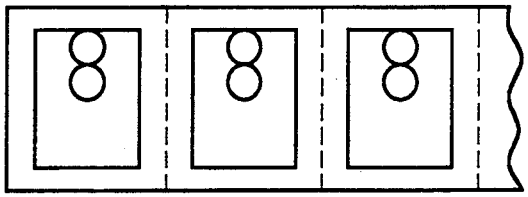
FIG. 35 ( O )
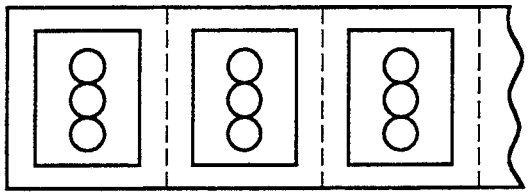
FIG. 35 ( P )
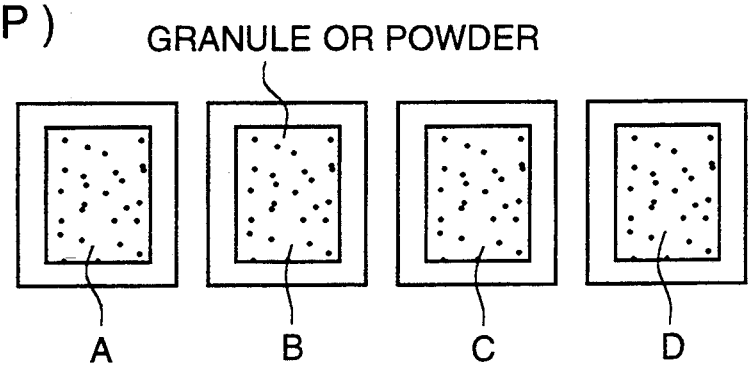
FIG. 35 ( Q )
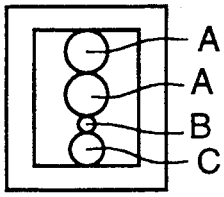
FIG. 35 ( R )
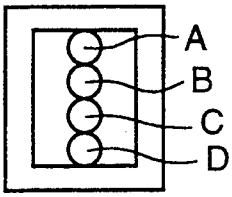
FIG. 35 ( S )
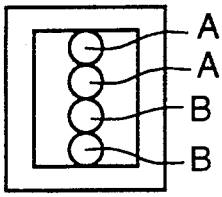

FIG. 36 ( A )
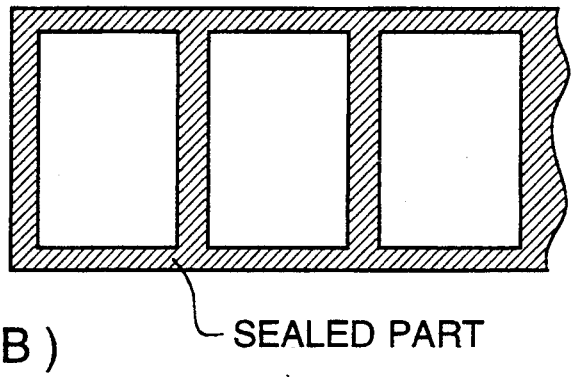
FIG. 36 ( B )
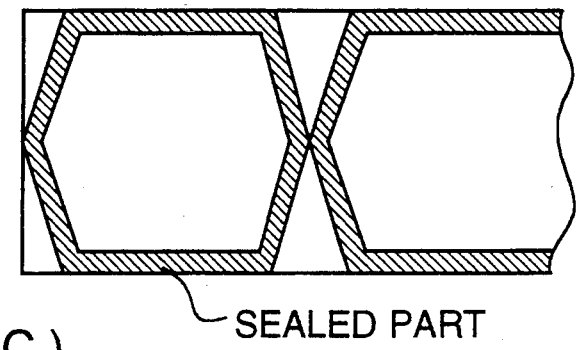
FIG. 36 ( C )
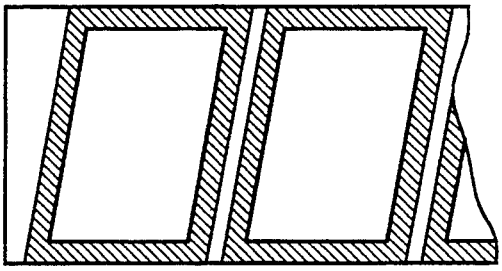
FIG. 36 ( D )
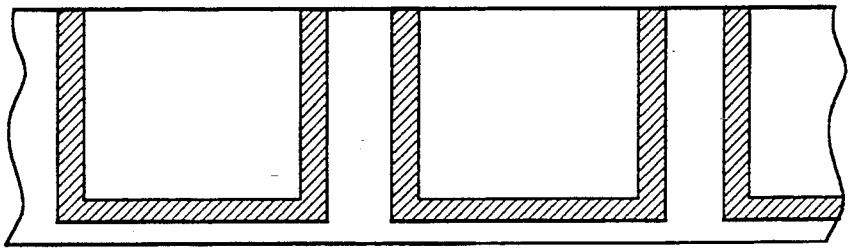

FIG. 39 ( A )
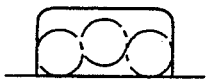
FIG. 39 ( B )
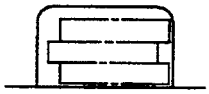
FIG. 39 ( C )
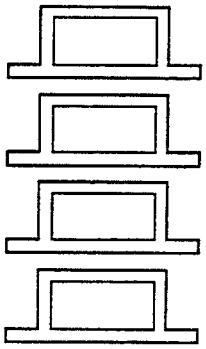
FIG. 39 ( D )
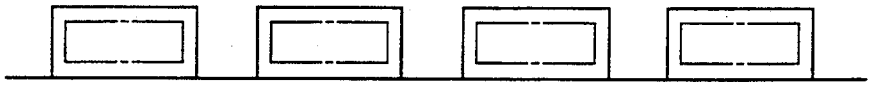
FIG. 39 ( E )
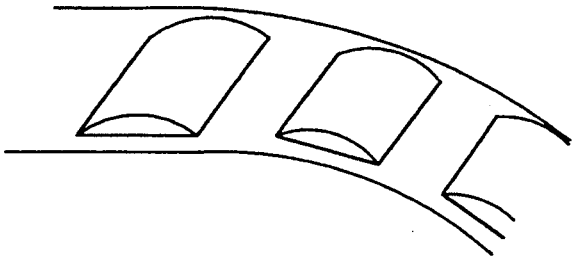

FIG. 40 ( A )
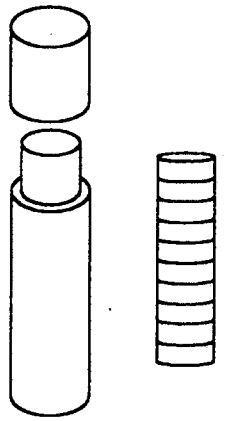
FIG. 40 ( B )
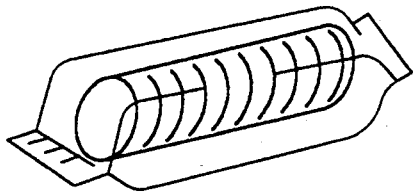
FIG. 40 ( C )
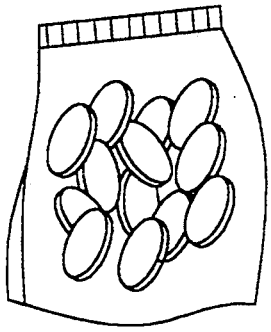

APPARATUS FOR PROCESSING A LIGHT-SENSITIVE SILVER HALIDE PHOTOGRAPHIC MATERIAL

BACKGROUND OF THE INVENTION

The present invention relates to an automatic processing machine for silver halide photographic light-sensitive materials, more specifically a compact automatic processing machine offering markedly improved operability free of dissolving operation and remarkably improved chemical stability.

Silver halide color photographic light-sensitive materials (hereinafter also referred to as light-sensitive materials or photographic materials) are processed in developing, desilvering, washing, stabilizing and other processes after exposure. Silver halide black-and-white photographic light-sensitive materials are developed and fixed after exposure. A black-and-white developer or a color developer, a bleacher or a bleach-fixer, a fixer, tap water or deionized water, a stabilizing solution and a dye stabilizer are used for development, desilvering, fixing, washing, waterless washing and dye stabilization, respectively.

The liquids capable of performing these processes are called processing solutions. Each processing solution is usually kept at a temperature of 30° to 40° C., in which the light-sensitive material is immersed and processed.

These processes are usually carried out by sequentially transporting the light-sensitive material through processing tanks containing the above processing solutions, using an automatic processing machine or another means.

The automatic processing machine mentioned herein is generally a processing machine having a developing portion, a fixing portion, a desilvering portion, a washing or stabilizing portion and a drying portion, and a means for automatically sequentially transporting the photographic light-sensitive material to the processing tanks.

In carrying out processing using such an automatic processing machine, the processing solution in each processing tank is supplemented with a processing agent to keep the activity of the processing solution in the processing tank constant.

For this purpose, it is common to prepare a replenisher containing the processing agent dissolved therein.

Specifically, processing is carried out while supplying the previously prepared replenisher from the replenisher tank to the processing tank as appropriate.

In this case, it is the common practice to prepare the replenisher itself to be stored in the replenisher tank in a remove place, and in mini-labs etc., the replenisher is usually prepared in a given amount in a replenisher tank made within the processing machine at a time by manual dissolution or mixing dissolution using a mechanical mixer.

The silver halide photographic light-sensitive material processing agent (hereinafter also referred to as photographic processing agent) is supplied in the form of powder or liquid; it is prepared as a solution in a given amount of water in the case of powder. In the case of liquid, it is prepared as a dilution in a given amount of water in the case of liquid, since it is supplied in a concentrated state.

Replenisher tanks may be set by the automatic processing machine, requiring considerable space. Also, in recently-increasing mini-labs, replenisher tanks are housed in the automatic processing machine; in this case as well, sufficient space must be available for the replenisher tanks, each of which should contain at least 5 to 10 liter of replenisher.

Any processing agent for replenishment is divided in some parts to ensure constantly good performance in photographic processing. For example, the color developer replenisher is divided in three or four parts, and the bleach-fixer replenisher for color photography is divided in two parts: a part of the oxidant ferric salt of organic acid and a part of the reducing agent thiosulfate. In preparing the replenisher, said dense part of ferric salt of organic acid and said dense part of thiosulfate are mixed together and diluted with a given amount of water before using.

Said dense parts are placed in containers such as plastic containers, which containers are packed in outer packages, such as corrugated cardboard boxes, for 1 unit of commercial distribution.

The processing agent for replenishment in a kit of part agents is dissolved, diluted, mixed and then diluted to a given volume before using. Said processing agent for replenishment has the following drawbacks:

First, almost all conventional kits comprise dense aqueous solutions concentrated for improved operability, most of which are very dangerous because of high pH values of not more than 2.0 or not less than 12.0 in that they are harmful to the human body by skin contact etc. Also, many of them are strong oxidants or reducing agents, possessing very dangerous corrosivity in transport by ships or aircraft. The aqueous solution is subject to limitation as to solubility, being heavier and bulkier than in the case of solid. Since the concentrated solution is a dangerous article as stated above, its containers must be sufficiently tough to avoid destruction and spillage even if it is fallen; plastic container disposal poses a problem.

Second, the part agents are removely contained in respective containers; some processing agents for replenishment comprise several bottles of part agents so that each unit of commercial distribution thereof involves a considerable number of containers, which requires much space for storage and transportation. For example, the color developer replenishing agent for CPK-2-20QA, a processing solution for color printing paper, is available in 10-liter units, wherein part A (a kit including a preservative), part B (a kit including a color developing agent) and part C (alkaline agent) are each contained in a 500-ml plastic container. Similarly, the bleach-fixer replenisher is available in 8-liter units, wherein three part agents are contained in respective bottles. The stabilizer replenisher is available in 10-liter units, wherein two part agents are contained in respective bottles. These replenishing agents are stored and transported in respective outer packages of various sizes. The outer package size ranges from about $17\times14\times16.5$ cm for the stabilizer replenisher to about $18.5\times30.5\times22.5$ cm for the bleach-fixer replenisher; it is not possible to pile packages of replenishers in storing or transporting them or in storage them at dealer shops unless they are of the same kind, so that much space is required.

The third drawback concerns with the problem of waste container disposal. In recent years, there has been strong demand for environmental conservation and saving resources mainly in Europe and the United States; in the photographic industry, plastic container disposal has been of major concern. Specifically, although plastic containers for photographic use are cheap, conveniently storable and transportable and excellent in chemical resistance, they pose problems of accumulation in the environment because they are hardly biodegradable, and emission of large amounts of carbon dioxide upon burning, which contribute to global warming and acid rain. As for the problems posed on the user side, they include decrease in the available working area due to occupation of the narrow working space by crowding plastic containers, which are too tough to compress.

The fourth drawback is poor chemical stability.

Usually, the life time of a replenisher is at most 2 weeks even in the presence of a floating lid. However, with the trend toward replenishing rate reduction, it has recently been often the case where a 10-liter replenisher is used over a period of more than 1 month in a mini-lab receiving an order of 30 rolls of color films daily on average.

In this case, the replenisher in the replenishing tank is often much more frequently in contact with air than the processing solution in the processing tank; often, replenishing has no effect due to replenisher deterioration. Accordingly, attempts have been made to reduce the replenishing tank capacity to 5 liter or reduce the replenishing kit unit to 5 liter. However, this approach involves another drawback of the necessity of additional packing material.

For example, in preparing a color developer replenisher for color printing paper, a given volume of water is placed in the replenisher tank, after which dense kit A, which contains a preservative, is added, followed by stirring, and dense kit B, which contains a color developing agent, is then added, followed by stirring, and dense kit C, which contains an alkaline agent, is then added, followed by stirring, and finally water is added to make a given volume. This series of procedures is liable to be accompanied by some problems. For example, in case of insufficient stirring or a failure to add the starting water, the color developing agent tends to crystalize, and the resulting crystal can stay in the bellows pump and fail to be supplied so that the photographic performance becomes labile or the bellows pump breaks. Also, the dense kits are not always used immediately after production; they may be used even 1 year after production; in some cases, performance becomes labile due to oxidation of the color developing agent or preservative.

The color developer replenisher prepared from dense kits or powder is also known to pose some problems in the replenisher tank. For example, if the replenisher remains unused for a long time, crystals can deposit on the inside wall of the replenisher tank, the replenisher becomes susceptible to oxidation, and tar forms. Under some storage conditions, other problems arise, including separation of easily-crystallizing components of the replenisher, such as the color developing agent, at low temperatures; some makers specify replenisher storage conditions and instruct the users to keep their replenishers under those conditions.

As stated above, when a replenisher, e.g., a color developer replenisher for color printing paper, is prepared using a commonly used dense kit or powder, the above-mentioned problems arise; similar problems arise in the case of bleach-fixer, bleacher and fixer. For example, the bleach-fixer is characterized by considerably poor storage stability. This is because the bleach-fixer is usually of high acidity and considerably low pH for neutralizing the alkalinity of the dye fixer carried over by the printing paper being processed because the bleach-fixing process immediately follows the process with a color developer of high pH. It is said that at low pH values, any bleach-fixer comprising a thiosulfate and an oxidant is considerably poor in storage stability and cannot be replenished at low replenishing rates. The same applies to the fixer and stabilizer.

Another problem is that the replenisher becomes increasingly dense in answer to the recent trend toward replenishing rate reduction and rapid processing; it has recently been a common practice to concentrate the replenisher to the limit of solubility.

This deteriorates replenisher storage stability, thus posing many practical problems such as crystal separation.

On the other hand, in addition to the above method of preparing a replenisher using a dense kit or powder, another method is known wherein a dense kit is added as such.

In this method, supplying means such as a bellows pump are used to supply the dense kit as such directly to the processing tank and a given volume of replenishing water is added independently, to improve the low efficiency in dissolving operation. This method really obviates solution preparing operation and is free of the problem of poor storage stability because no replenisher solution is prepared, in comparison with the above method, wherein the replenisher is prepared from a dense kit or powder.

However, this method also involves many problems. The major problem is the increased size of the automatic processing machine because of the necessity for a dense kit tank for supplying the dense kit and a pump for supplying the dense kit. For example, in the case of CPK-2-20, a processing solution for color printing paper, the dense kit of color developer replenisher is divided in three parts; the dense kit of bleach-fixer replenisher, three parts; and the dense kit of stabilizer replenisher, two parts. To supply all these dense kits, eight tanks and eight pumps are required. In the conventional replenishing method, three tanks and three pumps are sufficient, since each replenisher requires one tank and one pump. In short, more tanks and more pumps than in the conventional method are required for supplying the dense kits, and a pump for water used to prepare the replenisher is also required. Also, since bellows pump precision is not so high, it is difficult to accurately discharge a plurality of solutions simultaneously, which can result in an imbalanced composition.

Moreover, dense kits are difficult to maintain due to proneness to crystallization near the outlet of replenisher nozzle because they are dense solutions. Another problem is that the bellows pump is insufficient in supplying accuracy so that replenishing accuracy fluctuates widely in supplying a dense replenisher, resulting in very labile photographic performance. Still another problem is that the amount of waste plastic containers remains unchanged, in comparison with the conventional replenishing method, even when dense kits are supplied.

In addition to the above methods, some proposals have been made to obviate the use of plastic containers and improve replenisher chemical stability.

For example, Japanese Patent Publication Open to Public Inspection (hereinafter referred to as Japanese Patent O.P.I. Publication) No. 11032/1983 discloses an art wherein developing components are encapsuled in microcapsules; Japanese Patent O.P.I. Publication No. 61837/1976 discloses photographic tablets containing a disintegrating agent. Japanese Patent O.P.I. Publication Nos. 109042/1990, 09043/1990, 39735/1991 and 39739/1991 disclose methods using granular photographic processing agents having a particular average grain size.

The photographic tablets containing a disintegrating agent described in Japanese Patent O.P.I. Publication No. 61837/1976 are merely easily-soluble tablets. This proposal never leads to the idea of the present invention that a solid processing agent is added directly to the processing tank and dissolved therein.

Japanese Patent O.P.I. Publication No. 109042/1990 describes a granular photographic processing agent having a particular average grain size.

However, none of these publications proposes an automatic processing machine which has sufficiently simplified operability free of replenisher dissolving operation and which offers stable photographic performance or a compact automatic processing machine having no replenisher tanks.

On the other hand, as a means for obviating the necessity for previous dissolving operation, Japanese Patent O.P.I. Publication No. 11344/1991 discloses an art wherein pasty part agents, in amounts according to the mixing ratio of the part agents, are pushed out from respective unit containers and appropriately diluted at given dilution rates to accurately prepare and supply replenishers. Although this method really reduces or almost obviates the necessity for dissolving operation, pasty part agents are unstable because of the presence of solvent and are difficult to push out in given amounts for long periods, and in addition, when they are used at low frequencies, nozzle clogging tends to occur, which hampers the obtainment of constant photographic performance. Also, paste containers are required, which must be made of a flexible and tough material, usually a composite material, which is usually difficult to recycle and is hence undesirable from the viewpoint of environmental protection. Particularly, pasty chemicals are known to be poor in storage stability due to the use of organic solvent to prepare the paste.

Japanese Utility Model Publication No. 85732/1989 discloses an automatic processing machine having a means for adding a tablet fungicide to the stabilizer, but this never leads to the idea of a processing agent replenishment controlling means, since the fungicide itself poses no problem even in the event of entry in large amounts, and in addition, the addition of such a fungicide is essential, since its purpose is to preserve the stabilizer.

WO 91-07698 and WO 91-07699 disclose a method wherein CD-3 or CD-4 is added in a solid form while the other components added as activators in the form of liquid. However, the relevant patents concern with regeneration, particularly low rate replenishment involving almost no overflow, specifically a method wherein bromide and chloride ions are adsorbed and removed from the developer by means of ion exchange resin, after which the lacking components, namely alkali agent activator and a small amount of solid or liquid dense color developing agent are added while maintaining a constant volume.

The present invention is totally different from the inventions described above in that processing agent replenishment is achieved solely by adding a removely weighed solid processing agent to the processing tank and dissolve it therein, whereby previous replenisher dissolving operation is obviated to ensure maintenance-free operation; the present invention is never expected from the above invention.

On the other hand, it was proven that a solid processing agent has the following problems. Since a solid processing agent is composed of materials dissolvable in a processing solution entirely, it is effected by water to be deformed, in most cases due to humidity.

When such an altered solid processing agent is supplied to a processing solution, it was proven that not only deterioration in processing ability of aforesaid processing solution is caused but also various adverse influences take place in automatic processing machine itself, especially to a solid processing agent supplying means or a housing means causing problems. In other words, it was proven that, due to partial dissolution of the solid processing agent cause by moisture, elements of solid processing agent dissolved stick inside the solid processing agent supplying device in the automatic processing machine or inside the housing means causing contamination. Or, when a solid processing agent is a tablet or a pill, solid processing agents adjoining each other are forced to be sticked together due to moisture. On the other hand, when a solid processing agent is a powder or a granule, solid processing agents are joined to form a large clumps due to humidity, resulting in caking. In any case, when solid processing agents are clogged at the supplying port of the solid processing agent supplying device to a processing tank, the prescribed amount of supplying may be stopped, causing problem. In addition, with regard to processing solution quality too, increase of the moisture content ratio in the solid processing agent due to high humidity promotes oxidation and sulfurization of the components in the solid processing agents, which causes lowering of property resulting in problems.

Technologies for solving the above-mentioned problems have already been described in Japanese Patent Application Nos. 107713/1993, 107714/1993, 107715/1993 and 107716/1993 by the present inventor.

However, the above-mentioned applications relates to apparatuses preventing soaking of solid processing agents inside the supplying device due to splashing of the processing solution when aforesaid solid processing agent is supplied to the processing solution in the automatic processing machine directly. Accordingly, wetting of solid processing agents and deformation thereby due to the entering of vapor which generates from the automatic processing machine to aforesaid supplying device, no consideration was paid, or only insufficient consideration was paid.

On the other hand, Japanese Patent OPI Publication No. 213454/1992 discloses a device provided with an exhausting port and a conveyance section in a dehumidified space closed tightly in an automatic processing machine wherein a granular processing agent is added to a processing tank. In this apparatus, aforesaid solid processing agent can be protected from humidity by means of a methods to use package provided with a dehumidifying treatment until it is housed to a solid processing agent supplying device. However, once the agent is housed to the supplying device, it may be kept as it is for 1 month or more in an automatic processing machine with low replenishing processing. In this meaning, in the case that the humidity outside is high such as in the summer season in Japan, or in the case aforesaid processing machine is installed in a place where humidity is regarded as high normally, the above-mentioned patent application did not pay any consideration on a measure against wetting and deformation when aforesaid solid processing agent is exposed to air outdoor with high humidity.

Especially, since a light-sensitive material is processed in an automatic processing machine in such a manner that the a processing solution is kept at a certain temperature, evaporation of the processing solution occurs and also evaporation of moisture from the light-sensitive material in a drier section in the automatic processing machine occurs. Accordingly, the humidity surrounding the automatic processing machine is liable to be high by nature, causing the above-mentioned problem noticeably.

The following issues are further cited as conventional problems:

In an automatic processing machine wherein a conventional processing agent is dissolved for a replenisher solution in advance and processing operation is conducted while supplying the replenisher solution into a processing tank when necessary, water is required for dissolution and dilution of the processing agent iwhen a replenishng water is supplied and for supplementation of evaporation from the processing solution.

In order to feed water from a water supplying source such as tap water to an automatic processing machine, there may be a method to connect the tap water and the automatic processing machine directly. However, since many problems exist such as that the conditions for establishing the automatic processing machine and a water piping are controlled strictly, the above-mentioned method is not used commonly. Accordingly, in most cases, a method to convey water manually from the water supplying source located near the automatic processing machine is adopted. However, this work requires much labor to persons who use the automatic processing machine. Especially, when there is no water supplying source near the automatic processing machine, it is necessary to convey water from a distance, and in some cases, water must be conveyed from the lower floor, resulting in very insufficient automatic operation.

In addition, recently there has been a trend in automatic processing machines for down-sizing. following it, automatic processing machines began to be installed in places where automatic processing machines had not been installed previously. In general, most of such places do not have a ready water supply source closely, resulting in troublesome water supplying work requesting labor as stated above. This is another problem.

In an automatic processing machine wherein the solid processing agent of the present invention is dissolved directly in a processing tank, it is desirable to sense the amount of processing of a photographic light-sensitive material at the same time as supplying the solid processing agent before supply replenishing water and to keep photographic properties at a constant level by diluting reaction inhibiting components eluted arising from processing. The water supplying work for this has still remained necessary. This is still another problem.

On the other hand, a method to dehumidify air taken into an automatic processing machine and to supply water generated there to a processing tank or a tank for a replenisher solution is disclosed in Japanese Patent OPI. Publication No. 219245/1991. In addition, a method to supply water obtained by concentrating vapor exhausted from the drier section and a processor section to the processor section is disclosed in Japanese Patent OPI. Publication No. 78851/1992. The purpose of these two applications is to obtain water for a method and an apparatus for processing light-sensitive materials while supplying a replenisher solution from the tank for a replenisher solution to the processing tank when necessary and water for compensating for evaporation of the processing solution. Accordingly, these applications cannot foresee the concept of the present invention to keep replenishing water in an automatic processing machine of the present invention wherein solid processing agents are dissolved into the processing tank directly and to result in maintenance-free function because replenishing solution is not necessary to be prepared.

In addition, in methods and apparatuses wherein an device like a dehumidifier is provided in an automatic processing machine which processes light-sensitive materials while supplying a replenishing solution from a conventional tank for replenishing solution in the relevant field to a processing tank when necessary, in addition to a supplying means for replenisher for processing solution, a means for controlling supplying and tanks, both of which are necessary for replenishing water use removely. Accordingly, when comparing with a method wherein similar devices are provided in an automatic processing machine of the present invention which dissolves solid processing agents directly to the processing tank, the automatic processing machine becomes complicated and unwieldy. This is another problem.

In addition, in Japanese Patent OPI. Publication No. 219245/1991, a method to obtain water by dehumidifying air taken in by a drier is disclosed. However, it also is a method and an apparatus for processing light-sensitive materials while supplying a replenishing solution into a processing tank when necessary. The object of this method and apparatus is to obtain water for dissolving or diluting processing agent when a replenishing solution is produced and water supplementing vapor from the processing solution. Accordingly, they cannot foresee the concept of the present invention to make maintenance-free function because it is not necessary to keep replenishing water and to prepare a replenishing solution in an automatic processing machine of the present invention wherein solid processing agents Are dissolved directly to a processing tank and to prevent deformation of solid processing agents due to humidity.

On the other hand, in Japanese Patent OPI. Publication No. 78851/1992, a separate device to return water obtained by a vapor condenser placed above the processing tank to the above-mentioned processing tank placed below thereof. The object of this invention is to obtain water for supplementing vapor from a processing solution in a method and an apparatus to process light-sensitive materials while supplying replenishing solution from a tank for a replenishing solution to a processing tank when necessary. Accordingly, from this, the concept of the present invention to keep replenishing water in an automatic processing machine of the present invention wherein solid processing agents are dissolved into a processing tank directly is not foreseeable.

In addition, in the invention disclosed in Japanese Patent OPI. Publication No. 78851/1992, a condenser must be provided to each processing tank. Accordingly, not only that the automatic processing machine becomes complicated and large in size in total but also that troublesome water supplying work remains necessary for supplementing moisture for other purposes such as diluting water necessary for processing light-sensitive materials though evaporation can be supplemented to some extent.

On the other hand, apart from the above-mentioned method, a technology to reuse effluent for reducing the amount of effluent was disclosed in Japanese Patent OPI Publication No. 174154/1991. This is extremely effective for reducing the amount of effluent. In addition, it has a benefit that concentration of replenisher is not necessary to some extent. However, a stock tank is required for each processing tank and a dissolution tank is additionally required. Only with them, enormous space is required. In addition, due to the existence of dissolution operation, troublesomeness for it is not lightened. Furthermore, when an overflowed solution is recycled completely, elusion from a light-sensitive material is accumulated. Accordingly, in order to dilute or reduce accumulated material, part of it is abolished or recycled by means of ion-exchanged resin. Accordingly, it causes some problems on a mini-lab or the like.

However, the above-mentioned photo-effluent causes extremely severe pollution and regulations against environmental pollution have recently been enforced. Accordingly, it is substantially impossible to drain photo-effluent into sewage systems or rivers. Therefore, currently, photo-effluent is collected and disposed by specialized firms. However, a method of entrusting disposing effluent to such firms for disposing effluent has shortcomings since considerable space for storing effluent and expensive cost for collection. In addition, extremely large-scale facilities are necessary for disposing of effluent in an environmentally friendly manner. For installing such a disposing facilities, enormous cost is required and cost for disposing also become expensive. Accordingly, some of effluent collected is dumped into the ocean. Since entire prohibition on dumping into the ocean is pressing now from the viewpoint of protecting worldwide environment, disposal of effluent has come to be a critical problem to our industry.

In addition, as stated above, that replenishing water is necessary means that the supply source for the replenishing water must be located in the vicinity from the processing plants. Recently, following prevailing of mini-labs and micro-labs, the number of cases in which photographic processing must be conducted where there is no tap water closely has been increased. Accordingly, keeping water has become a critical problem. This problem is especially critical when a solid processing agent is used. It is no exaggeration to say that it is an only maintenance activity conducted by manual. In order to solve these problems, a technology to reuse distilled liquid generated from evaporation of photo-effluent is disclosed in Japanese Patent OPI. Publication No. 201442/1987. However, the object of this method is to produce a replenisher by mixing a solution in the dissolution tank. Therefore, it is considerably different from the object of the present invention to pursue maintenance-free function so that it is impossible to foresee the present invention. In addition, in Japanese Patent OPI. Publication No. 78746/1991 discloses a method to introduce dry heat in a effluent tank for reusing the resulting moisture. However, no concept and technology for eliminating dissolution operation of the present invention and provide maintenance-free function were disclosed. Accordingly, it is completely different from the present invention. In addition, Japanese Patent OPI. Publication No. 219245/1991 discloses a method to supply moisture generated by the use of Peltier element to the processing tank in the same manner as the preceding invention. However, neither its structure nor technological concept were the same as the present invention.

In addition, it is common that replenishing water is stored in a plastic bucket in the form of water. It is gradually fed to the processing tank. Accordingly, the time of storage in the stock tank is frequently elongated so that propagation of mildew and bacteria is easily to occur. When mildew and bacteria are also fed with replenishing water, a large amount of gelatin contained in a color paper or the like becomes a suitable victim to them, easily causing deterioration of images after being stored. In addition, not only mildew or bacteria, heavy metal components and sulfur components due to rust may be contained in water used as a supplying source for replenishing water, neither of which is acceptable in terms of photographic processing stability. Only in replenishing water, all of the above-mentioned problems are potential so that immediate solution is urged.

SUMMARY OF THE INVENTION

It is an object of the present invention to provide an automatic processing machine capable of obviating the use of liquid chemicals dangerous in transport and handling to allow the use of solid chemicals without troublesome operation by the user.

It is another object of the present invention to provide an automatic processing machine obviating the necessity of manual dissolving operation by the user for a completely automated replenishing system.

It is still another object of the present invention to provide a compact automatic processing machine having no built-in replenishing tanks.

It is yet another object of the present invention to provide an automatic processing system free of the necessity of liquid replenisher storage and offering improved processing stability.

It is still yet another object of the present invention to provide an environmentally friendly processing system using a reduced amount of plastic packaging material by obviating the use of plastic bottles for liquids.

A sixth object of the present invention is to attain an automatic processing machine wherein the quality of solid processing machines supplied can always be kept high.

A seventh object of the present invention is to attain an automatic processing machine capable of saving labor in water supplying work necessary for processing light-sensitive materials.

A eighth object of the present invention is to attain a system wherein photo-effluent is stored so that labor for removing photo-effluent can significantly be saved.

An 9th object is to attain a system for supplying water without propagation of mildew or bacteria and without contamination of heavy metal and with a stable quality not depending on tap water as a supply source for replenishing water.

The present inventors studied the above-mentioned problem from various points of view. As a result, the inventors discovered the above-mentioned problems can be solved by the following methods for attaining the present invention.

Namely, the objects of the present invention can be attained by an automatic processing machine for a silver halide photographic light-sensitive material, wherein the automatic processing machine comprises at least one processing tank which houses a processing solution for processing light-sensitive materials exposed, housing means for housing solid processing agents respectively weighed in advance and/or means for setting a housing package for housing the above-mentioned solid processing agent, supplying means for supplying the above-mentioned solid processing agent respectively weighed to the above-mentioned processing tank, processing amount sensing means for sensing information on processing the above-mentioned silver halide photographic light-sensitive material, controlling means for controlling the above-mentioned supplying means so as to supply solid processing agents in accordance with the information on the amount of processing the above-mentioned silver halide photographic light-sensitive materials sensed by the above-mentioned sensing means, device for removing moisture from ambient air.

In addition, as specified embodiments of the present invention, (2) in the automatic processing machine for a silver halide photographic light-sensitive material described in (1) above, the above-mentioned solid processing agents are powder, granule or tabulated and molded tablets respectively weighed in advance, (3) in the automatic processing machine for a silver halide photographic light-sensitive material described in (1) or (2) above, above-mentioned device for removing moisture from air intakes air outside of the automatic processing machine, (4) in the automatic processing machine for a silver halide photographic light-sensitive material described in either (1) through (3) above, above-mentioned device for removing moisture from air intakes air in the drier section of the automatic processing machine, (5) in the automatic processing machine for a silver halide photographic light-sensitive material described in either (1) through (4) above, above-mentioned device for removing moisture from air intakes air from the upper portion of a processing tank of the automatic processing machine, (6) the automatic processing machine for a silver halide photographic light-sensitive material described in either (1) through (5) above has a supplying device which supplies the condensed water removed by the above-mentioned device for removing moisture from air to the above-mentioned processing tank, (7) the automatic processing machine for a silver halide photographic light-sensitive material described in either (1) through (6) above has a means for supplying dry air generated from the above-mentioned device for removing moisture from air to the above-mentioned supplying means and/or a housing means for solid processing agents and (8) in the automatic processing machine for a silver halide photographic light-sensitive material described in either (1) through (7) above, the above-mentioned device for removing moisture from air is structured by at least one of apparatuses or methods selected from the below-mentioned items (a) through (c).

(a) an apparatus or a method for condensing air by means of a heat pump, (b) an apparatus or a method for condensing air by means of an electronic chilling element or (c) an apparatus or a method for separating moisture by means of a semi-permeable membrane which removes vapor from air.

In addition, it was discovered that the above-mentioned problems can be attained by the following structure.

An automatic processing machine for a silver halide photographic light-sensitive material is characterized by comprising a processing tank containing a processing solution, wherein the tank includes a processing section to process the light-sensitive material and a processing agent supplying section where the processing solution is adapted to circulate between the processing section and the processing agent supplying section; a housing means for housing each solid processing agent and/or a supporting means for setting a package housing aforesaid processing agent, a supplying means for supplying above-mentioned solid processing agent to the above-mentioned processing agent supplying section, a processing amount sensing means for sensing information on the amount of processing the above-mentioned silver halide photographic light-sensitive material, a control means for controlling and operating the above-mentioned supplying means so as to supply each solid processing agent in accordance with the information on the amount of processing the above-mentioned silver halide photographic light-sensitive material; replenishing water supplying means for supplying the replenishing water to the above-mentioned processing section or the processing agent supplying section and a distilling means for photographic processing solution, and by utilizing distilled water produced by means of the above-mentioned photographic processing solution distilling means as a part or the whole of the above-mentioned replenishing water.

BRIEF DESCRIPTION OF THE DRAWINGS

FIG. 20(A) shows a cross-sectional view of a powder-type processing agent supplying device and;

FIG. 20(B) shows a perspective view of a package.

FIGS. 27(A) to 27(C) are cross-sectional views of still another supplying apparatus.

FIG. 36(A) through 36(D) show examples of three-side and four-side seal packages.

FIGS. 39(A) through 39(E) are examples of PTP packaging.

FIGS. 40(A) through 40(C) are examples of bulk packaging.

DETAILED DESCRIPTION OF THE PREFERRED EMBODIMENT

Figure 1:
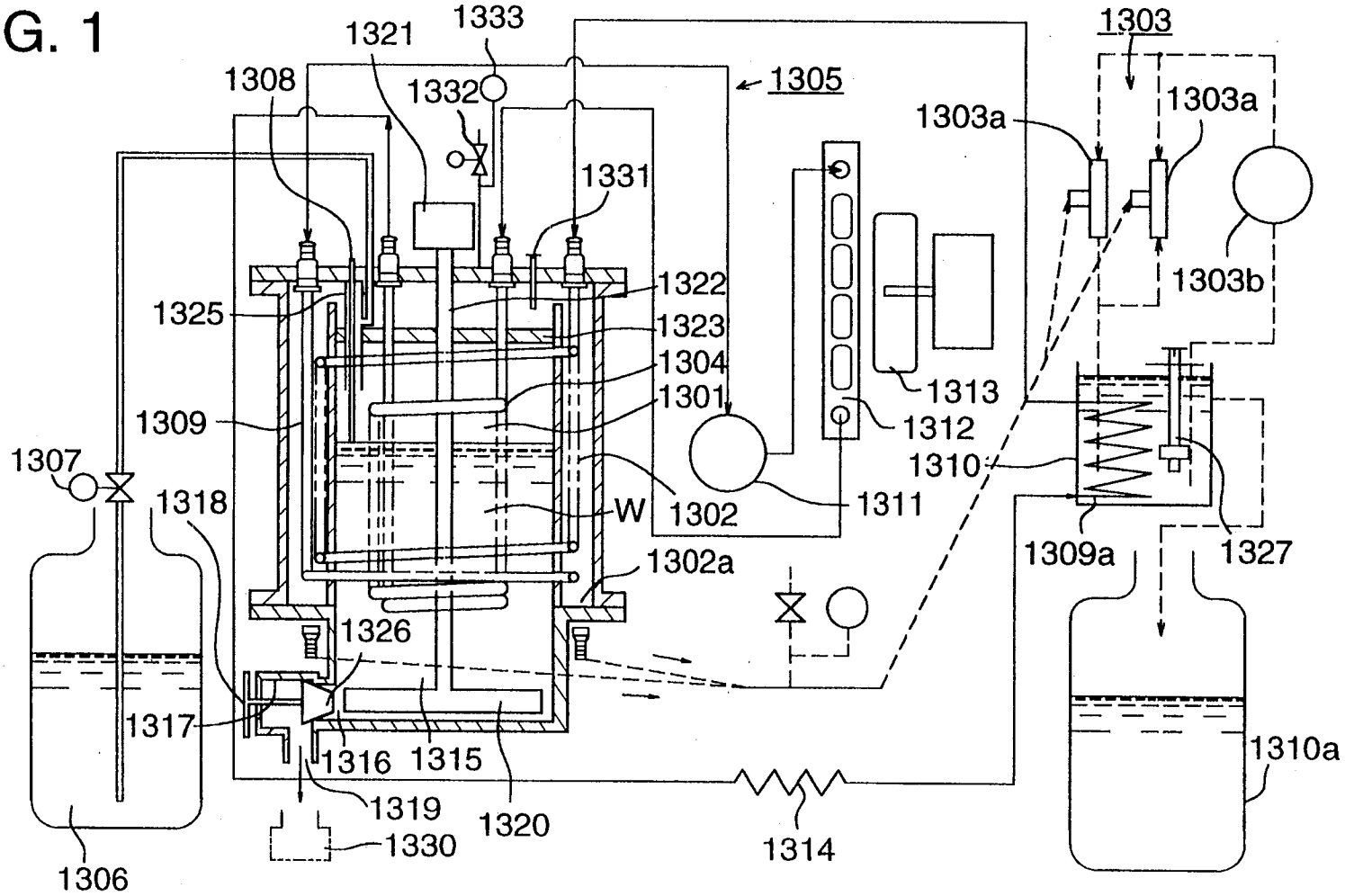
FIG. 1 shows an example of an evaporation and concentration device which can be used for an automatic processing machine for photographic processing use of the present invention.

The present inventors made extensive experiments concerning the direct addition of a solidified processing agent to a tank, and determined the optimum replenishing rate for each processing solution free of photographic performance fluctuation. Although this optimum replenishing rate was thought to depend on the size of the processing tank of the automatic processing machine, i.e., the volume of the processing solution, the inventors found that efficient use of a property of solid chemicals, i.e., practically low solubility, is advantageous that the concentration does not rise rapidly even if the chemical is added at a time, replenishing water can be injected according to the dissolution, and very stable photographic performance is obtained. It was realized that dissolution before using is not an essential requirement.

The amount of processing agent added at a time is preferably 0.1 to 50 g, more preferably 1 to 20 g for color developer, 5 to 50 g for fixer and bleach-fixer, 0.1 to 10 g for stabilizer, and 0.5 to 20 g for black-and-white developer. Even when a solid processing agent is added directly to the processing tank of an ordinary small-sized processing machine in this amount range and processing is carried out while dissolving gradually the solid processing agent, the photographic condition is not adversely affected. This is because the solid processing agent exhibits stable processing performance with its composition well balanced according to the amount of consumption while continuing the processing even when a large amount is added at a time because the solid processing agent dissolves gradually rather than rapidly, as stated above. It was found that photographic performance can also be kept constant by injecting replenishing water according to the dissolution. This is quite a surprising finding which has not been reported. Also, in the present invention, the solid processing agent is added directly to the processing tank, wherein the processing solution is always kept almost constant at the processing temperature, i.e., dissolution speed is almost constant throughout the year, which makes it possible to obtain the desired preset balance of the addition of the solid processing agent and the composition. Another great advantage was found that the so-called non-dissolution phenomenon does not occur as in dissolution in cold water. The non-dissolution phenomenon, named by the present inventors, is a solidifying phenomenon occurring upon addition of a solid processing agent to cold water at a time followed by slow or almost no stirring, resulting in vitrification of the solid processing agent. The solid processing agent, once vitrified, long remains undissolved even with vigorous stirring. In contrast, dissolution in warm water at the processing temperature for the automatic processing machine allows sequential dissolution of the solid processing agent even if it is added in large amounts at a time. The present inventors made further investigations based on these findings, and developed the present invention.

In the present invention, means for supplying a solid processing agent to the processing tank are exemplified by known methods such as those described in Japanese Utility Model Publication Nos. 137783/1988, 97522/1988 and 85732/1989 for tablet processing agents. Essentially, any method is acceptable, as long as a means for supplying the tablets to the processing tank is provided. For granular or powdery processing agents, available methods include gravity fall methods such as those described in Japanese Utility Model Publication Nos. 81964/1987, 84151/1988 and Japanese Patent O.P.I publication No. 292375/1989, and screw-based methods such as those described in Japanese Utility Model Publication Nos. 105159/1988 and 195345/1988. These examples are not to be construed as limitative.

Preferably, however, for supplying the solid processing agent to the processing tank, a given amount of the solid processing agent, previously separately packaged, is taken out from the package according to the amount of processing of the light-sensitive material. Specifically, the solid processing agent, in a given amount, preferably in an amount equivalent to a single replenishment, is housed in a package of at least two packaging materials, which package can be separated in two directions or part thereof can be broken to allow the solid processing agent to be taken out. The solid processing agent is thus allowed to fall freely and to be supplied easily to the processing tank equipped with a filtering means. The given amount of the solid processing agent remains moisture-resistant unless the package is opened, because each is contained in a separately sealed package to avoid contact with the atmosphere and the adjacent solid processing agent.

A mode of embodiment is a package of at least two packaging materials between which the solid processing agent is inserted, wherein the two packaging materials are in contact or adhesion mutually so that they can be removed from each other. By pulling in different directions, the packaging materials are removed on the contact or adhesion surface, so that the solid processing agent can be taken out.

In another mode of embodiment, at least one of the two packaging materials, between which the solid processing agent is inserted, is made openable by external force. The term "opening" mentioned herein means cutting or breakage of the package while leaving a part thereof intact. For opening the package, the solid processing agent is forced to be pushed out by exerting a compressive force in the direction from the non-openable packaging material to the openable packaging material via the solid processing agent, or the solid processing agent is made takable by cutting the openable packaging material with a sharp element.

A supply starting signal is generated by detecting information on the amount of processing. Upon reception of such supply starting signal, the driving means for separation or opening is activated. A supply stopping signal is generated by detecting information on the completion of supply of a specified amount. Upon reception of such supply stopping signal, the driving means for separation or opening is disabled.

The above solid processing agent supplying means is equipped with a controlling means for adding a given amount of the solid processing agent according to information on the amount of processing of light-sensitive material, which constitutes a key to the present invention. It is essential for the automatic processing machine of the present invention to keep the component concentration in each processing tank constant and hence stabilize photographic performance. The information on the amount of processing of silver halide photographic light-sensitive material is a value in proportion to the amount of the silver halide photographic light-sensitive material to be processed by a processing solution or the amount of the silver halide photographic light-sensitive material already processed by a processing solution or the amount of the silver halide photographic light-sensitive material being processed by a processing solution, offering a direct or indirect index of the reduction in the amount of the processing agent in the processing solution. This information may be detected at any timing, before or after light-sensitive material transportation into the processing solution or during its immersion in the processing solution. It may also be the amount of the light-sensitive material printed using a printer, or the concentration of the processing solution contained in the processing tank or concentration change, or the amount discharged after drying the processing solution.

Although any portion is acceptable to add the solid processing agent of the present invention, as long as it is located in the processing tank, preference is given to a portion communicating with the processing portion for the light-sensitive material and allowing the processing solution to flow to/from the processing portion. The preferred configuration is such that a given amount of processing solution is circulated to/from the processing portion to allow the dissolved components to be transferred to the processing portion. It is preferable to add the solid processing agent into a processing solution being warmed.

Usually, the automatic processing machine is equipped with an electric heater to warm processing solutions, wherein a heat exchanger is provided in the auxiliary tank connected to the processing tank (processing portion), which auxiliary tank is equipped with a pump for supplying the solution at constant rate from the processing tank to have constant temperature.

A filter is usually arranged to remove crystalline foreign substances occurring due to contamination or crystallization in the processing solution.

It is most preferable to add the solid processing agent to a warmed portion communicating with the processing portion like this auxiliary tank. This is because the insoluble components of the added processing agent are isolated from the processing portion by the filtering portion to prevent the solids from entering the processing portion and adhere to the light-sensitive material etc.

Also, when a processing agent receiving portion, along with the processing portion. is provided in the processing tank, it is preferable to provide a shield or another device to avoid direct contact of the insoluble components with the film etc.

For the filter and filtering apparatus, any material can be used, as long as it is commonly used in ordinary automatic processing machines, and the effect of the present invention is not affected by any particular structure or material.

In the present invention, the addition of a solid processing agent to the processing tank obviates the necessity of tanks etc. for storage the replenishers and making the automatic processing machine compact, and provided that the automatic processing machine is equipped with a circulating means, solid processing agent solubility improves markedly.

It is desirable to provide replenishing water supplying means, desirably under control by the photographic light-sensitive material processing amount detecting means necessary to control the addition of the solid processing agent. It should be emphasized, however, that the replenishing water is not for dissolving the solid processing agent, i.e., the solid processing agent and the replenishing water have totally reverse functions in that the former is for compensating the shortage of components consumed by processing, while the latter is for diluting the reaction inhibitory components dissolved upon processing to make photographic performance constant. Traditionally, water has been used to dissolve chemicals. In contrast, in the present invention, as stated above, the primary purpose of the addition of replenishing water is to dilute the cumulative components dissolved upon reaction while compensating the water loss due to carry-over by the photographic material and evaporation via the tank surface. It is therefore preferable to control the replenishing water supplying means by the processing amount detecting means, since a sensor can be omitted, though it may be controlled removely from the addition of the solid processing agent.

In the present invention, wherein a solid processing agent is added directly to the processing tank, water is therefore unnecessary merely for the purpose of preparing replenishers as in the prior art. This feature results in a major secondary effect of overflow volume reduction. Traditionally, because of the common idea that replenishing solutions must be prepared in advance, as dense replenishing solutions as possible have been used to compensate the shortage of components. Although it has been realized that replenishing rates can be reduced by increasing the solution concentration, whereby the volume of overflow waste liquid, which poses an environmental problem, can be reduced, this has been impossible due to the limitation of the solubility of processing chemicals. In the present invention, the processing chemicals do not become more dense than the tank solution concentration, there is no high concentration state exceeding the tank solution, and replenishment is necessary for desired processing chemicals only; therefore, even overflow-free replenishment is possible.

However, as stated above, it is preferable to use replenishing water to lower the concentrations of accumulated reaction inhibitory components, particularly halide ions in the developer and silver ions in the fixer and bleach-fixer. This replenishing water serves to dilute these reaction inhibitory components and to removely compensate the water loss from each processing solution due to carry-over by the photographic material and evaporation via the tank surface, thus making a marked contribution to the improved processing stability of the present invention.

Therefore, the controlling information used to supply replenishing water includes the amount (e.g., area) of processing of the photographic material, acting time, warming time, stopping time, installation site ambient temperature and relative humidity, and solid processing agent dissolution speed. Controlling the amount of replenishing water added based on these information parameters will make it possible to manage the chemical components in the processing tank in an ideal condition; this may be an epoch-making method of photographic processing management as viewed from the viewpoint of photographic performance. This is because conventional methods have a major problem in which the processing agent components become increasingly dense due to evaporation via each tank as the replenishing rate decreases. Generally, the most preferable for correction for evaporation loss is to dilute the replenisher and supply it in large amounts, but this has a drawback of environmentally undesirable increase in overflow waste. For this reason, the trend has been toward lower replenishing rates. The use of replenisher to compensate the evaporation loss leads to its entry into the processing tank even in the absence of processing, resulting in an imbalanced composition. Thus, it has been a common practice to compensate the water loss by supplying water to reach the starting level every morning, but this is merely the addition of water to the processing solution in the tank whose volume has decreased due to temperature change, rather than compensation of the water loss due to evaporation with water, offering no real solution.

Appropriate compensation for the water loss due to evaporation is to keep the component balance constant except for component change due to consumption by the photographic material, or to supply water according to the amount of water loss due to evaporation caused by the tank solution temperature and tank surface vapor pressure, irrespective of the presence or absence of processing.

Accordingly, in the present invention, replenishing water is supplied for three purposes: 1) To dilute the accumulating harmful inhibitory components dissolving upon reaction in light-sensitive material processing to keep a constant concentration, 2) to dilute the undesirable chemicals carried over by the processed photographic material or by the previous solution, and 3) to compensate the water loss due to evaporation via the tank surface. Information required to accomplish these purposes is detected, based on which the preset water supplying means is controlled to perform the tasks. This is a new method made feasible by the present invention. This water replenishing means for the present invention proved to offer marked improvement in processing stability. In the present invention, the solid processing agent is removely weighed in a given amount, preferably a specified amount. This ensures very accurate replenishment in the automatic processing machine of the present invention, offering very stable continuous processing performance. The phrase "previously removely weighed" mentioned herein means that before charging the processing agent to the automatic processing machine of the invention or before setting the package containing the processing agent to the immobilizing means, the processing agent was removely weighed in a given amount, involving embodiments wherein tablets or pills of a given size are formed and embodiments where granules or powder is packaged in a given amount. However, the scope of the invention does not include the embodiments wherein powder or granules are placed in a storage means and an amount corresponding to a single addition is weighed out upon supply. In the conventional replenisher supplying system, a bellows pump is used, but its precision is not constant so that it is unsuitable to precise control of replenishment. On the other hand, in the present invention, the solid processing agent is weighed in a specified amount at, for example, the factory where it is produced, and replenishment is controlled on an ON/OFF basis by determining whether the solid processing agent is added or not, thus involving no dispersion among replenishing operations. Processing agent supply accuracy is therefore markedly high, which is also conducive to stable processing performance.

In the present invention, since the automatic developing machine has a device for removing moisture from air, wetting and deformation of the solid processing agent housed in aforesaid solid processing agent supplying device due to humidity can be noticeably inhibited by dehumidifying and drying air surrounding the automatic processing machine, especially near the solid processing agent supplying device in aforesaid automatic processing machine. For example, when aforesaid solid processing agent is in tablet or pill form, supplying excessive amount of agent comparaed to the prescribed one or supplying no agent due to sticking or clogging of tablets, though the agent was in advance divided into the prescribed amount and weighed, can be prevented.

In addition, by introducing the resulting dry air inside the solid processing agent supplying device, wetting and deformation of the solid processing agents housed inside aforesaid solid processing agent supplying device can be inhibited noticeably.

As a device for removing moisture from air, a dehumidifier commercially available in the market can be used. In addition, a device employing a device or system to condense air by the use of a heat pump or an thermo-chilling-element (Peltier element) can be used. In addition, a structure by the use of a device or a system to remove moisture by the use of a semi-permeable membrane which removes vapor from air. For aforesaid devices, see Chemical Technology Volume 53, No. 1 (1989), pp. 51 to 53.

In addition, the above-mentioned devices and systems can be used in combination.

A good timing for having the above-mentioned device for removing moisture from air work is when the humidity near the automatic processing machine, above the processing tank and the drying section becomes high or, in other words, when the automatic processing machine is working because aforesaid device can absorb moisture most effectively. Accordingly, it is desirable to operate aforesaid device in conjunction with with the automatic processing machine. The device can be controlled in such a manner. In addition, even when the automatic processing machine is not operating, it is desirable to have aforesaid device for removing moisture from air work in the case that humidity near the automatic processing machine as summer season in Japan. I is desirable, as a controlling means, to control and operate aforesaid device for removing moisture from air for detecting humidity in the solid processing agent supplying device and to maintain humidity to a certain low level.

In the automatic processing machine of the present invention, it is a preferred embodiment to provide replenishing water supplying means, a control means for supplying replenishing water and replenishing water tank, wherein water generated by means of the device for removing moisture from air can be utilized by these means without being equipped with a special additional device. Accordingly, labor and energy for water supplying operation can be saved without deteriorating reduction of the automatic processing machine.

Conventional systems and apparatuses wherein moisture is condensed by providing a device for removing moisture from air such as a dehumidifier in an automatic processing machine which processes a light-sensitive material while supplying a replenisher from a replenisher tank for processing solutions to a processing tank as necessary, in addition to a supplying means, supplying controlling means and a tank for a replenisher for a processing solution, such means for replenishing water. Thus, the present invention solved a problem that conventional automatic processing machines was forced to be large in size and complicated though they could lighten water supplying operation completely by the use of a solid processing agent.

In addition, by structuring the above-mentioned device for removing moisture from air in the manner to intake air in the drier section in the automatic processing machine, air with high humidity can be taken into the device for removing moisture from air when the automatic processing machine is operated. Therefore, not only that water can be obtained effectively but also that ejection of high-humidity air to the outside of the automatic processing machine can be prevented. Thus, by maintaining surrounding each solid processing agent at low humidity, preservability is improved so that the objects of the present invention can be attained more effectively.

In addition, by structuring the above-mentioned device for removing moisture from air in the manner to intake air above the processing tank in the automatic processing machine, the effects in the same manner as the above-mentioned structure to intake air in the drier section can be obtained so that the objects of the present invention can be attained more effectively.

In addition, by structuring the above-mentioned device for removing moisture from air in the manner that the air can be circulated inside the solid processing agent supplying device, the same effect as the above-mentioned 2 cases can be obtained so that the objects of the present invention can be attained more effectively.

Next, a means for distilling a photographic processing solution (hereinafter also referred to as a photo-effluent processing apparatus.) will be explained. It is necessary for the photo-effluent processing apparatus, which is one of the structural requirements of the present invention, to be able to reuse capable of reusing distilled liquid occurring during a effluent concentrating process, wherein a vacuum distilling type evaporation and concentration apparatus is desirable. In addition, a heat pump and Peltier element are suitable as a heating means. As preferable processing conditions for evaporation and concentration, the processing temperature is preferred to be not more than 60° C. The processing pressure is preferred to be not more than 200 mmHg and more preferable to be not more than 100 mm Hg. Processing effluent by means of the above-mentioned apparatus and under the above conditions cause neither separation nor evaporation of materials contained in the effluent so that the occurrence of harmful gas and offensive odor is prevented, as well as providing distilled liquids capable of being reused with photographic process.

In the present invention, it is preferred to use a vacuum pump or an ejector as an evacuation means. Of the two, the ejector is preferred in terms of noise abatement, reduction of size of the apparatus and in terms of enhancing the effects of the present invention.

Next, an example of a preferred photo-effluent processing apparatus having an evacuating means will be explained referring to FIGS. 1 and 2.

Due to an apparatus as shown in FIG. 1 employing a heat pump as a heat source for evaporation and concentration under evacuated pressure, heat utilization efficiency is so high that evaporation and concentration can be conducted under low electric power consumption. In addition, heat separation and heat modification of the components of the photo-effluent due to high temperature can be prevented. Since it is maintenance-free, neither specialized technician nor operator is necessary. Its size can be reduced and the running cost is inexpensive.

In FIG. 1, 1301 shows an evaporation vessel which is not collapsed when evacuating. Photo-effluent is poured and stored inside this evaporation vessel 1301. Above the liquid surface of evaporation vessel 1301, demister 1323 is provided. 1302 is a chilling vessel enclosing evaporation vessel 1301 concentrically. The upper portion of chilling vessel 1302 is connected with the upper portion of evaporation vessel 1301 using the upper portion of demister 1323. In addition, the bottom of the chilling vessel is connected to an evacuating means 1303 to be evacuated. Due to demister 1323, splashing of concentrated components, in evaporation vessel 1301, and mixing with condensed water inside chilling vessel 1302 is prevented. As a result, evaporation and concentration can be conducted more safely. Evacuating means 1303 is composed of ejectors 1303*a* and 1303*a*. Aforesaid ejectors 1303*a* and 1303*a* operate their function to remove air by passing water inside tank 1310for condensed water driven by means of pump 1303*b*.

1304 is a spiral heating means located inside evaporation vessel 1301. Heating means 1304 and chilling means 1309 are parts of the structure of heat pump 1305. In heat pump 1305, a heat-transfer medium is compressed by compressor 1311 so that the temperature thereof is raised. The heat-transfer medium, whose temperature was raised by compression, passes through air-chilling means 1312, where it is chilled to a temperature which is appropriate for heating means 1304. Then, the heating medium is supplied to heating means 1304, where it heats photo-effluent W inside evaporation vessel 1301 for evaporation. In air-chilling means 1312, air-chilling fan 1313 is provided, where air-chilling means 1312 is chilled by air-chilling fan 1313. The lower portion of heating means 1304 is immersed in photo-effluent W and the upper portion thereof is above the surface of photo-effluent W. After passing through heating means 1304, the heat-transfer medium passes through capillary tube 1314 which serves as an expansion valve where it is expanded and evacuated. Thus, the temperature of the heat-transfer medium is reduced. The heat-transfer medium whose temperature has been reduced passes through chilling means 1309*a*, chills water inside a vessel for concentrated water and, then, supplied to chilling means 1309 where it chills and condenses vapor, which occurred in evaporation vessel 1301 and entered evaporation vessel 1302 to make condensed water. The resulting condensed water is stored at bottom part 1302*a* in chilling vessel 1302, sucked up by ejectors 1303*a* and 1303*a* and, then, collected in tank 1310 as condensed water. The heat-transfer medium passing through chilling means 1309 is turned to compressor 1311.

Numeral 1306 is a vessel for storing photo-effluent. 1307 is a feeding means provided with an electric valve pumping up the photo-effluent and feeding it to evaporation vessel 1301. 1308 is an electrode-type liquid surface detector which senses the liquid surface of evaporation vessel 1301. Aforesaid liquid surface detecting means 1308 is housed in cylinder 1325 in order to prevent mal-detection due to sticking of sludge of concentrated photo-effluent and washed with photo-effluent fed from tank 1306. Feeding means 1307 is controlled due to the results of detection by liquid surface detecting means 1308.

At the bottom of evaporation vessel 1301, sludge storage area 1315 for keeping sludge resulted from evaporation and concentration and sludge clean-out port 1316 are provided. Sludge clean-out port 1316 is tightly sealed by corking means 1317. On this corking means 1317, backing cork 1326 is provided for maintaining the evacuated condition inside evaporation vessel 1301. By drawing or pushing knob 1318 connected to backing cork 1326, sludge clean-out port 1316 can be opened and closed. In addition, to corking means 1317, sludge ejecting outlet 1319 is provided so that sludge-recycling container (shown by a dashed line) 1330 can be coupled to it.

1320 is a stirring blade housed in sludge storage area 1315. It is fixed to the bottom end of outputting shaft 1322 which hangs vertically from driving source 1321 placed at the top of evaporation vessel 1301. This stirring blade 1320 stirs sludge storage area 1315 thoroughly. In addition, it is so structured as to easily move sludge to taking-out portion 1316.

1332 is an electric valve. When foaming occurs during operation, it is detected by liquid surface detecting means 1331, and opening electric valve 1332 preventing photo-effluent from mixing with concentrated water.

1333 is a pressure sensor which monitors evacuating condition. 1310*a* is a container for storing for water overflow from tank 1310 for condensed water. 1327 is a liquid surface sensor which monitors the water level of tank 1310 for condensed water.

The above-mentioned evaporation and concentration apparatus is operated in the following manner.

By driving pump 1303*b*, condensed water in tank 1310 for the condensed water is fed to ejectors 1303*a* and 1303*a*. Evaporation vessel 1301 and the chilling vessel are evacuated so that photo-effluent is fed from tank 1306 to evaporation vessel 1301 by operating feeding means 1307. The evacuation condition inside evaporation vessel 1301 and chilling vessel 1302 can be sensed by means of pressure sensor 1333. After pressure is brought to a certain evacuated level, compressor 1311 is driven so that heat pump 1305 starts its operation. Though evacuation conditions may be sensed by means of pressure sensor 1333, the following step may be started after a specific time.

When compressor 1311 is driven, the heat-transfer medium is compressed raising its temperature. Air-chilling means 1312 is used for lowering the temperature of the heat-transfer medium whose a temperature has been raised by being compressed by compressor 1311 to temperature suitable for supplying the heat-transfer medium to heating means 1304. Heating means 1304 is chilled by air-chilling fan 1313. Capillary tube 1314 serves as an evacuation valve. The heat-transfer medium, after leaving heating means 1304, passes through capillary tube 1314, whereby the heat-transfer medium is swelled and its temperature is lowered. This heat-transfer medium having a low temperature passes through chilling means 1309*a* where the condensed water in tank 1310 for condensed water is chilled. Next, the heat-transfer medium passes through chilling means 1309 where vapor evaporated by evaporation vessel 1301 is chilled to result in condensed water. Then, the heat-transfer medium is returned to compressor 1311. Regarding capillary tube 1314, the up-stream side is a heating area, and the downstream side is a chilling area.

Photo-effluent W inside evaporation vessel 1301 is heated by means of heating mean 1304. The vapor so generated, is heated by heating means 1304 part of which is above the level of photo-effluent W. After passing through demister 1323, the vapor enters chilling vessel 1302 from the top of evaporation vessel 1301, where the vapor is chilled for condensing by chilling means 1309. The condensed water prepared in the above-mentioned manner is stored in area 1302*a* of chilling vessel 1302. Then, the vapor is collected by a vacuum produced by ejectors 1303*a* and 1303*a*, into tank 1310 for condensed water which is a storage container placed outside the vessel. Ejectors 1303*a* and 1303*a* serve to keep the pressure inside evaporation vessel low. In addition, the condensed water is stored in area 1302*a* of chilling vessel 1302. On the other hand, they serve to keep the pressure inside evaporation vessel 1301 low. Due to this and due to the chilling and concentration of vapor generated cooperatively, inside evaporation vessel is kept evacuaton. Water overflow from concentrated water tank 1310 is stored in storage container 1310*a*.

When the liquid surface inside evaporation vessel 1301 is lowered due to evaporation, the lowering is sensed by means of liquid surface sensing means 1308. Feeding means 1307 serves to supply photo-effluent. Thus, the height of the photo-effluent liquid surface is maintained at a certain level.

When evaporating of photo-effluent is bubbled, the demister prevents bubbles from entering the chilling vessel and mixing with condensed water.

Sludge concentrated to high density through repeating evaporation and concentration is stored at sludge storing port 1315, placed at the bottom of evaporation vessel 1301. Sludge collection container 1330 is coupled to the end of sludge exhausting port 1319. Backing cork 1326 is removed by operating knob 1318 and the stirring blade is rotated by operating driving source 1321. Thus, sludge stored at sludge storing section 1315 flows into sludge collection container 1330. Next, backing cork 1326 is closed by operating knob 1318. Sludge is collected by removing sludge collection container 1330 from sludge exhausting port 1319.

The present apparatus is controlled so that it starts operation when photo-effluent is present in tank 1306 and that it stops operation when the liquid surface is lowered near the bottom surface.

In FIG. 1, a heat pump is used as a heating means and as a chilling means. A Peltier element can be used as a heating means and a chilling means. Even when the Peltier element is used for a heating means and a chilling means, a processing apparatus for photographic processing solution can be structured in the same manner as shown in FIG. 1.

A Peltier element is an element which utilizes the Peltier effect.

Figure 2:
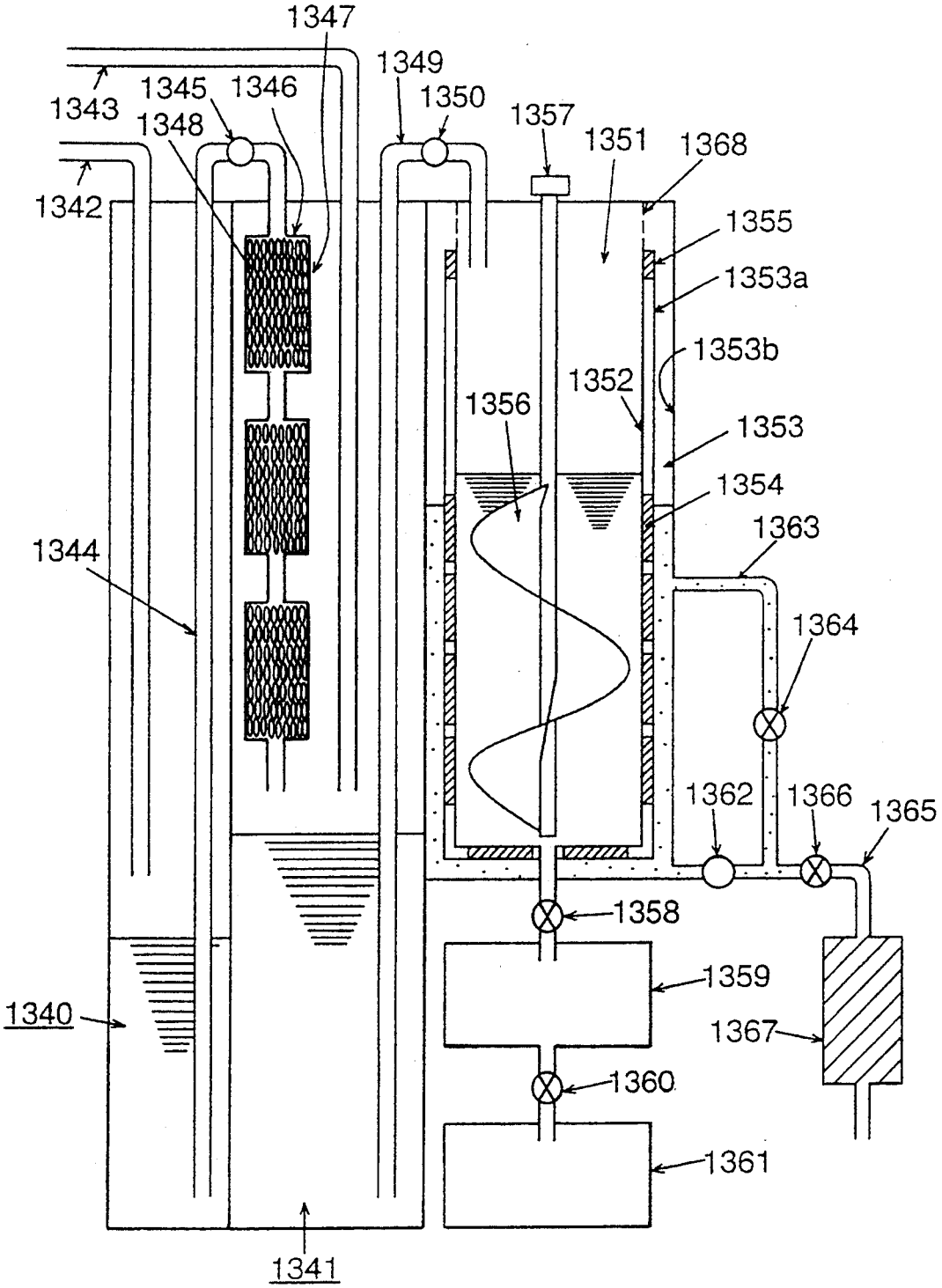
FIG. 2 is another example of an evaporation and concentration device which can be used for an automatic processing machine for photographic processing use of the present invention.

FIG. 2 shows an example of a processing apparatus for photographic processing solution which uses the Peltier element as a heat source.

In FIG. 2, numeral 1340 is a No. 1 storage tank which stores effluent before being condensed. 1341 is a No. 2 storage tank which also stores effluent before being condensed. 1342 is a pipe for feeding silver-content effluent. 1343 is a pipe for feeding silver-free effluent. 1344 is an effluent feeding pipe. 1345 is a pump. 1346 is a desilvering device. 1347 is a desilvering filter. 1348 is steel wool. 1349 is a pipe. 1350 is a pump. 1351 is a effluent-concentration device. 1352 is an evaporation tank. 1353*a* is an inner-tank. 1353*b* is an outer water tank. 1354 is the Peltier elements. 1355 is a sealing member. 1356 is a stirrer. 1357 is a motor. 1358 is a valve. 1359 is a temporary storage tank for concentrated effluent. 1360 is a valve. 1361 is a final storage container. 1362 is a pump. 1363 is a circulation pipe. 1364 is a valve. 1365 is an exhausting pipe. 1366 is a valve. 1367 is a filter. 1368 is a demister.

Silver-containing effluent such as a used fixer and bleach-fixer sent from the automatic processing machine is temporaryly stored in No. 1 storage tank 1340 through pipe 1342 for feeding silver-containing effluent. Silver-content effluent in No. 1 storage tank 1340 is pumped through pipe 1344 by pump 1345 to be fed to desilvering device 1346. Desilvering device 1346 is composed of 3 desilvering filters 1347 placed in series. Inside each desilvering filter, steel wool 1348 is housed. When silver-containing effluent contacts steel wool 1348, silver is replaced with iron for desilvering. Desilvered effluent drops in No. 2 storage tank 1341. Used silver-free effluent sent from the automatic processing machine passes through pipe 1343 for silver-free effluent and is stored in No. 2 storage tank 1341. Used silver-free effluent stored in No. 2 storage tank 1341 is sucked up by pipe 1349 and pump 1350 to be fed to concentration device 1351.

Concentration device 1351 is composed of evaporation device 1352 which evaporates effluent supplied therein and waste tank 1353 composed of inner box 1353*a* and outer box 1353*b* which enclose evaporation tank 1352.

In addition, between evaporation tank 1352 and water tank 1353, a large number of Peltier elements are placed in the manner that the heat emitting surface of the Peltier elements 1354 attaches to evaporation tank 1352 and heat absorption surface attaches to inner-box 1353*a* of water tank 1353. In addition, sealing element 1355 is placed on top of evaporation tank 1352 and above of inner tank 1353*a* for a liquid seal.

To concentrating and evacuating device 1351, there is provided an evacuating means, though it is not illustrated so that inside evaporation tank 1352 is evacuated.

The effluent supplied to evaporation tank 1352 is heated by means of Peltier element 1354 for concentration of effluent. Vapor generated overflows into water tank 1353, and is chilled by Peltier element 1354 to produce a distilled solution which is stored inside water tank 1353. Inside water tank 1353, a prescribed amount of water has been present in advance which is circulated through circulation pipe 1363 driven by pump 1362.

The effluent inside evaporation tank 1352 is stirred by stirrer 1356 rotated by motor 1357.

The effluent condensed in evaporation tank 1352 is temporaryly housed in storage tank 1359 for concentrated effluent and controled by opening valve 1358. In addition, the concentrated effluent inside storage tank 1359 is drained to final storage tank 1361 by opening valve 1360. Final storage tank 1361 is placed removably so that the concentrated effluent drained to final storage tank 1361 can be emptied.

By closing valve 1364 and opening valve 1366, the distilled solution stored inside water tank 1353 is drained through draining pipe 1365 and filter 1367, and reutilized. Filter 1367, is of activated charcoal applied for absorbing and removing impurities such as volatile materials contained in the distilled solution.

1368 is a demister, which prevents effluent inside evaporation tank 1352 from mixing with water in tank 1353.

In the above-mentioned manner, the effluent is evaporated and concentrated. The distilled solution generated is stored in a stock tank, and utilized as replenishing water for each tank. This distilled solution contains photographic processing solution components which are easy to volatilize appropriately. Accordingly, it is surprising that the distilled solution maintains almost the same components and pH value and is excellent in anti-mildew properties and anti-bacteria properties. To use it as replenishing water resulted in 2 unexpected benefits that stable processing properties can be obtained and that labor in supplying replenishing water can be saved.

Though distilled solution is applicable to all tanks, color developing solution requires extremely fine control on the composition of processing solution compared to the other processing tanks. Accordingly, in order to utilize the distilled solution as replenishing water without excess or shortage, it is preferably applied to the processing tanks but not the color developing tank.

Distilled solution obtained in the above-mentioned manner is desirable to be subjected to secondary treatment. Practically, aforesaid secondary treatment could be one of the following treatments:

(1) Treatment with activated charcoal
(2) Treatment with ultra violet ray irradiation
(3) Treatment with reverse osmosis
(4) Treatment with an oxidant
(5) Electrolytic oxidation treatment
(6) Aeration treatment
(7) Electrodialysis treatment
(8) Redistilling treatment
(9) Treatment with an ion-exchanged resin
(10) pH regulating treatment In addition, for part or all of the replenishing water, distilled water produced by this photographic processing solution distilling means in the present invention is used. However, depending on the processing amount of a silver halide light-sensitive material, the amount of replenishing water can become excessive or shorting as described above. Accordingly, it is necessary to use water from tap water and replenishing water provided from the above-mentioned secondary treatment as a part of replenishing water. The solid processing agent of the present invention may take any form, including powder, granules, tablets and pills, and even mixtures thereof are acceptable. Also, the objects of the present invention can be accomplished even when using the solid processing agent in combination with liquid, as long as it is safe, such as water. Tablets and pills are preferred for remove weighing. In the case of powder, it is preferable to removely package it in an alkali-soluble film, plastic film or paper after remove weighing.

Accordingly, tablets and pills permit supply in accurately removely weighed portions, and powder and granules are removely weighed and removely packaged, whereby the solid processing agent of the present invention is completed. Tablets and pills can be given moisture resistance by coating with a water-soluble moisture-resistant polymer or by using a moisture-resistant packaging material. Powder and granules can be given moisture resistance by using a moisture-resistant packaging material.

In addition, when the humidity in the solid agent supply device is maintained to be lower than a predetemined level and when the solid processing agent is powder or granule, the purpose of individual package is merely dividing it to a prescribed amount. Therefore, it is possible to attain the objects of the present invention even by the use of paper having substantially no dehumidifying property in terms of the material for packaging. The present inventor discovered, however, that the objects of the present invention can be attained more preferably by enclosing the agent with a water-soluble dehumidifying polymer or employing dehumidifying materials for the agent in the case of tablets and pills and by selecting dehumidifying material for individual package in the case of powder and granule.

The scope of solid processing agent mentioned herein includes powdery processing agents and solid processing agents in the form of tablets, pills, granules and others, which may be subjected to a moisture resistance treatment as necessary. Pasty or slurry processing agents are in the form of semi-liquid and poor in storage stability, and those of any shape subject to legal regulation because of danger in transport are not included in the scope of the solid processing agent of the present invention.

The powder for the present invention is defined as an aggregate of microcrystals. The granule for the present invention is defined as a particle having a grain size of 50 to 5000 μm, prepared by powder granulation. The tablet for the present invention are defined to be formed by compressing a powder or granule into a given shape.

Of the above solid processing agents, tablets are preferably used, since they offer high replenishing accuracy and are easy to handle.

For solidifying a photographic processing agent, various methods can be optionally selected; for example, a photographic processing agent in the form of a dense solution, fine powder or granules and a water-soluble binder are kneaded and formed, or a water-soluble binder is sprayed over the surface of the pre-formed photographic processing agent to form a coating (see Japanese Patent Application Nos. 29136/1992, 85533/1992, 85534/1992, 85535/1992, 85536/1992 and 172341/1992).

In the preferred method of tablet production, a powdery solid processing agent is granulated and then tableted. This method is advantageous in that photographic performance is stable as a result of improvement in solubility and storage stability, in comparison with solid processing agents prepared solely by mixing and tableting solid processing agent components.

For forming tablets, known granulating methods can be used, including tumbling granulation, extrusion granulation, compressive granulation, disintegration granulation, stirring granulation, fluidized bed granulation and spray drying granulation. In forming tablets, it is preferable to use a granulation product having an average grain size of 100 to 800 μm, more preferably 200 to 750 μm, since unevenness in the composition, or so-called segregation, is not likely upon granulation product mixing and compression. In addition, the grain size distribution is preferably such that not less than 60% of the grains fall in the range of ±100 to 150 μm apart from the average grain size. In compressing the granulation product obtained, a known compressing machine, such as a hydraulic press, a single tableting machine, a rotary tableting machine or a briquetting machine, can be used. Although the solid processing agent obtained by compression can take any shape, cylindrical agents, i.e., so-called tablets, are preferred from the viewpoint of productivity and handling quality.

More preferably, components such as an alkali agent, a reducing agent, a bleaching agent and a preservative, are removely granulated, whereby the above effect is enhanced.

Tablet processing agents can be produced by ordinary methods such as those described in Japanese Patent O.P.I. Publication Nos. 61837/1976, 155038/1979 and 88025/1977 and British Patent No. 1213808. Granular processing agents can be produced by ordinary methods such as those described in Japanese Patent O.P.I. Publication Nos. 109042/1990, 109043/1990, 39735/1991 and 39739/1991. Powdery processing agents can be produced by ordinary methods such as those described in Japanese Patent O.P.I. Publication No. 133332/1979, British Patent Nos. 725892 and 729862 and German Patent No. 3733861.

From the viewpoint of solubility and the desired effect of the present invention, the apparent density of the solid photographic processing agent described above is preferably 1.0 to 2.5 g/cm$^3$; this range is preferable from the viewpoint of solid strength for the lower limit and solid solubility for the upper limit. When the solid processing agent is of granule or powder form, the apparent density is preferably 0.40 to 0.95 g/cm$^3$.

Although the solid processing agent for the present invention may be used for various photographic processing agents, such as a color developing agent, a black-and-white developing agent, a bleaching agent, a fixing agent, a bleach-fixing agent, and a stabilizing agent, the effect of the invention, particularly the photographic performance stabilizing effect, is enhanced when it is applied to a color developing agent.

Those exemplified from the regulation for dangerous liquid products are black-and-white developing agents, color developing agents, bleaching agents, bleach-fixing agents and stabilizers.

For the embodiment of the present invention, it is best to solidify all processing agents, but it is preferable to solidify at least the color developing agent. This is because the effect of the present invention is most enhanced, since the color developing agent contains many components showing chemical interaction and also harmful components. More preferably, in addition to the color developing agent, the bleach-fixing agent or the bleaching agent and the fixing agent are solidified, which are recognized as involving a risk in transportation, since they are distributed in liquid kits.

Although solidification of part of a processing agent is included in the scope of the present invention, it is preferable to solidify the entire components of the processing agent. Desirably, each component is formed as a remove solid processing agent and packaged in the same style. It is also desirable to package each component in the order of repeated addition.

It is preferable to add all processing agents to be supplied to respective processing tanks according to information on the amount of processing in the form of solid processing agents. Where necessary, replenishing water is supplied on the basis of such information or other replenishing water controlling information. In this case, the liquid added to the processing tank may be replenishing water alone. In other words, when two or more processing tanks require replenishment, by sharing the replenishing water, only one tank is sufficient to store the replenishing liquid, resulting in automatic processing machine size reduction. It is a preferred mode, for automatic processing machine size reduction, that a single replenishing water tank be installed outside the automatic processing machine.

In solidifying a color developing agent, it is preferable to solidify all of the alkali agent, coloring agent and reducing agent, and to confine the number of tablet kinds to not more than 3, preferably 1. When solidifying in two or more agents, it is preferable to package these tablets or granules in the same package.

Tablets and pills can be moisture-resistant packaged with the following materials:

Usable synthetic resin materials are polyethylene (prepared by the high pressure method or the low pressure method), polypropylene (whether elongated or not), polyvinyl chloride, polyvinyl acetate, nylon (elongated or not), polyvinylidene chloride, polystyrene, polycarbonate, vinylon, Eval, polyethylene terephthalate (PET), other polyester resins, hydrochlorinated rubber, acrylonitrile-butadiene copolymer, epoxy-phosphate resin (the polymers described in Japanese Patent O.P.I. Publication Nos. 63037/1988 and 32952/1982). Pulp is also acceptable.

These materials are usually prepared as laminated films combined by adhesion, but may be prepared by coating.

It is preferable to use various gas barrier film such as aluminum foil or aluminum evaporated synthetic resin between the above synthetic resin films. The total oxygen permeability of these laminated films is preferably not higher than 50 ml/m$^2$/24 hr/atm (at 20° C., 65% RH), more preferably not higher than 30 ml/m$^2$/24 hr/atm.

The total film thickness of these laminated films is preferably 1 to 2000 μm, more preferably 10 to 1000 μm, and still more preferably 50 to 1000 μm.

These synthetic resin films may be single-layer (polymer) resin films or multiple-layer laminated (polymer) resin films.

Examples of single-layer polymer resin films meeting the requirements of the present invention include:

(1) polyethylene terephthalate (PET) of not less than 0.1 mm in thickness, (2) acrylonitrile-butadiene copolymers of not less than 0.3 mm in thickness, and (3) hydrochlorinated rubber of not less than 0.1 mm in thickness. Preference is given to polyethylene terephthalate because of excellent alkali resistance and acid resistance.

Examples of laminated polymer resin films meeting the requirements of the present invention include:

(4) PET/polyvinyl alcohol-ethylene copolymer (Eval)/polyethylene (PE), (5) stretched polypropylene (OPP)/Eval/PE, (6) non-stretched polypropylene (CPP)/Eval/PE, (7) nylon (N)/aluminum foil (Al)/PE, (8) PET/Al/PE, (9) cellophane/PE/Al/PE,
(10) Al/paper/PE,
(11) PET/PE/Al/PE,
(12) N/PE/Al/PE,
(13) paper/PE/Al/PE,
(14) PET/Al/PET/polypropylene (PP),
(15) PET/Al/PET/high density polyethylene (HDPE),
(16) PET/Al/PE/low density polyethylene (LDPE),
(17) Eval/PP,
(18) PET/Al/PP,
(19) paper/Al/PE,
(20) PE/PVDC-coated nylon/PE/ethylvinyl acetate-polyethylene condensation product (EVA),
(21) PE/PVDC-coated N/PE,
(22) EVA/PE/aluminum-deposited nylon/-PE/EVA,
(23) aluminum-deposited nylon/N/PE/EVA,
(24) OPP/PVDC-coated N/PE,
(25) PE/PVDC-coated N/PE,
(26) OPP/Eval/LDPE,
(27) OPP/Eval/ CPP,
(28) PET/Eval/LDPE,
(29) ON (stretched nylon)/Eval/LDPE, and
(30) CN (non-stretched nylon)/Eval/LDPE, with preference given to (20) through (30).

Example configurations of these packaging materials include the following (the innermost face is in contact with the processing agent):

PE/base cardboard/PE/Al/epoxy-phosphate resin layer/polyester resin layer/PE,
PE/K-nylon/PE or adhesive/Al/PE/cardboard/PE,
PE/vinylon/PE or adhesive/Al/PE/cardboard/PE,
PE/vinylidene chloride/PE or adhesive/Al/PE/cardboard/PE,
PE/polyester/PE or adhesive/Al/PE/cardboard/PE, and
polypropylene/K-nylon/polypropylene/Al/polypropylene/cardboard/polypropylene.

Methods for moisture-resistant packaging tablets or granules include four-side sealing, three-side sealing, stick packaging (pillow packaging, gusset packaging), PTP packaging and cartridge packaging.

Four-side sealing, three-side sealing and stick (pillow, gusset) packaging are differentiated by packaging form, and the above-mentioned materials are used therefor. It should be noted, however, when these methods are applied to the peel open method, a sealant is laminated to provide peel opening suitability.

The peel open method is usually available in three modes: the cohesive failure method, the interfacial peeling method and the interlayer peeling method.

The cohesive failure method involves the use of a hot melt adhesive and a heat seal lacquer as a sealant, wherein peeling is achieved by internal cohesive failure of the sealant layer upon package opening.

The interfacial peeling method is based on peeling in the interface between two films, wherein the sealing film (sealant) and the adherend are not completely molten together so that they can be detached with moderate strength. The sealant is a film blended with viscous resin, and its material can be selected from polyethylene, polypropylene or a copolymer thereof, polyester, etc., depending on the material of the adherend.

The interlayer peeling method is based on peeling between laminate films using a multiple layered co-extruded film.

In the peel open method using a film of the present invention, interlayer peeling or interfacial peeling is preferred.

Since these sealants are thin, it is a common practice to use them with lamination with other films such as polyethylene, polypropylene, polystyrene, polycarbonate, polyester (polyethylene terephthalate), polyvinyl chloride, nylon, Eval or aluminum, with preference given to polyethylene, polypropylene, polyester and Eval from the viewpoint of moisture resistance, environmental concern and compatibility with the contents. Also, in view of printability, the outermost face is preferably of non-stretched polypropylene, polyester, paper or the like.

Available sealant films include the CMPS film, produced by Tocello, Diflan PP-100 and PS-300, produced by Dainippon Ink & Chemicals, Inc., the LTS film, produced by Toppan Printing Co., Ltd., and Sanseal FR and Sanseal MS, produced by San-Ei Chemical Industries, Ltd. Polyester-laminated types include Diklan C-1600T and C-1602T.

PTP is a kind of blister packaging wherein formed sheets of PVC, CPP or the like, containing a solid processing agent, are heat sealed with aluminum sealing material.

The recent tendency for PVC is toward avoidance of the use as a forming material from the viewpoint of environmental concern; A-PET and highly moisture-resistant PP (e.g., TAS-1130, TAS-2230, TAS-3230, produced by Taisei Kako K. K.) have recently been preferred.

The water-soluble films or binders which are preferably used to bind or coat processing agents are those based on polyvinyl alcohol, methyl cellulose, polyethylene oxide, starch, polyvinylpyrrolidone, hydroxypropyl cellulose, pullulan, dextran, gum arabic, polyvinyl acetate, hydroxyethyl cellulose, carboxyethyl cellulose, carboxymethylhydroxyethyl cellulose sodium salt, poly(alkyl) oxazoline or polyethylene glycol, with preference given to those based on polyvinyl alcohol or pullulan from the viewpoint of the desired effect of coating or binding.

Preferred polyvinyl alcohol, a very good film-forming material, exhibits good strength and flexibility under almost all conditions. Commercially available polyvinyl alcohol compositions for inject-molded films vary widely as to molecular weight and the degree of hydrolysis; the molecular weight is preferably about 10000 to about 100000. Here, the degree of hydrolysis is defined as the ratio of acetate groups replaced by hydroxyl groups in the polyvinyl alcohol. For film application, the degree of hydrolysis is normally in the range from about 70 to 100%. As stated above, the term polyvinyl alcohol usually involves polyvinyl acetate compounds.

These water-soluble films are produced by ordinary methods such as those described in Japanese Patent O.P.I. Publication Nos. 124945/1990, 97348/1986, 158245/1985, 86638/1990, 117867/1982, 75650/1990, 226018/1984, 218741/1988 and 13565/1979.

Water-soluble films which are commercially available under trade names of Solupuron (produced by Aicello Kagaku), Hicellon (produced by Nichigo Film) and pullulan (produced by Hayashibara Co., Ltd.) can be used. Also, the 7-000 series polyvinyl alcohol films available from the MONO-SOL division of Chris Craft Industries Inc., which dissolve in water at temperatures of about 34° to 200° F., which are harmless and which exhibit high chemical resistance, are particularly preferably used.

From the viewpoint of solid processing agent storage stability, water-soluble film dissolution time and crystallization in the automatic processing machine, the film thickness of the water-soluble film is preferably 10 to 120μ, more preferably 15 to 80μ, and still more preferably 20 to 60μ.

The water-soluble film is preferably thermoplastic. This is because thermoplasticity facilitates heat seal work and ultrasonic welding work and enhances the coating effect.

The tensile strength of the water-soluble film is preferably $0.5\times10^6$ to $50\times10^6$ kg/m$^2$, more preferably $1\times10^6$ to $25\times10^6$ kg/m$^2$, and still more preferably $1.5\times10^6$ to $10\times10^6$ kg/m$^2$. Tensile strength is determined by the method described in JIS Z-1521.

The photographic processing agent wrapped, bound or coated with a water-soluble film or a binder is preferably packaged in a moisture-resistant packaging material to prevent damage due to high humidities, atmospheric moisture such as rain and fog, and accidental contact with scattered water or wet hands during storage, transportation and handling. Said moisture-resistant packaging material is preferably 10 to 150μ in thickness. Said moisture-resistant packaging material is at least one selected from the group comprising polyolefin films such as those of polyethylene terephthalate, polyethylene and polypropylene, craft paper enhanced for moisture resistant by polyethylene, wax paper, moisture-resistant cellophane, glassine, polyester, polystyrene, polyvinyl chloride, polyvinylidene chloride, polyamide, polycarbonate, acrylonitrile and foils of metals such as aluminum, and metallized polymer films, and may be a composite thereof.

Also, in embodying the present invention, preference is also given to degradable plastics, specifically biodegradable or photodegradable plastics as moisture-resistant packaging materials.

Said biodegradable plastics include 1) naturally occurring high molecular compounds, 2) microbial polymers, 3) highly biodegradable synthetic polymers and 4) blends of naturally occurring biodegradable high molecular substances in plastics. Photodegradable plastics include 5) those having in the main chain thereof a group whose bond is broken upon UV excitation. In addition to the above-mentioned high molecular substances, those which are both photodegradable and biodegradable can also be preferably used.

Typical examples of such substances are as follows.

Examples of biodegradable plastics include:

1) naturally occurring high molecular substances such as polysaccharides, cellulose, polylacetic acid, chitin, chitosan, polyamino acid and modified configurations thereof;

2) microbial polymers such as Biopol, which is based on PHB-PHV (copolymer of 3-hydroxybutyrate and 3-hydroxyvalerate), and microbial cellulose;

3) highly biodegradable synthetic polymers such as polyvinyl alcohol, polycaprolactone and copolymers and mixtures thereof; and 4) blends of naturally occurring biodegradable high molecular substances in plastics such as those prepared by adding starch or cellulose to plastics to provide shape disintegrability.

Examples of photodegradable plastics of 5) include those having a carbonyl group introduced therein for photodisintegrability, which may be supplemented with UV absorbent for promoted disintegration.

Ordinary biodegradable plastics such as those described in "Kagaku to Kogyo", Vol. 64, No. 10, pp. 478–484 (1990) and "Kino Zairyo", 1990 July issue, pp 23–34 can be used Also usable biodegradable plastics are commercial products such as Biopol, produced by ICI, Eco, produced by Union Carbide, Ecolite, produced by Eco Plastic, Ecostar, produced by St. Lawrence Starch, and Knuckle P, produced by Nippon Unicar.

The moisture-resistant packaging material described above is preferably not more than 10 g.mm/m$^2$ 24 hr, more preferably not more than 5 g.mm/m$^2$ 24 hr in water permeation coefficient.

A p-phenylenediamine compound having a water-solubilizing group is preferably used as a color developing agent in the color developer for the present invention, since it enhances the desired effect of the invention and causes little fogging.

The p-phenylenediamine compounds having a water-solubilizing group are advantageous over the p-phenylenediamine compounds having no water-solubilizing group, such as N,N-diethyl-p-phenylenediamine, that they do not contaminate the light-sensitive material and are not irritative to skin upon skin contact. In addition, their use in combination with the color developer for the present invention allows more efficient accomplishment of the desired object of the invention.

The p-phenylenediamine compound for the present invention has at least one water-solubilizing group as described above on the amino group or benzene nucleus thereof. Preferred water-solubilizing groups include: $-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ (m and n independently represent an integer of not less than 0), a —COOH group and a $-SO_3H$ group.

Examples of color developing agents preferably used for the present invention are C-1 through C-16 described on pages 7 through 9 of Japanese Patent Application No. 86741/1992.

The color developing agent described above is used normally in the form of a salt such as hydrochloride, sulfate or p-toluenesulfonate.

The above-mentioned color developing agents may be used singly or in combination, and may be used in combination with black-and-white developing agents such as phenidone, 4-hydroxymethyl-4-methyl-1-phenyl-3-pyrazolidone and Metol as desired.

It is a preferred mode of embodiment of the present invention to add a compound represented by the following formula A or B to the color developer relating to the present invention, whereby the desired effect of the invention is enhanced.

Specifically, it is effective in that not only the storage stability of tablets and other forms of solid processing agent improve in comparison with other compounds, but also sufficient strength is maintained. Another advantage is that photographic performance becomes stable and fogging in the unexposed portion is suppressed.

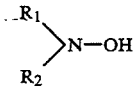

Formula A wherein $R_1$ and $R_2$ independently represent an alkyl group, an aryl group,

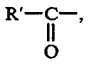

or a hydrogen atom, provided that they do not represent a hydrogen atom concurrently. The alkyl groups represented by $R_1$ and $R_2$ may be identical or not, each of which preferably has 1 to 3 carbon atoms. These alkyl groups may have a carboxylate group, a phosphate group, a sulfonate group or a hydroxyl group.

R′ represents an alkoxy group, an alkyl group or an aryl group. The alkyl groups and aryl groups for $R_1$, $R_2$ and R′ include those having a substituent. $R_1$ and $R_2$ may bind together to form a ring, such as a heterocyclic ring like piperidine, pyridine, triazine or morpholine.

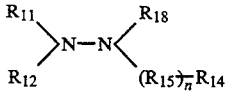

Formula B wherein $R_{11}$, $R_{12}$ and $R_{13}$ independently represent a hydrogen atom, a substituted or unsubstituted alkyl group, aryl group or heterocyclic group; $R_{14}$ represents a hydroxyl group, a hydroxyamino group, a substituted or unsubstituted alkyl group, aryl group, heterocyclic group, alkoxy group, aryloxy group, carbamoyl group or amino group. The heterocyclic group is a 5- or 6-membered ring comprising C, H, O, N, S and halogen atoms, whether saturated or unsaturated. $R_{15}$ represents a divalent group selected from the group comprising —CO—, —$SO_2$— and

| | M | $X_2$ | $Y_1$ | $X_3$ | $Y_2$ |
|---|---|---|---|---|---|
| E-1 | Na | 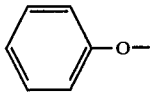 | $-NHC_2H_4OH$ | $-NHC_2H_4OH$ | 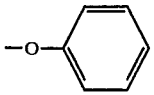 |
| E-2 | Na | $HOC_2H_4NH-$ | $-NHC_2H_4OH$ | $-NHC_2H_4OH$ | $-NHC_2H_4OH$ |
| E-3 | Na | 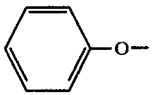 | $-N(C_2H_4OH)_2$ | $-N(C_2H_4OH)_2$ | 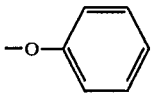 |
| E-4 | Na | $(HOC_2H_4)_2N-$ | $-OCH_3$ | $-OCH_3$ | $-NHC_2H_4SO_3Na$ |
| E-5 | Na | $HOCH_2CH_2NH-$ | $-N(C_2H_4OH)_2$ | $-N(C_2H_4OH)_2$ | $-NHCH_2CHOH$<br>\|<br>$CH_2OH$ |
| E-6 | Na | $(HOC_2H_4)_2N-$ | $-N(C_2H_4OH)_2$ | $-N(C_2H_4OH)_2$ | $-N(C_2H_4OH)_2$ |
| E-7 | Na | 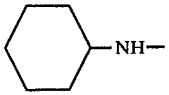 | $-NHC_2H_4OH$ | $-NHC_2H_4OH$ | 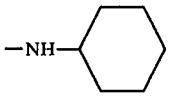 |
| E-8 | Na | 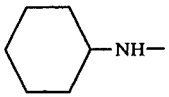 | $-N(C_2H_4OH)_2$ | $-N(C_2H_4OH)_2$ | 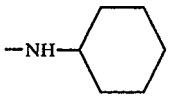 |
| E-9 | Na | $HO-$ | 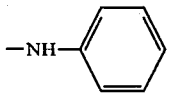 | 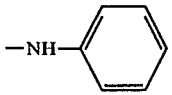 | $-OH$ |
| E-10 | Na | $H_2N-$ | 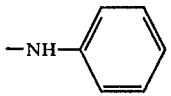 | 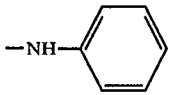 | $-NH_2$ |
| E-11 | Na | $CH_3O-$ | 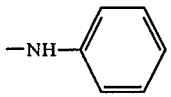 | 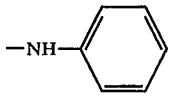 | $-OCH_3$ |

-continued
| | M | $X_2$ | $Y_1$ | $X_3$ | $Y_2$ |
|---|---|---|---|---|---|
| E-12 | Na | $HOC_2H_4NH-$ | 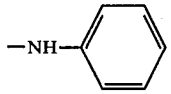 | 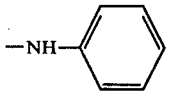 | $-NHC_2H_4OH$ |
| E-13 | Na | $(HOC_2H_4)_2N-$ | 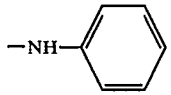 | 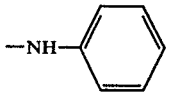 | $-N(C_2H_4OH)_2$ |
| E-14 | Na | $HOC_2H_4NH-$ | 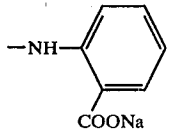 | 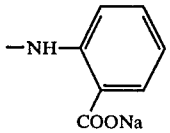 | $-NHC_2H_4OH$ |
| E-15 | Na | 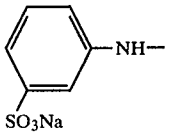 | $-N(C_2H_4OH)_2$ | $-N(C_2H_4OH)_2$ | 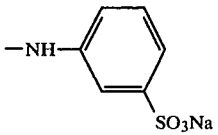 |
| E-16 | Na | 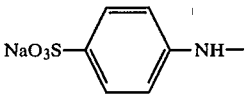 | $-N(C_2H_4OH)_2$ | $-N(C_2H_4OH)_2$ | 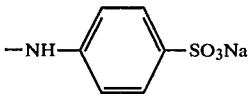 |
| E-17 | Na | 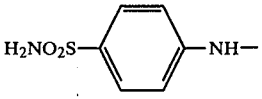 | $-N(C_2H_4OH)_2$ | $-N(C_2H_4OH)_2$ | 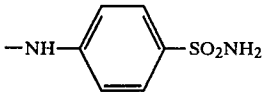 |
| E-18 | Na | 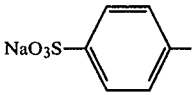 | $-N(C_2H_4OH)_2$ | $-N(C_2H_4OH)_2$ | 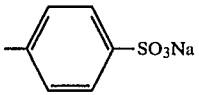 |
| E-19 | Na | $HOCH_2CH(CH_3)CH_2HN-$ | $-OCH_3$ | $-OCH_3$ | $-NHCH_2CH(CH_3)CH_2OH$ |

-continued
| | M | $X_2$ | $Y_1$ | $X_3$ | $Y_2$ |
|---|---|---|---|---|---|
| E-20 | Na | $(HOC_2H_4)_2N-$ | 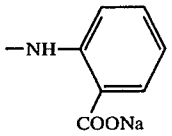 | 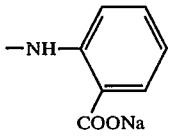 | $-N(C_2H_4OH)_2$ |
| E-21 | Na | $HOC_2H_4NH-$ | 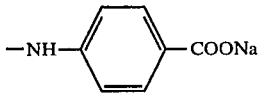 | 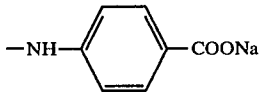 | $-NHC_2H_4OH$ |
| E-22 | Na | 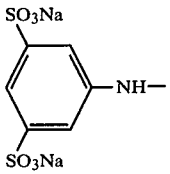 | $-NHC_2H_5$ | $-NHC_2H_5$ | 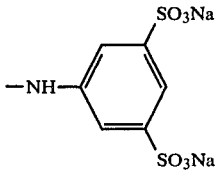 |
| E-23 | Na | 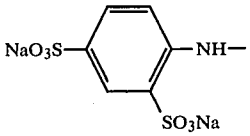 | $-NHCH_3$ | $-NHCH_3$ | 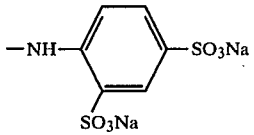 |
| E-24 | Na | 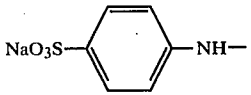 | 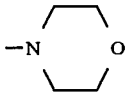 | 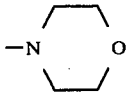 | 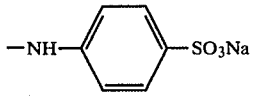 |
| E-25 | Na | $HOC_2H_4NH-$ | 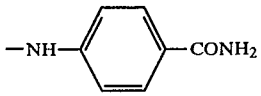 | 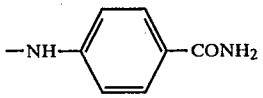 | $-NHC_2H_4OH$ |
| E-26 | Na | $HOC_2H_4NH-$ | 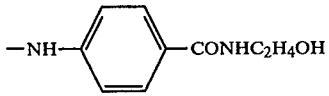 | 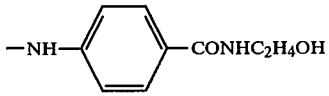 | $-NHC_2H_4OH$ |

-continued
| | M | $X_2$ | $Y_1$ | $X_3$ | $Y_2$ |
|---|---|---|---|---|---|
| E-27 | Na | $(HOC_2H_4)_2N-$ | 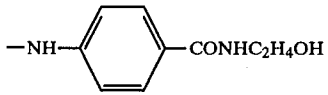 | 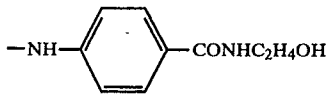 | $-N(C_2H_4OH)_2$ |
| E-28 | Na | $HOC_2H_4NH-$ | 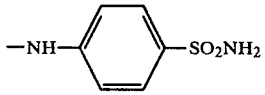 | 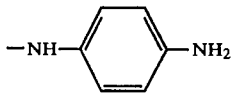 | $-NHC_2H_4OH$ |
| E-29 | Na | $HOC_2H_4NH-$ | 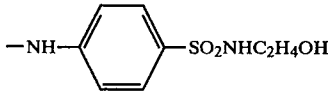 | 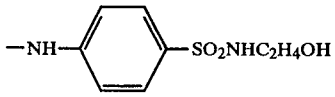 | $-NHC_2H_4OH$ |
| E-30 | Na | $(HOC_2H_4)_2N-$ | 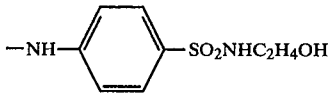 | 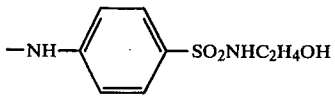 | $-N(C_2H_4OH)_2$ |
| E-31 | Na | 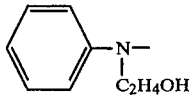 | 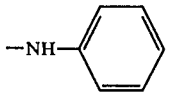 | 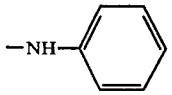 | 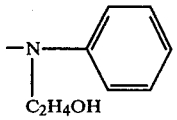 |
| E-32 | Na | 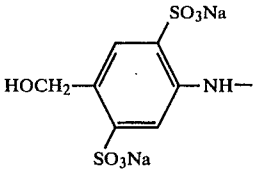 | 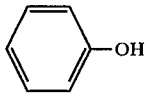 | 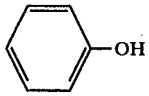 | 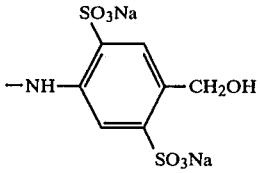 |
| E-33 | Na | 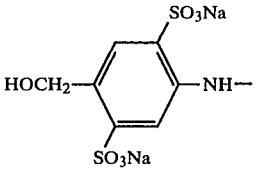 | $-NHC_2H_5$ | $-NHC_2H_5$ | 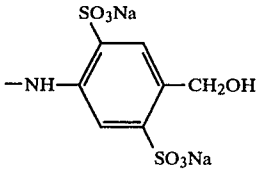 |
| E-34 | Na | $CH_3O-$ | $-NHCH_2CH(OH)CH_3$ | $-NHCH_2CH(OH)CH_3$ | $-OCH_3$ |

-continued
| | M | $X_2$ | $Y_1$ | $X_3$ | $Y_2$ |
|---|---|---|---|---|---|
| E-35 | Na | 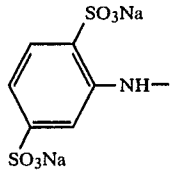 | 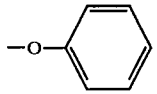 | 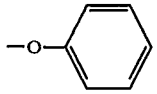 | 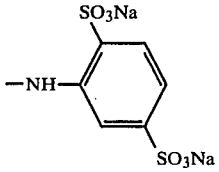 |
| E-36 | Na | 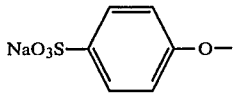 | $-N(C_2H_4OH)_2$ | $-N(C_2H_4OH)_2$ | 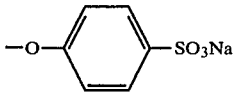 |
| E-37 | Na | 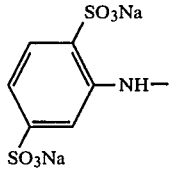 | $-N(C_2H_5)_2$ | $-N(C_2H_5)_2$ | 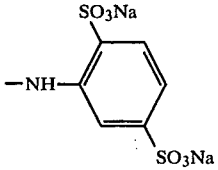 |
| E-38 | Na | 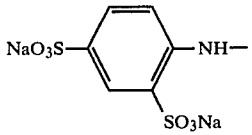 | $-NHCH_3$ | $-NHCH_3$ | 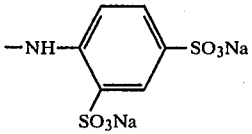 |
| E-39 | Na | $CH_3O-$ | $-NHCH(CH_2OH)CH_3$ | $-NHCH(CH_2OH)CH_3$ | $-OCH_3$ |
| E-40 | Na | $CH_3O-$ | $-N(C_2H_4OH)_2$ | $-N(C_2H_4OH)_2$ | $-OCH_3$ |
| E-41 | Na | $CH_3O-$ | $-NHC_2H_4SO_3Na$ | $-NHC_2H_4SO_3Na$ | $-OCH_3$ |
| E-42 | Na | $CH_3O-$ | $-NHC_2H_4OH$ | $-NHC_2H_4OH$ | $-OCH_3$ |
| E-43 | Na | $CH_3O-$ | 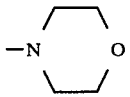 | 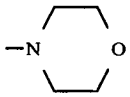 | $-OCH_3$ |
| E-44 | Na | $CH_3O-$ | $-NHC_2H_4SO_3K$ | $-NHC_2H_4SO_3K$ | |
| E-45 | Na | 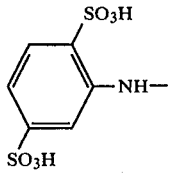 | $-N(C_2H_5)_2$ | $-N(C_2H_5)_2$ | 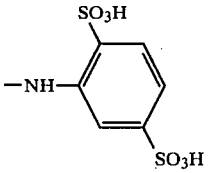 |

n represents 0 or 1. Provided that n is 0, $R_{14}$ represents a group selected from an alkyl group, an aryl group and a heterocyclic group; $R_{13}$ and $R_{14}$ may cooperate to form a heterocyclic group.

Examples of the hydroxylamine compound represented by formula A are given in U.S. Pat. Nos. 3,287,125, 33293034 and 3,287,124 and other publications. Particularly preferable compounds are compound Nos. A-1 through A-39 described on pages 36 through 38 of Japanese Patent Application No. 86741/1992, compound Nos. 1 through 53 described on pages 3 through 6 of Japanese Patent O.P.I. Publication No. 33845/1991 and compound Nos. 1 through 52 described on pages 5 through 7 of Japanese Patent O.P.I. Publication No. 63646/1991.

Examples of the compound represented by formula B are compound Nos. B-1 through B-33 described on pages 11 through 12 of Japanese Patent Application No. 86741/1992 and compound Nos. 1 through 56 described on pages 4 through 6 of Japanese Patent O.P.I. Publication No. 33846/1991.

These compounds represented by formula A or B are used normally in the forms of free amine, hydrochloride, sulfate, p-toluenesulfonate, oxalate, phosphate, acetate and others.

The color developer and black-and-white developer used for the present invention may incorporate a trace amount of sulfite as a preservative. Examples of such sulfites include sodium sulfite, potassium sulfite, sodium bisulfite and potassium bisulfite.

The color developer and black-and-white developer used for the present invention must contain a buffer. Examples of buffers include sodium carbonate, potassium carbonate, sodium bicarbonate, potassium bicarbonate, trisodium phosphate, tripotassium phosphate, dipotassium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

Examples of developing accelerators which can be added as necessary include the thioether compounds disclosed in Japanese Patent Examined Publication Nos. 16088/1962, 5987/1962, 7826/1963, 12380/1969 and 9019/1970 and U.S. Pat. No. 3,813,247, the p-phenylenediamine compounds disclosed in Japanese Patent O.P.I. Publication Nos. 49829/1977 and 15554/1975, the quaternary ammonium salts disclosed in Japanese Patent O.P.I. Publication Nos. 137726/1975, 156826/1981 and 43429/1977 and Japanese Patent Examined Publication No. 30074/1969, the p-aminophenols disclosed in U.S. Pat. Nos. 2,610,122 and 4,119,462, the amine compounds disclosed in U.S. Pat. Nos. 2,494,903, 3,128,182, 4,230,796, 3,253,919, 2,482,546, 2,596,926 and 3,582,346 and Japanese Patent Examined Publication No. 11431/1966, the polyalkylene oxides disclosed in Japanese Patent Examined Publication Nos. 16088/1962, 25201/1967, 11431/1966 and 23883/1967 and U.S. Pat. Nos. 3,128,183 and 3,532,501, and 1-phenyl-3-pyrazolidones, hydrozines, meso-ionic compounds, ionic compounds and imidazoles.

Preferably, the color developer contains substantially no benzyl alcohol, specifically not more than 2.0 ml per liter of color developer, more preferably absolutely no benzyl alcohol. When the color developer contains substantially no benzyl alcohol, better results are obtained with less fluctuation in photographic properties in continuous processing, particularly less increase in the degree of staining.

For the prevention of fogging and other purposes, chlorine and bromine ions must be present in the color developer. In the present invention, it is preferable, from the viewpoint of developing speed, staining and minimum density fluctuation, that chlorine ions be contained at $1.0\times10^{-2}$ to $1.5\times10^{-1}$ mol/l, more preferably $4\times10^{-2}$ to $1\times10^{-1}$mol/l. It is therefore preferable to prepare the solid processing agent to make the color developer in the processing tank have a concentration in the above range.

In the present invention, it is preferable, from the viewpoint of developing speed, maximum density, sensitivity and minimum density, that the color developer in the processing tank contain bromine ions at a concentration of $3.0\times10^{-3}$ to $1.0\times10^{-3}$ mol/l, more preferably $5.0\times10^{-3}$ to $5\times10^{-4}$ mol/l, and still more preferably $1\times10^{-4}$ to $3\times10^{-4}$ mol/l. In this case as well, it is preferable to prepare the solid processing agent to make the color developer in the processing tank have a bromine concentration in the above range.

Provided that chlorine ions are added directly to the color developer, examples of chlorine ion sources include sodium chloride, potassium chloride, ammonium chloride, nickel chloride, magnesium chloride, manganese chloride, calcium chloride and cadmium chloride, with preference given to sodium chloride and potassium chloride.

Chlorine ions may also be supplied in the form of a counterpart salt of the color developer or the brightening agent added thereto. Examples of bromine ion sources include sodium bromide, potassium bromide, ammonium bromide, lithium bromide, calcium bromide, magnesium bromide, manganese bromide, nickel bromide, cadmium bromide, cerium bromide and thallium bromide, with preference given to potassium bromide and sodium bromide.

In addition to chlorine ions and bromine ions, the color developer and black-and-white developer used for the present invention may incorporate antifogging agents which are optionally selected as necessary. Antifogging agents which can be used include alkali metal halides such as potassium iodide and organic antifogging agents. Typical examples of organic antifogging agents include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

From the viewpoint of the desired effect of the present invention, it is preferable to add a triazinylstilbene brightening agent to the color developer and black-and-white developer used for the present invention. Said brightening agent is preferably represented by the following formula E:

Formula E

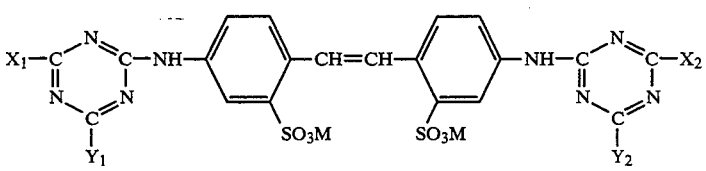

wherein $X_2$, $X_3$, $Y_1$ and $Y_2$ independently represent a hydroxyl group, a chlorine atom, a bromine atom or another halogen atom, an alkyl group, an aryl group,

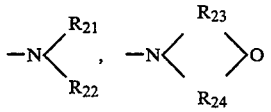

or $—OR_{25}$, wherein $R_{21}$ and $R_{22}$ independently represent a hydrogen atom, an alkyl group (may be substituted) or an aryl group (may be substituted); $R_{23}$ and $R_{24}$ each represent an alkylene group (may be substituted); $R_{25}$ represents a hydrogen atom, an alkyl group (may be substituted) or an aryl group (may be substituted); M represents a cation.

Details of the groups in formula E and substituents therefor are the same as those described on page 16 and page 17 of Japanese Patent O.P.I. Publication No. 118649/1992.

Examples of the compound represented by formula E are given below.

| | M | $X_2$ | $Y_1$ | $X_3$ | $Y_2$ |
|---|---|---|---|---|---|
| E-1 | Na | 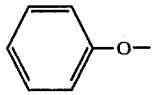 | $-NHC_2H_4OH$ | $-NHC_2H_4OH$ | 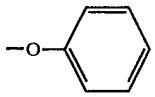 |
| E-2 | Na | $HOC_2H_4NH-$ | $-NHC_2H_4OH$ | $-NHC_2H_4OH$ | $-NHC_2H_4OH$ |
| E-3 | Na | 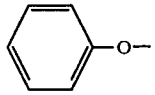 | $-N(C_2H_4OH)_2$ | $-N(C_2H_4OH)_2$ | 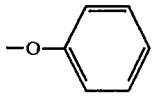 |
| E-4 | Na | $(HOC_2H_4)_2N-$ | $-OCH_3$ | $-OCH_3$ | $-NHC_2H_4SO_3Na$ |
| E-5 | Na | $HOCH_2CH_2NH-$ | $-N(C_2H_4OH)_2$ | $-N(C_2H_4OH)_2$ | $-NHCH_2CHOH$<br>\|<br>$CH_2OH$ |
| E-6 | Na | $(HOC_2H_4)_2N-$ | $-N(C_2H_4OH)_2$ | $-N(C_2H_4OH)_2$ | $-N(C_2H_4OH)_2$ |
| E-7 | Na | 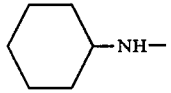 | $-NHC_2H_4OH$ | $-NHC_2H_4OH$ | 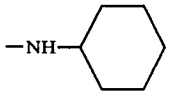 |
| E-8 | Na | 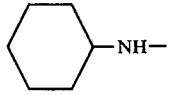 | $-N(C_2H_4OH)_2$ | $-N(C_2H_4OH)_2$ | 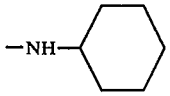 |
| E-9 | Na | $HO-$ | 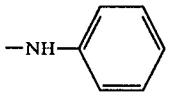 | 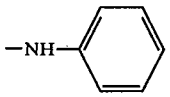 | $-OH$ |
| E-10 | Na | $H_2N-$ | 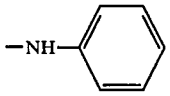 | 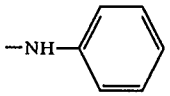 | $-NH_2$ |
| E-11 | Na | $CH_3O-$ | 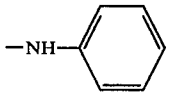 | 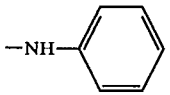 | $-OCH_3$ |

-continued
| | M | $X_2$ | $Y_1$ | $X_3$ | $Y_2$ |
|---|---|---|---|---|---|
| E-12 | Na | $HOC_2H_4NH-$ | 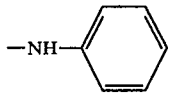 | 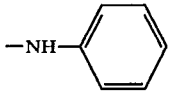 | $-NHC_2H_4OH$ |
| E-13 | Na | $(HOC_2H_4)_2N-$ | 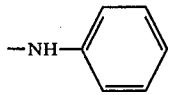 | 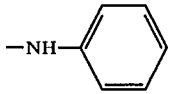 | $-N(C_2H_4OH)_2$ |
| E-14 | Na | $HOC_2H_4NH-$ | 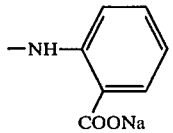 | 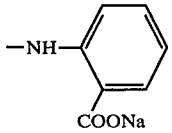 | $-NHC_2H_4OH$ |
| E-15 | Na | 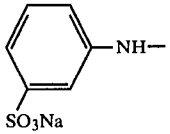 | $-N(C_2H_4OH)_2$ | $-N(C_2H_4OH)_2$ | 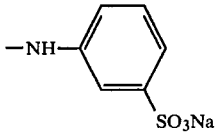 |
| E-16 | Na | 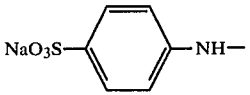 | $-N(C_2H_4OH)_2$ | $-N(C_2H_4OH)_2$ | 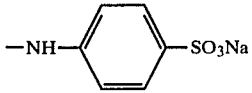 |
| E-17 | Na | 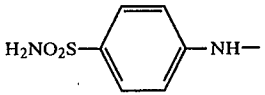 | $-N(C_2H_4OH)_2$ | $-N(C_2H_4OH)_2$ | 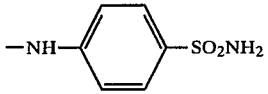 |
| E-18 | Na | 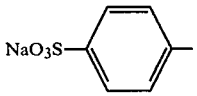 | $-N(C_2H_4OH)_2$ | $-N(C_2H_4OH)_2$ | 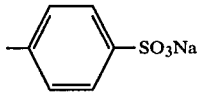 |
| E-19 | Na | $HOCH_2CH(CH_3)CH_2HN-$ | $-OCH_3$ | $-OCH_3$ | $-NHCH_2CH(CH_3)CH_2OH$ |

-continued
| | M | $X_2$ | $Y_1$ | $X_3$ | $Y_2$ |
|---|---|---|---|---|---|
| E-20 | Na | $(HOC_2H_4)_2N-$ | 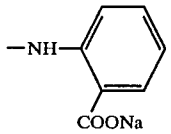 | 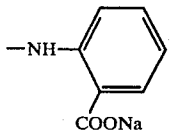 | $-N(C_2H_4OH)_2$ |
| E-21 | Na | $HOC_2H_4NH-$ | 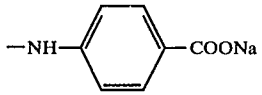 | 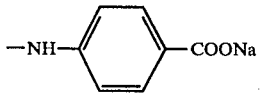 | $-NHC_2H_4OH$ |
| E-22 | Na | 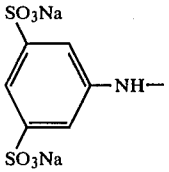 | $-NHC_2H_5$ | $-NHC_2H_5$ | 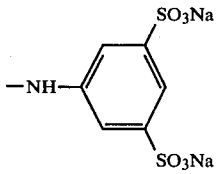 |
| E-23 | Na | 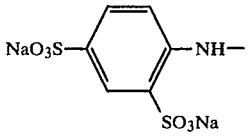 | $-NHCH_3$ | $-NHCH_3$ | 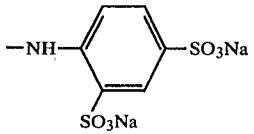 |
| E-24 | Na | 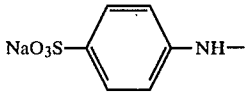 | 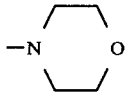 | 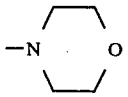 | 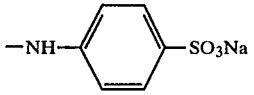 |
| E-25 | Na | $HOC_2H_4NH-$ | 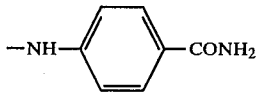 | 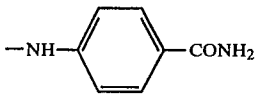 | $-NHC_2H_4OH$ |
| E-26 | Na | $HOC_2H_4NH-$ | 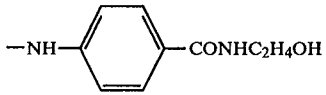 | 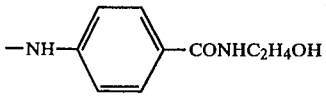 | $-NHC_2H_4OH$ |

-continued
| | M | $X_2$ | $Y_1$ | $X_3$ | $Y_2$ |
|---|---|---|---|---|---|
| E-27 | Na | $(HOC_2H_4)_2N-$ | 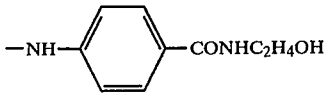 | 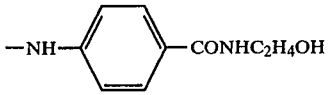 | $-N(C_2H_4OH)_2$ |
| E-28 | Na | $HOC_2H_4NH-$ | 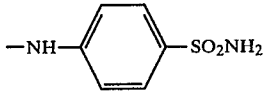 | 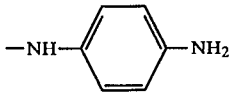 | $-NHC_2H_4OH$ |
| E-29 | Na | $HOC_2H_4NH-$ | 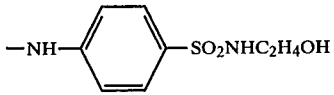 | 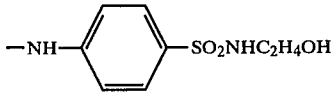 | $-NHC_2H_4OH$ |
| E-30 | Na | $(HOC_2H_4)_2N-$ | 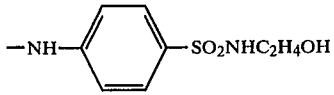 | 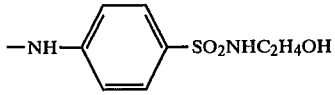 | $-N(C_2H_4OH)_2$ |
| E-31 | Na | 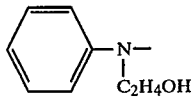 | 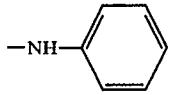 | 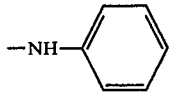 | 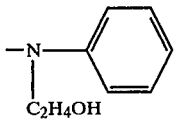 |
| E-32 | Na | 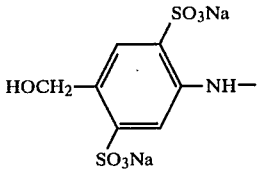 | 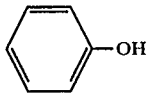 | 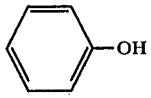 | 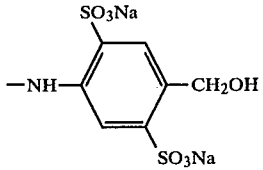 |
| E-33 | Na | 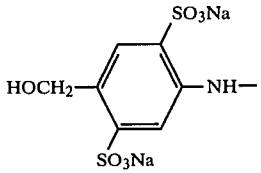 | $-NHC_2H_5$ | $-NHC_2H_5$ | 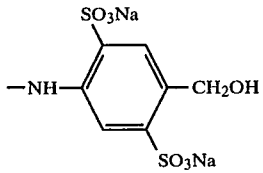 |
| E-34 | Na | $CH_3O-$ | $-NHCH_2CH(OH)CH_3$ | $-NHCH_2CH(OH)CH_3$ | $-OCH_3$ |

-continued
| | M | $X_2$ | $Y_1$ | $X_3$ | $Y_2$ |
|---|---|---|---|---|---|
| E-35 | Na | 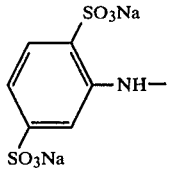 | 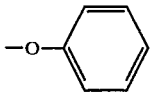 | 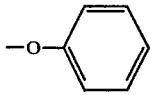 | 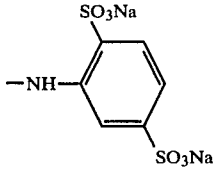 |
| E-36 | Na | 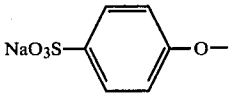 | $-N(C_2H_4OH)_2$ | $-N(C_2H_4OH)_2$ | 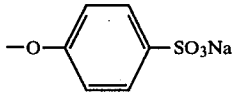 |
| E-37 | Na | 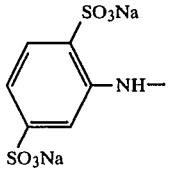 | $-N(C_2H_5)_2$ | $-N(C_2H_5)_2$ | 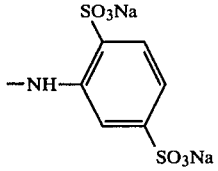 |
| E-38 | Na | 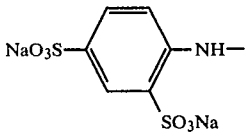 | $-NHCH_3$ | $-NHCH_3$ | 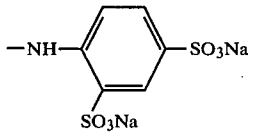 |
| E-39 | Na | $CH_3O-$ | $-NHCH(CH_2OH)CH_3$ | $-NHCH(CH_2OH)CH_3$ | $-OCH_3$ |
| E-40 | Na | $CH_3O-$ | $-N(C_2H_4OH)_2$ | $-N(C_2H_4OH)_2$ | $-OCH_3$ |
| E-41 | Na | $CH_3O-$ | $-NHC_2H_4SO_3Na$ | $-NHC_2H_4SO_3Na$ | $-OCH_3$ |
| E-42 | Na | $CH_3O-$ | $-NHC_2H_4OH$ | $-NHC_2H_4OH$ | $-OCH_3$ |
| E-43 | Na | $CH_3O-$ | 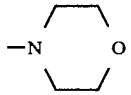 | 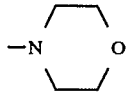 | $-OCH_3$ |
| E-44 | Na | $CH_3O-$ | $-NHC_2H_4SO_3K$ | $-NHC_2H_4SO_3K$ | |
| E-45 | Na | 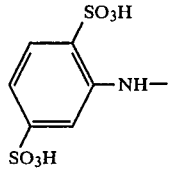 | $-N(C_2H_5)_2$ | $-N(C_2H_5)_2$ | 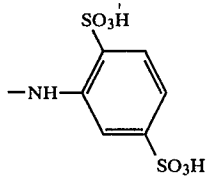 |

These compounds can be synthesized by known methods. Of the example compounds given above, E-4, E-24, E-34, E-35, E-36, E-37 and E-41 are preferably used. It is preferable to prepare the solid processing agent so that the amount of these compounds added falls in the range from 0.2 to 10 g, preferably from 0.4 to 5 g per liter of color developer.

The color developer and black-and-white developer used for the present invention may also incorporate organic solvents such as methyl cellosolve, methanol, acetone, dimethylformamide, β-cyclodextrin and the compounds described in Japanese Patent Examined Publication Nos. 33378/1972 and 9509/1969 for increasing the solubility of the developing agent as necessary.

Auxiliary developing agents may be used in combination with the principal developing agent. Examples of such auxiliary developing agents include Metol, phenidone, N,N-diethyl-p-aminophenol hydrochloride and N,N,N',N'-tetramethyl-p-phenylenediamine hydrochloride.

It is also possible to use various additives such as antistaining agents, anti-sludge agents and lamination effect enhancers.

It is preferable, from the viewpoint of efficient accomplishment of the desired effect of the present invention, that the color developer and the black-and-white developer incorporate one of the chelating agent represented by the following formula K and example compound Nos. K-1 through K- 22, described on page 16 and page 17 of Japanese Patent Publication No. 118649/1992.

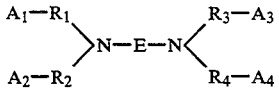

Formula K

Of these chelating agents, K-2, K-9, K-12, K-13, K-17 and K-19 are preferably used, with more preference given to K-2 and K-9, since their addition to the color developer enhances the effect of the invention.

It is preferable to add these chelating agents to the solid processing agent so that their amount falls in the range from 0.1 to 20 g, preferably from 0.2 to 8 g per liter of color developer or black-and-white developer.

The color developer and black-and-white developer may also contain anionic, cationic, amphoteric and nonionic surfactants.

Various surfactants such as alkylsulfonic acids, arylsulfonic acids, aliphatic carboxylic acids and aromatic carboxylic acids may be added as necessary.

The bleaching agents which are preferably used in the bleacher or bleach-fixer relating to the present invention are ferric complex salts of the organic acid represented by the following formula C:

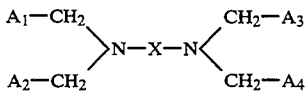

Formula C wherein $A_1$ through $A_4$, whether identical or not, independently represent —$CH_2OH$, —COOM or —$PO_3M_1M_2$; M, $M_1$ and $M_2$independently represent a hydrogen atom, an atom of alkali metal or ammonium. X represents a substituted or unsubstituted alkylene group having 3 to 6 carbon atoms.

The compound represented by formula C is described in detail below.

$A_1$ through $A_4$ in formula IV are not described in detail here, since they are identical with $A_1$ through $A_4$ described on page 4 and page 5 of Japanese Patent Publication No. 191952/1990.

A ferric complex salt of the organic acid represented by formula C is preferably used for the present invention, since a small amount is sufficient to solidify itself because of the high bleaching capability so that weight and size reduction is possible, and since it offers an additional effect of improving the storage stability of solid processing agent.

Examples of preferred compounds represented by the above formula C are given below.

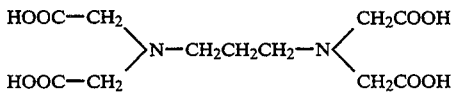

(C-1)

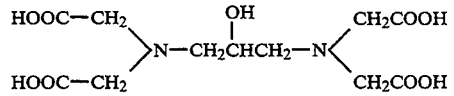

(C-2)

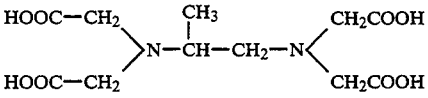

(C-3)

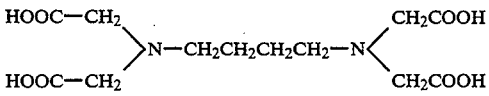

(C-4)

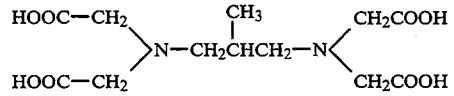

(C-5)

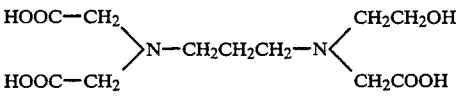

(C-6)

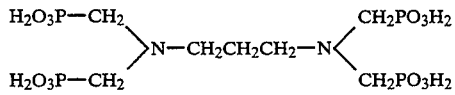

(C-7)

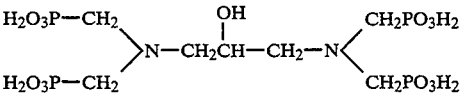

(C-8)

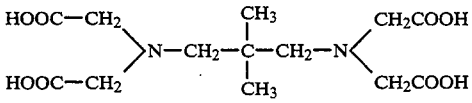

(C-9)

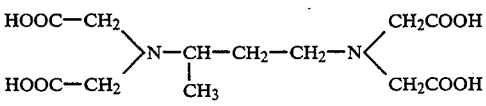

(C-10)

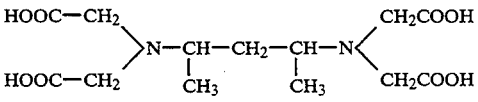

(C-11)

-continued

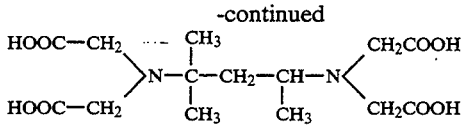

(C-12)

The ferric complex salts of these compounds C-1 through C-12 may be sodium salts, potassium salts or ammonium salts thereof, which can be selected optionally. From the viewpoint of the desired effect of the present invention and solubility, ammonium salts of these ferric complex salts are preferably used.

Of the compounds exemplified above, C-1, C-3, C-4, C-5 and C-9 are preferred, with more preference given to C-1.

In the present invention, ferric complex salts of the following compounds and others can be used as bleaching agents for the bleacher or bleach-fixer in addition to the iron complex salts of the compound represented by the above formula C.

A'-1: Ethylenediaminetetraacetic acid
A'-2: trans-1,2-cyclohexanediaminetetraacetic acid
A'-3: Dihydroxyethylglycinic acid
A'-4: Ethylenediaminetetrakismethylenephosphonic acid
A'-5: Nitrilotrismethylenephosphonic acid
A'-6: Diethylenetriaminepentakismethylenephosphonic acid
A'-7: Diethylenetriaminepentaacetic acid
A'-8: Ethylenediaminediorthohydroxyphenylacetic acid
A'-9: Hydroxyethylethylenediaminetriacetic acid
A'-10: Ethylenediaminedipropionic acid
A'-11: Ethylenediaminediacetic acid
A'-12: Hydroxyethyliminodiacetic acid
A'-13: Nitrilotriacetic acid
A'-14: Nitrilotripropionic acid
A'-15: Triethylenetetraminehexaacetic acid
A'-16: Ethylenediaminetetrapropionic acid
A'-17: β-alaninediacetic acid The amount of the above-mentioned ferric complex salt of organic acid added preferably falls in the range from 0.01 to 2.0 mol, more preferably from 0.05 to 1.5 mol per liter of bleacher or bleach-fixer. It is therefore preferable to prepare the solid processing agent so that the organic acid ferric complex salt concentration of the bleacher or bleach-fixer in the processing tank falls in the above range.

The bleacher may incorporate at least one of the imidazole described in Japanese Patent O.P.I. Publication No. 295258/1989, derivatives thereof and the compounds represented by formulas I through IX given in the same publication, whereby rapid processing is facilitated.

In addition to the above-mentioned developing accelerators, the example compounds given on pages 51 through 115 of Japanese Patent O.P.I. Publication No. 123459/1987, the example compounds given on pages 22 through 25 of Japanese Patent O.P.I. Publication No. 17445/1988 and the compounds described in Japanese Patent O.P.I. Publication Nos. 95630/1978 and 28426/1978 can also be used.

In addition to the above-mentioned additives, the bleacher or bleach-fixer may incorporate halides such as ammonium bromide, potassium bromide and sodium bromide, various brightening agents, defoaming agents and surfactants.

The fixing agents which are preferably used in the fixer or bleach-fixer for the present invention are thiocyanates and thiosulfates. The amount of thiocyanate added is preferably not less than 0.1 mol/l, more preferably not less than 0.5 mol/l, and still more preferably not less than 1.0 mol/l for processing a color negative film. The amount of thiosulfate added is preferably not less than 0.2 mol/l, more preferably not less than 0.5 mol/l for processing a color negative film. Also, the object of the present invention can be more efficiently accomplished by using a thiocyanate and a thiosulfate in combination.

In addition to these fixing agents, the fixer or bleach-fixer for the present invention may contain two or more pH regulators comprising various salts. It is also desirable to add a large amount of a re-halogenating agent such as an alkali halide or an ammonium halide, e.g., potassium bromide, sodium bromide, sodium chloride or ammonium bromide. Compounds which are known to be added to fixer or bleach-fixer, such as alkylamines and polyethylene oxides, may be added as appropriate.

It is preferable to add a compound represented by the following formula FA, described on page 56 of Japanese Patent O.P.I. Publication No. 295258/1989, to the fixer or bleach-fixer, whereby not only the effect of the invention is enhanced but also an additional effect is obtained in that sludge formation in the processing solution capable of fixing is significantly suppressed during prolonged processing of a small amount of light-sensitive material.

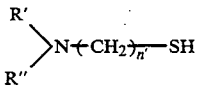

Formula FA

Compounds represented by formula FA can be synthesized ordinary methods such as those described in U.S. Pat. Nos. 3,335,161 and 3,260,718. These compounds represented formula FA may be used singly or in combination.

Good results are obtained when these compounds represented by formula FA are used in amounts of 0.1 to 200 g per liter of processing solution.

In the present invention, it is preferable to add a chelating agent having a ferric ion chelate stability constant of over 8 to the stabilizer. Here, the chelate stability constant is the constant which is well known in L. G. Sillen and A. E. Martell, "Stability Constants of Metal Ion Complexes", The Chemical Society, London (1964), S. Chaberek and A. E. Martell, "Organic Sequestering Agents", Wiley (1959), and other publications.

Examples of chelating agents having a ferric ion chelate stability constant of over 8 include those described in Japanese Patent Application Nos. 234776/1990 and 324507/1989.

The amount of the above chelating agent used is preferably 0.01 to 50 g, more preferably 0.05 to 20 g per liter of stabilizer, in which content range good results are obtained.

Ammonium compounds are preferably added to the stabilizer, which are supplied as ammonium salts of various inorganic compounds. The amount of ammonium compound added preferably falls in the range from 0.001 to 1.0 mol, more preferably from 0.002 to 2.0 mol per liter of stabilizer.

The stabilizer preferably contains a sulfite.

The stabilizer preferably contains a metal salt in combination with the chelating agent described above. Examples of such metal salts include salts of Ba, Ca, Ce, Co, In, La, Mn, Ni, Bi, Pb, Sn, Zn, Ti, Zr, Mg, Al and Sr, and it can be supplied as an inorganic salt such as halide, hydroxide, sulfate, carbonate, phosphate or acetate, or a water-soluble chelating agent. The amount of metal salt added preferably falls in the range from $1\times10^{-4}$ to $1\times10^{-1}$ mol, more preferably from $4\times10^{-4}$ to $2\times10^{-2}$ mol per liter of stabilizer.

EXAMPLES

Example 1

Figure 3:
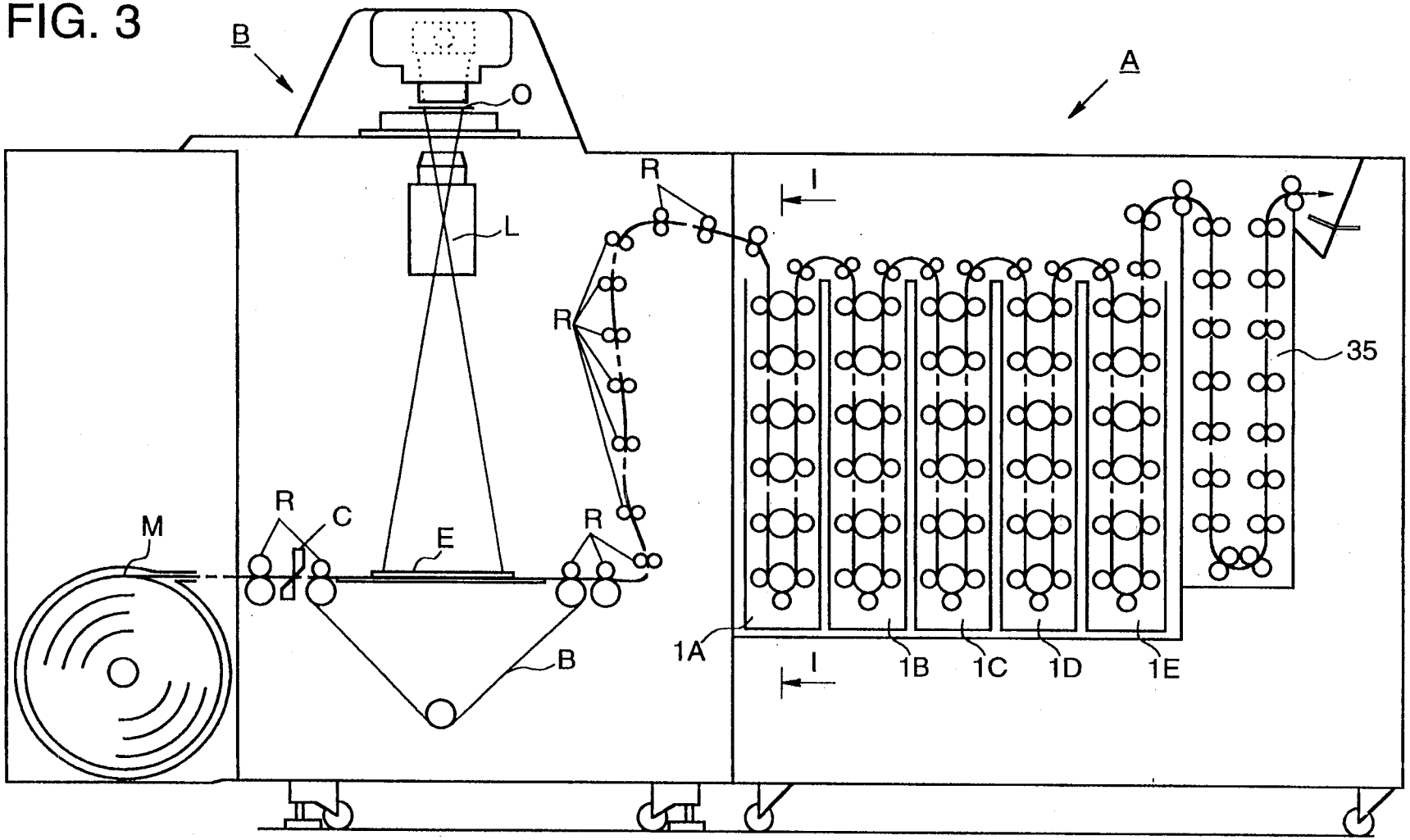
FIG. 3 is a schematic diagram of a printer processor wherein an automatic processing machine and a photographic printer are unified.

An example of automatic processing machine to which the present invention is applicable is described by means of drawings. FIG. 3 is a schematic diagram of a printer processor wherein automatic processing machine A and photographic printer B are unified.

In FIG. 3, in the lower left of photographic printer B is set a magazine M housing a roll of printing paper which is an unexposed silver halide photographic light-sensitive material. The printing paper drawn from the magazine is cut into a sheet of printing paper of given size via roller R and cutter portion C. This sheet of printing paper is transported by transporting belt B to exposure portion E, where it is subjected to exposure for original image O. The thus-exposed sheet of printing paper is further transported by a number of pairs of feed roller R to automatic processing machine A. In the automatic processing machine A, the sheet of printing paper is sequentially transported through color developing tank 1A, bleach-fixing tank 1B and stabilizing tanks 1C, 1D and 1E (comprising substantially three tanks) by a transporting roller (no reference symbol given), where it is subjected to color development, bleach-fixation and stabilization, respectively. The sheet of printing paper thus processed is dried at drying portion 35 and then discharged out of the automatic processing machine.

In the figure, the dashed line indicates the transportation path for silver halide photographic light-sensitive material. Also, although the light-sensitive material is introduced to automatic processing machine A in a cut form in this example, it may be introduced to the automatic processing machine in a band form. In such a case, processing efficiency can be improved by providing an accumulator for transient retention of the light-sensitive material between automatic processing machine A and photographic printer B. Also, the automatic processing machine relating to the present invention may be unified with photographic printer B or may stand alone. The silver halide photographic light-sensitive material processed by the automatic processing machine relating to the present invention is not limited to exposed printing paper; it may be an exposed negative film or the like. Although the following description of the present invention concerns with an automatic processing machine which comprises substantially three tanks, namely a color developing tank, a bleach-fixing tank and a stabilizing tank, it is not to be construed as limitative; the invention is applicable to automatic processing machines which comprise substantially four tanks, namely a color developing tank, a bleaching tank, a fixing tank and a stabilizing tank.

Figure 4:
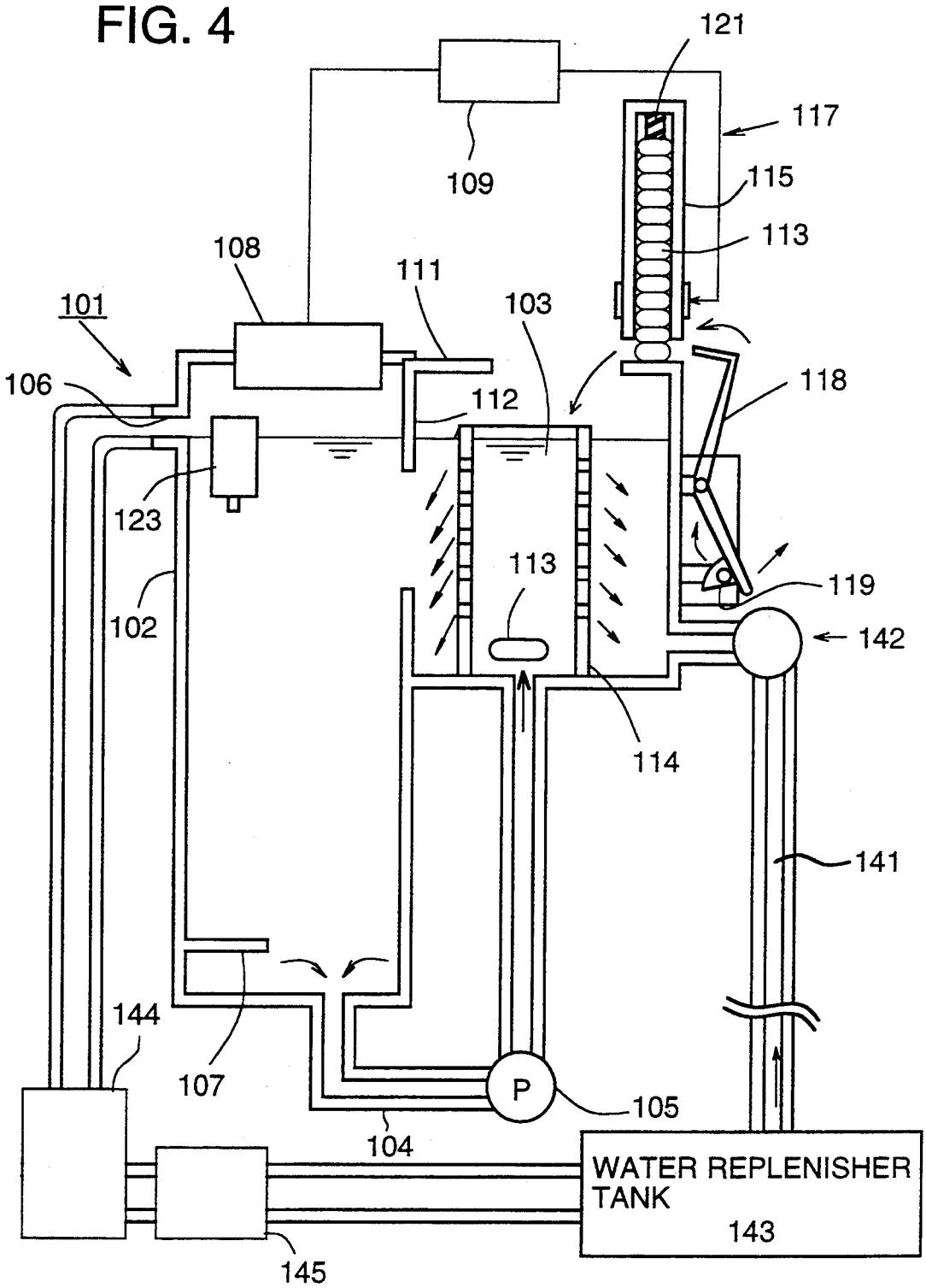
FIG. 4 is a cross sectional view of an automatic processing machine wherein replenishing water supplying means, photographic processing solution evaporating and concentrating device, a processing agents supplying section and a processing agent supplying means are combined.

FIG. 4 is a schematic diagram of color developing tank 1A of automatic processing machine A of FIG. 1, as viewed on the I—I cross-section thereof. Bleach-fixing tank 1B and stabilizing tanks 1C, 1D and 1E are of the same configuration as color developing tank 1A; processing tank 1 mentioned hereinafter means any of color developing tank 1A, bleach-fixing tank 1B and stabilizing tanks 1C, 1D and 1E. In the figure, light-sensitive material transporting means etc. are not illustrated for simple representation. Also, the present example concerns with the use of tablet 13 as a solid processing agent.

Processing tank 1 has processing portion 102 for processing a light-sensitive material and solid processing agent receiving portion 111 which is unified outside the separating wall of said processing portion 102 and to which tablet 113 is supplied. Processing portion 102 and solid processing agent receiving portion 111 are mutually removed by separating wall 112 having a communicating window, which allows passage of the processing solution. Because receiving portion 111 has processing agent receiving section 114 formed therein, the processing agent never moves to processing tank 102 while remaining solid.

Cylindrical filter 103, provided under solid processing agent receiving portion 111 in an exchangeable state, functions to remove insoluble substances, such as paper rubbish, from the processing solution. The inside of filter 103 communicates to the aspiration side of circulatory pump 105 (means for circulation) via circulatory pipe 104 set through the lower wall of solid processing agent receiving portion 111.

The circulatory system is configured with circulatory pipe 104 forming a solution circulating path, circulatory pump 105, processing tank 102 and other elements. The other end of circulatory pipe 104 communicating to the discharge side of circulatory pump 105 passes through the lower wall of processing portion 102 and communicates to said processing portion 102. By this configuration, upon activation of circulatory pump 105, the processing solution is aspirated via solid processing agent receiving portion 111 and discharged to processing portion 102, where it is mixed with the processing solution in processing portion 102 and then returns to solid processing agent receiving portion 111; this circulation is repeated in cycles. The flow rate of this circulatory flow is preferably not less than 0.1 rotation (1 rotation=circulatory volume/tank capacity), more preferably 0.5 to 2.0 rotations per minute relative to the tank capacity. Also, the direction of circulation of the processing solution is not limited to the direction shown in FIG. 2; it may be opposite.

Waste liquid discharge pipe 106, which is for overflowing the processing solution in processing portion 102, serves not only to keep the liquid level constant but also to prevent retention and concentration of the components carried over with the light-sensitive material from the processing solution in the processing portion and the components oozing out from the light-sensitive material.

The overflow solution is acumulated in effluent storage tank 144 after passing through effluent tube 106. Next, a distilled solution produced due to the processing of effluent by effluent processing device 145 is stored in replenishing water tank 143. It goes without saying that an overflow solution from each processing tank is accumulated in a effluent storage tank respectively in the same manner as above, and processed in the same manner. Replenishing water supplying means 142 is a means for supplementing replenishing water from replenishing tank 143 which stores replenishing water to processing agent supplying section 111.

Incidentally, it goes without saying that replenishing tank 143 may replenish not only a distilled solution but also tap water or the like by connecting with other replenishing water tanks directly or independently therefrom.

Replenishing water supplying means 142 operates based on information on the processing amount of light-sensitive material, and replenishing water is replenished to processing agent supplying section 111 from replenishing water tank 143.

Bar heater 107 placed at the bottom of processing portion 102 is for heating the processing solution in processing tank 1, i.e., it is a temperature controlling means for retaining the processing solution in processing tank 1 in an appropriate temperature range (e.g., from 20° to 55° C.).

Processing amount information detecting means 108, provided at the inlet of the automatic processing machine, is used to detect information on the amount of processing of the light-sensitive material. This processing amount information detecting means 108 comprises a plurality of left-right arranged detecting elements and functions to detect the width of the light-sensitive material and count the detection time. Because the transportation rate of the light-sensitive material is pre-set mechanically, the area of light-sensitive material processed can be calculated from information on the width and the time. This processing amount information detecting means may be any one, as long as it is capable of detecting the width and transportation time of light-sensitive material. Examples of such processing amount information detecting means include an infrared sensor, a microswitch and an ultrasonic sensor. In the case of the printer processor of FIG. 3, the processing amount information detecting means may be such that the area of light-sensitive material processed is indirectly detected, e.g., the amount of light-sensitive material printed, or the number of pre-set area of light-sensitive material units processed may be detected. Detection timing, which is before processing in the present example, may be after processing or during immersion in the processing solution (these can be achieved by properly changing the position of processing amount information detecting means 8 to another position allowing information detection after or during processing). The information detected is not limited to the area of light-sensitive material processed as in the above description; any information can serve for the purpose, as long as it is a value in proportion to the amount of light-sensitive material which is to be processed, which was processed or which is being processed; it may be the concentration of the processing solution in the processing tank or the change therein. Processing amount information detecting means 108 need not always be provided for each of processing tanks 1A, 1B, 1C, 1D and 1E; it is preferable to provide one processing amount information detecting means 108 for each automatic processing machine.

Processing agent supplying means 117 for adding the solid processing agent, stored in cartridge 115, to the processing tank, arranged above filtering portion (section) 114 described below, has cartridge 115 containing tablet 113 (solid processing agent), and pusher 118 for pushing out one or more pieces of tablet 113. This processing agent supplying means 117 is controlled by processing agent supply controlling means 109 described later, and upon supplying signal reception from processing agent supply controlling means 109, it pushes out waiting tablet 113 by means of pusher 118 to filtering portion (section) 114 in solid processing agent receiving portion 111. In the above-mentioned process, cam 119 is operated by means of a mechanism to stop rotation of axis 1 and extrusion member 118 and operated so that a tablet which has been in the state of ready is supplied to processing tank 102 and the succeeding tablet immediately becomes in the state of ready because it is pressed downward by spring.

In the present invention, solid processing agent 113 is supplied to filtering portion (section) 114 in solid processing agent receiving portion 111, but it may be supplied to any portion in processing tank 102. In other words, with respect to the position to which the solid processing agent is added, the present invention requires merely the capability of dissolving the solid processing agent using the processing solution; it is necessary to add the components according to the information on the amount of processing of light-sensitive material and keep the processing performance of the processing solution in processing tank 102 constant. More preferably, the solid processing agent is supplied to the circulatory path for the processing solution. Preferably, this processing agent supplying means 117 is arranged to avoid contact of the solid processing agent before being supplied to the processing tank with moisture in the processing tank of the automatic processing machine, atmospheric moisture and the spilled processing solution.

Filtering means (section) 114, immersed in the processing solution in solid processing agent receiving portion 111, removes the substances which originate from tablet 113 and other types of solid processing agent and which can cause flaws in the finished image, poor processing in the portion to which they adhere, and other undesirable things, if they adhere to the light-sensitive material, such as insoluble substances from tablet 113 supplied by processing agent supplying means 117, e.g., insoluble contaminants in tablet 113, and lumps of tablet 13 resulting from its disintegration. This filtering means (section) 114 is coated with resin. The filtering portion 114 need not always be provided in solid processing agent receiving portion 111; it may be provided at any position, as long as tablet 113 supplied by processing agent supplying means 117 does not enter the light-sensitive material transporting path illustrated in FIG. 3 or the processing solution in processing portion 102.

Processing agent supply controlling means 109 controls processing agent supplying means 117; when the information on the amount of processing of light-sensitive material (processing area, in the present example), as detected by processing amount information detecting means 108, reaches a given level, it passes a processing agent supplying signal to processing agent supplying means 117. Processing agent supply controlling means 109 controls processing agent supplying means 117 so that the required amount of processing agent according to the information on the amount of light-sensitive material processed is supplied to solid processing agent receiving portion 111.

Next, the action of the present invention is described by means of FIG. 4. With respect to the exposed light-sensitive material, information on the amount of processing is detected by processing amount information detecting means 108 at the inlet of automatic processing machine A. Upon reach of the integrated area of light-sensitive material processed to a given level, processing agent supply controlling means 109 and replenishing water supplying means 142 passes a supplying signal to processing agent supplying means 117 and replenishing water supplying means 142 according to the information on the amount of processing detected by processing amount information detecting means 108. Upon supplying signal reception, processing agent supplying means 117 and replenishing water supplying means 142 pushes out and supplies tablet 113 by means of pusher 10 to filtering portion (section) 114 in solid processing agent receiving portion 111. Replenishing water is supplied to solid processing agent supplying section 111 from replenishing water tank 143. Tablet 113 thus supplied is dissolved in the processing solution in solid processing agent receiving portion 111, wherein its dissolution is facilitated by the processing solution being circulated by a means for circulation in the cycle of solid processing agent receiving portion 111→circulatory pump 105→processing portion 102→communicating window→solid processing agent receiving portion 111. The detected light-sensitive material is sequentially transported by a transporting roller through color developing tank 1A, bleach-fixing tank 1B and stabilizing tanks 1C, 1D and 1E (see automatic processing machine A in FIG. 3). Color developing tank 1A, bleach-fixing tank 1B and stabilizing tanks 1C, 1D and 1E may be equipped with processing agent supplying means 117 respectively, for simultaneously supplying the processing agent thereto. Supplying timing may be different among these supplying means. The given area based on which the processing agent supplying means is controlled by processing agent supply controlling means 109 may be constant among processing tanks 1A, 1B, 1C, 1D and 1E or not.

Another embodiment of the present invention is described below. Bleach-fixing tank 1B and stabilizing tanks 1C, 1D and 1E are of the same configuration as color developing tank 1A; processing tank 1 mentioned hereinafter means any of color developing tank 1A, bleach-fixing tank 1B and stabilizing tanks 1C, 1D and 1E. Since the same numbers as in FIG. 3 are used for corresponding components having the same function, they are not described here. Also, light-sensitive material transporting means etc. are not illustrated for simple representation. In this example, a filtering means has been mentioned as a preferred example, the desired effect of the present invention can be sufficiently obtained even in the absence of such a filtering means.

As stated above, the present invention is excellently effective in that a compact automatic processing machine is realized because replenisher tanks are unnecessary, which are necessary for conventional automatic processing machines, and hence no space therefor is required, that solution preparing operation is unnecessary because a solid processing agent is supplied to the processing tank so that there is no fear of solution spillage or adhesion to, and contamination of, the human body, clothing and peripheral equipment during solution preparation, and handling is easy, and that processing solution replenishing accuracy improves so that stable processing performance is obtained without deterioration of the processing agent replenisher components.

Figure 5:
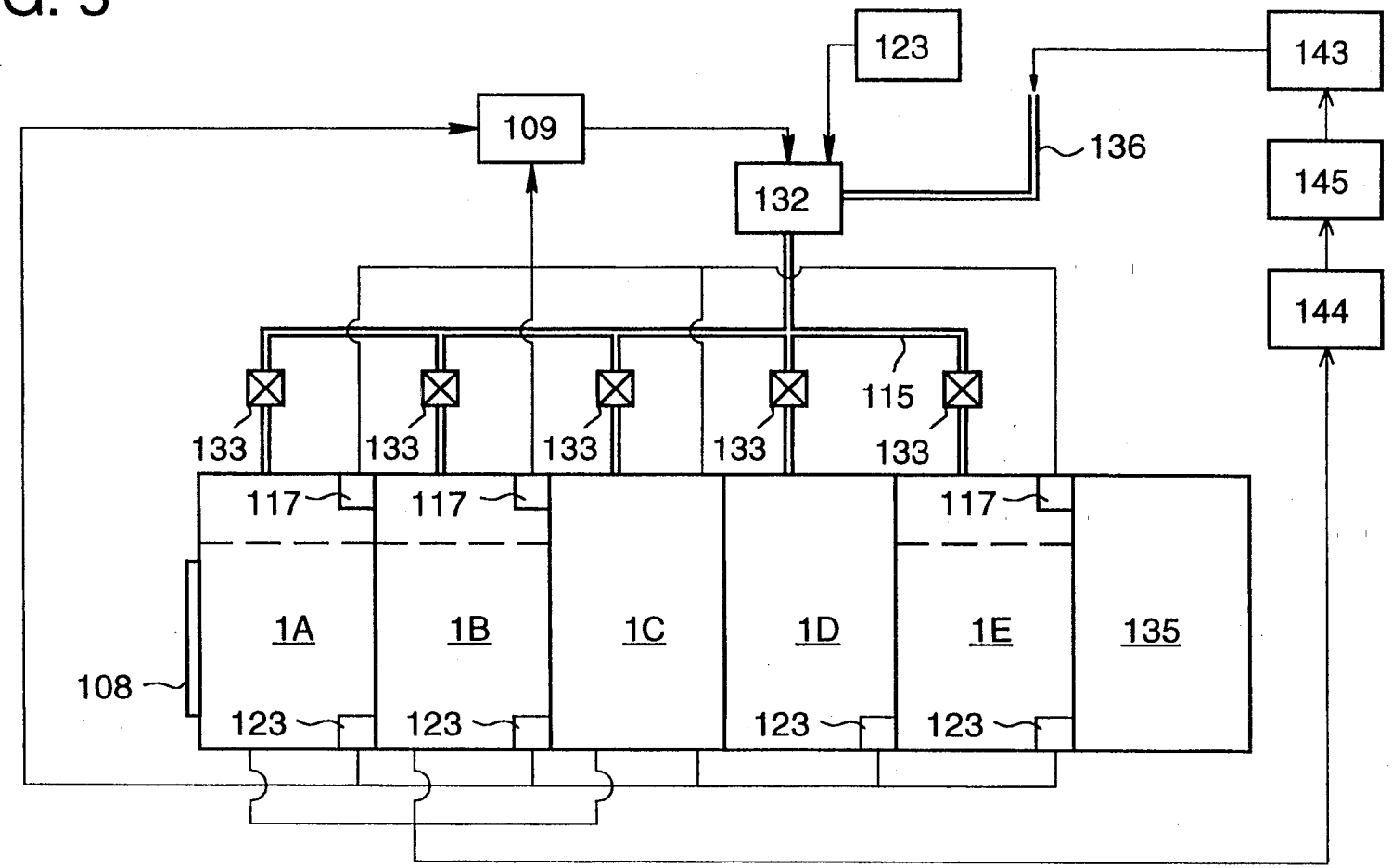
FIG. 5 is a plane view of the automatic processing machine A described above.

FIG. 5 is a schematic top view of automatic processing machine A of FIG. 3. (Incidentally, an effluent processing device and a route supplying distilled water as a replenishing means are illustrated.)

Solutions overflowed from color developer tank 1A, bleach-fixer tank 1B and stabilizer tank 1C are stored in effluent storage tank 144 and processed in the following effluent processing device 145. The resulting distilled water is stored in replenishing water tank 143. Hot water replenishing device 132 which is composed of a pump and a temperature-adjuster, electromagnetic valve 133 and replenishing water tube 136 are parts of replenishing water supplying means. This replenishing water supplying means 142 (hot water replenishing means 132 and electromagnetic valve 133) is used for diluting accumulation-inhibiting components which generate due to reaction, while replenishing moisture which was taken out from a light-sensitive material and which evaporated from the surface of the tank. In addition, replenishing water tank and replenishing water pump may be provided to each of processing tank 1A, 1B, 1C, 1D and 1E. However, when only one replenishing water tank is used wherein all tanks use the same replenishing water, the automatic processing machine becomes compact. It is recommended that only one replenshing tank and one replenishing water pump are provided to the automatic processing machine and an electromagnetic valve is provided to a route (pipe) for replenishing so that necessary amount of replenishing water is supplied to each processing tank when necessary. Or by increasing/decreasing the amount of replenishing by adjusting the diameter of the pipe for replenishing water, the number of replenishing water tank 143 and the replenishing pump can be reduced to one respectively for one automatic processing machine, resulting in further compact size. Incidentally, with regard to stabilizer tank 1C and 1D which are respectively a processing tank, the replenishing water supplying means can be eliminated by supplying a stabilizer overflowed from stabilizer tank 1D and 1E respectively.

In the above construction, solution overflow is piped into effluent storage tank 144. The solution is taken into effluent processing device 145 where evaporated and processed. The resulting distilled solution is piped into replenishing water tank 143 gradually. On the other hand, upon reach of the integrated area of light-sensitive material processed to a given level, processing agent supply controlling means passes a supplying signal to replenishing water supplying means 142 (hot water replenishing device 132 and electromagnetic valve 133) according to the information on the amount of processing detected by processing amount information detecting means 108. Upon supplying signal reception, replenishing water supplying means 142 pushes out and supplies replenishing water by means of hot water replenishing device 132 and electromagnetic valve 133 to each processing tank or processing tank which is requesting replenishing water in a given amount or in a necessary amount. In this case, "given area" may be the same as in processing agent supplying means 109. However, not restricted thereto, it may be a given area given specifically.

Since distilled solution of processing solution is used as replenishing water, excession or shortage of replenishing water may occur depending upon the amount of processing. When the amount of replenishing water is in shortage, water may be added to the tank for replenishing water removely. In addition, the number of processing tanks using the distilled solution may be limited.

So far an automatic processing machine containing various processing tanks were explained. In addition, the effects of the present invention were observed in both an automatic processing machine for color negativ efilms containing, as processing tanks, a developing tank for housing a developer therein, a bleaching tank for housing a bleacher, a bleach-fixing tank for housing a bleach-fixer, a fixing tank for housing a fixer and a stabilizing tank for housing a stabilizer wherein the above-mentioned housing means and/or supporting means, the above-mentioned supplying means and the above-mentioned controlling means are provided for each processing tank and an automatic processing machine for black-and-white silver halide photographic light-sensitive material containing, as processing tanks, a developing tank for housing a developer and a fixing tank for a fixer wherein the above-mentioned housing means and/or a supporting means, the above-mentioned supplying means and the above-mentioned controlling means are provided for each of the above-mentioned processing tank.

So far the mechanism for paper processor was explained. However, that for negative film processors can be structured in the same manner. In addition, a structure wherein effluent of negative films and papers can be joined so as to be processed concurrently can be designed.

In addition, with regard to the line flow of effluent processing, even when the solution overflow of a color negative film processing and a color paper is connected so that both solutions are mixed, the effects of the present invention can be observed. (See FIG. 6(A))

In addition, in the case of using a distilled solution after the effluent is processed for tanks other than for a color developing solution, the effects of the present invention are observed (see FIG. 6(A)). Incidentally, 146 in the aforesaid figure represents replenishing water tank for color developing, 147 represents a color negative film processing line and 148 represents a color paper processing line. In addition, 1F represents a bleaching tank, and 1G and 1G' respectively represent a fixing tank.

Figure 14:
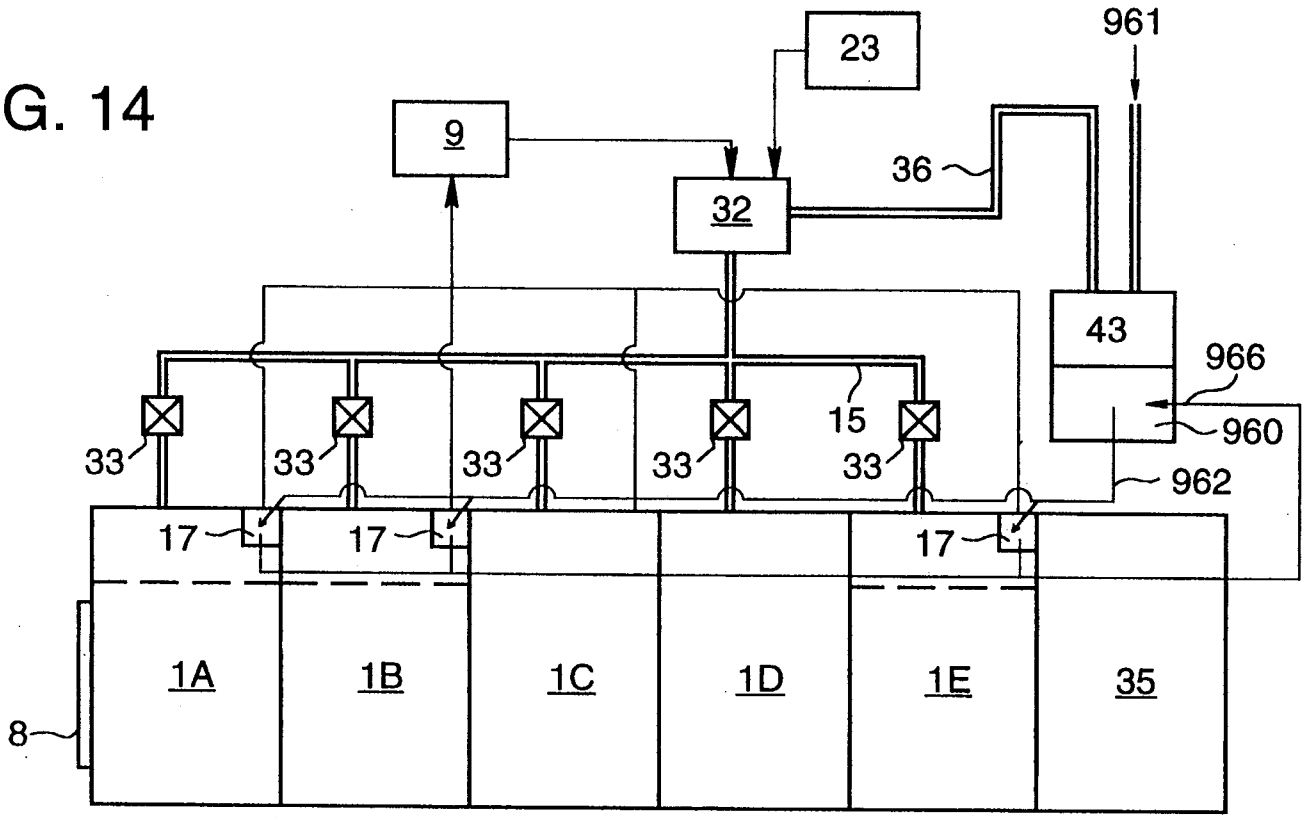
FIG. 14 is a plane view of an automatic processing machine where a means for circulating air between solid agent supply means and water-in-air separation apparatus.
Figure 15:
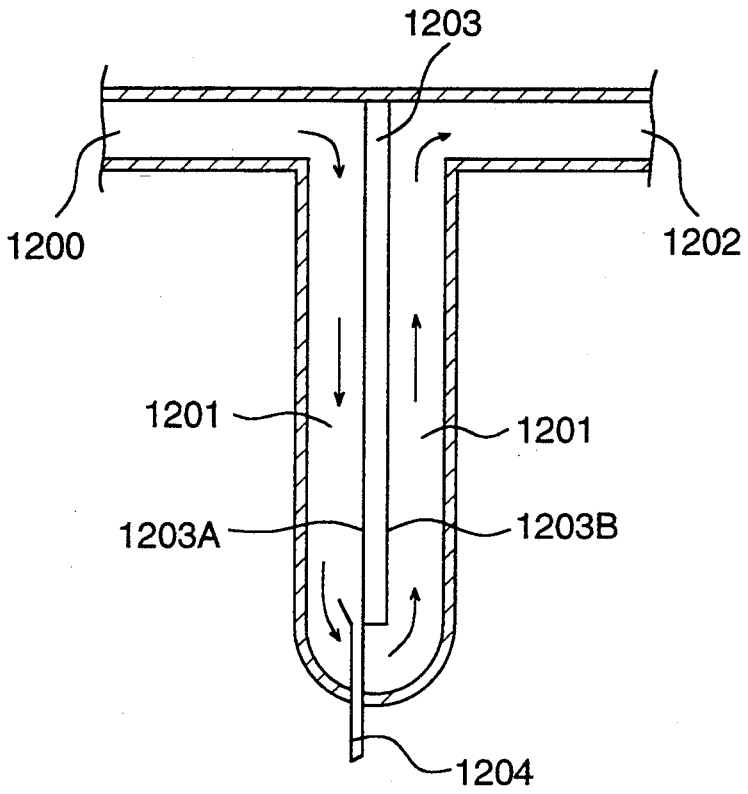
FIG. 15 is a cross-sectional view of a dehumidifier in which a peltier element is used.
Figure 16:
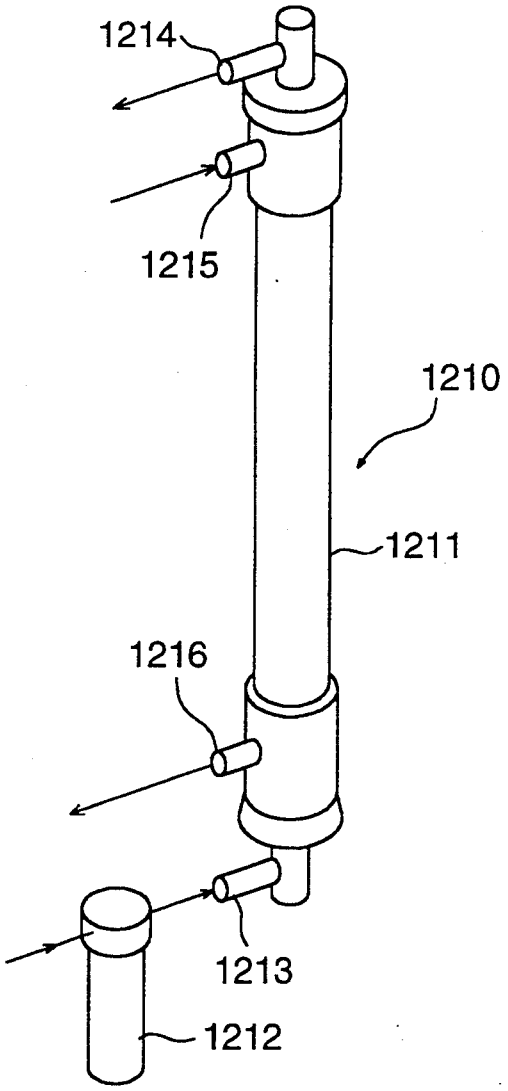
FIG. 16 is a cross-sectional view of a dehumidifier in which a semipermeable film to separate water is used.

In addition, in the present invention, humidity around the automatic processing machine, especially around the solid processing agent supplying means 115 and processing agent supplying means 117 is removed by operating the dehumidifier available on the market which has been modified so as to be built in the automatic processing machine as a device for removing moisture from air (not illustrated) so that sticking of tablet 113 each other can be prevented. (FIG. 14)

Timing of the operation of the above-mentioned dehumidifier can be determined depending upon humidity outside and temperature. In high humidity condition such as in summer, the dehumidifier can be operated all through day regardless whether or not the automatic processing machine is operated.

On the other hand, when the ambient circumstances is in a low humidity, it is also possible to operate the automatic processing machine while humidifying appropriately by the use of a humidifier available on the market.

Figure 7:
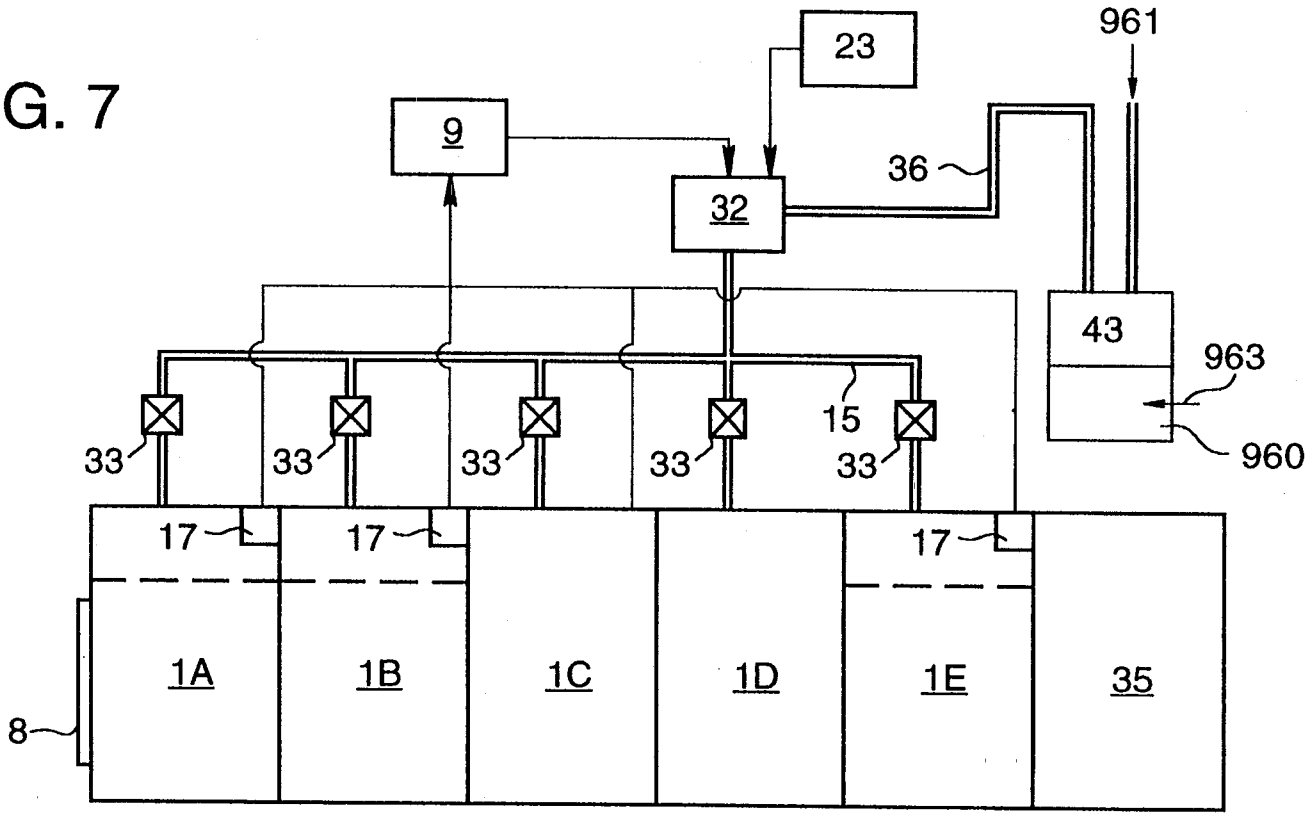
FIG. 7 is a plane view of the automatic processing machine A described above.
Figure 8:
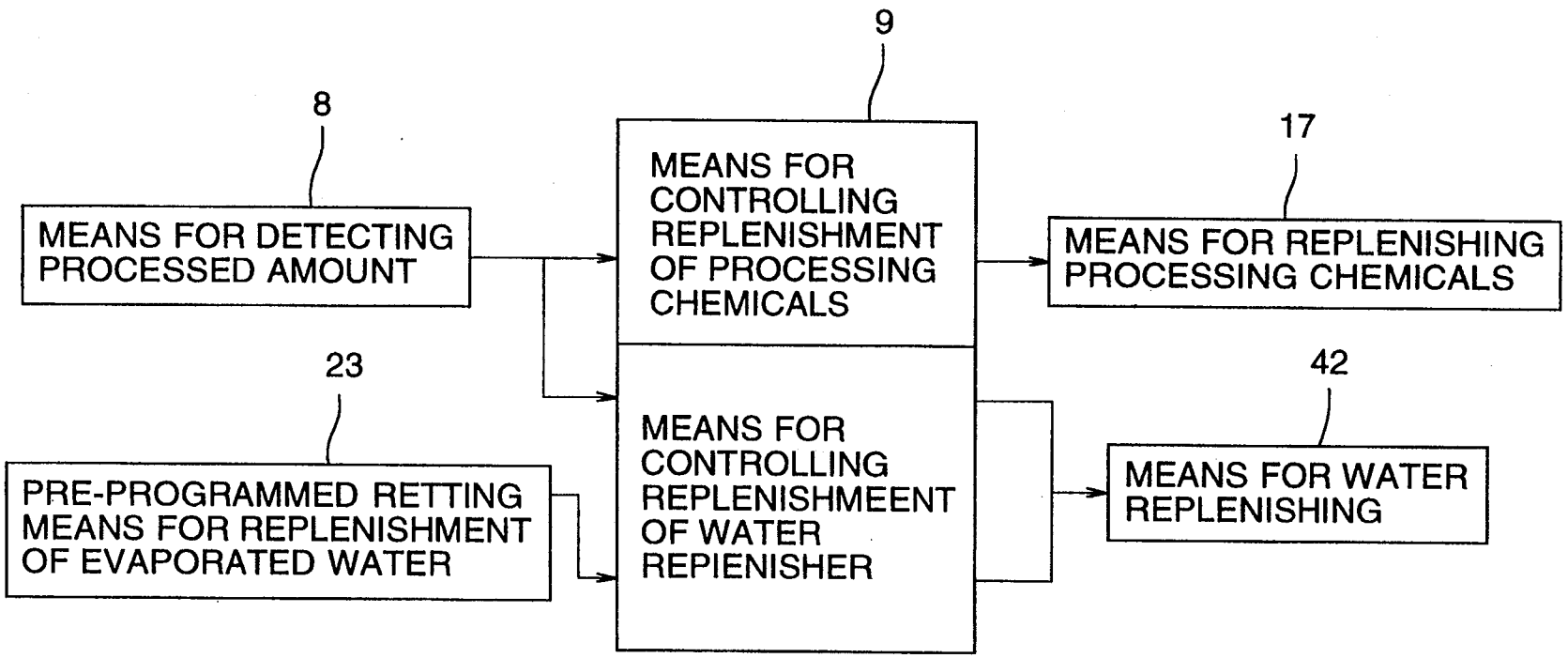
FIG. 8 is a block diagram showing the control means for an automatic processing machine.
Figure 9:
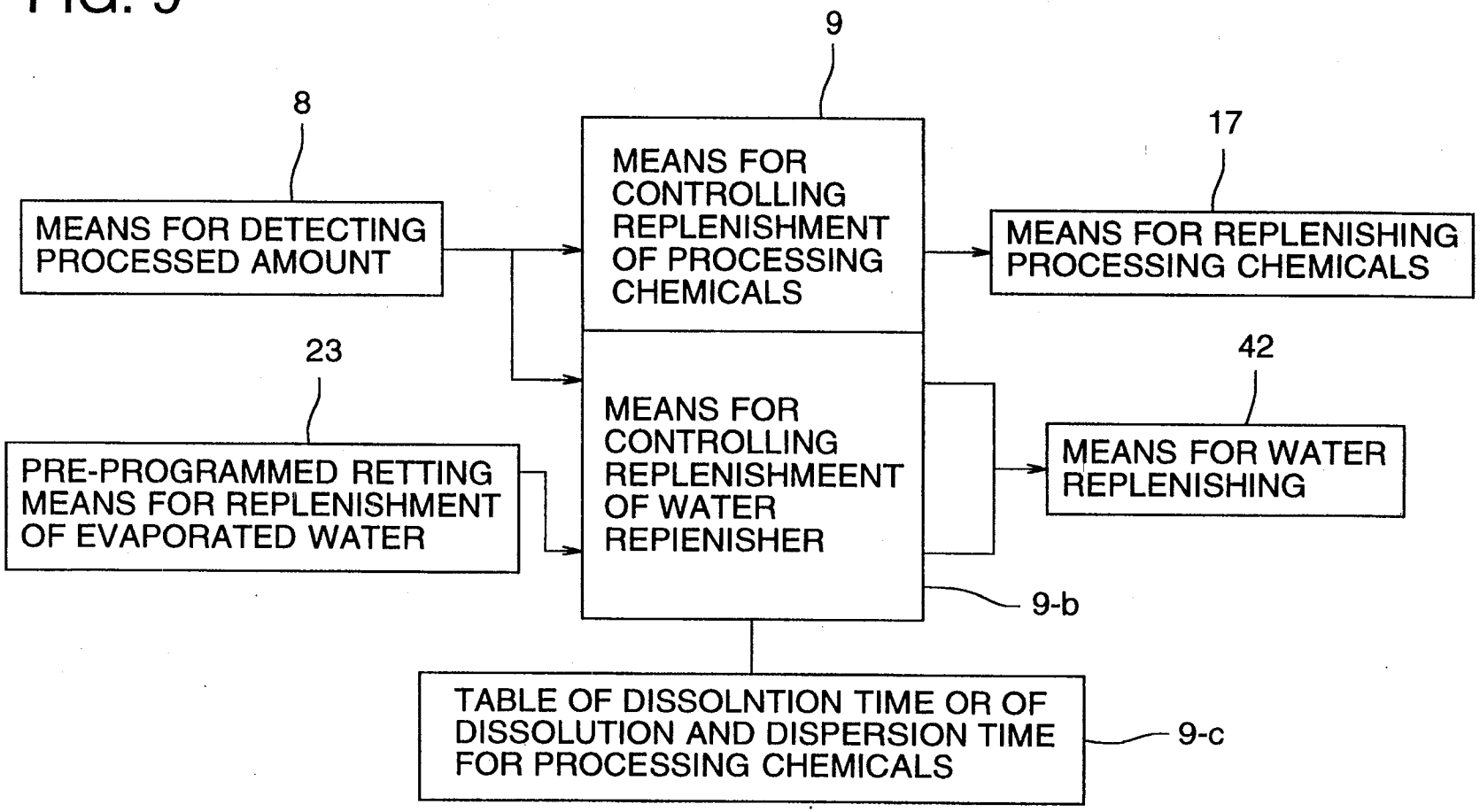
FIG. 9 is a block diagram showing the control means with a dissolution table of an automatic processing machine.

As another embodiment of the present invention, FIG. 7 shows an automatic processing machine A of FIG. 1, as viewed from above (for the sake of explanation, the path for the replenishing water supplying means is illustrated). FIG. 8 is a block diagram of the control relating to this example. FIG. 9 is a block diagram of a combination of the controlling means and a programmed evaporated water replenishing setting means 23.

In FIG. 7, numeral 960 is a commercial dehumidifier subjected to modification which is used as a device for removing moisture from air. Dehumidifier 960 is so structured as to dehumidify air which has been taken in through duct 963 for taking in air and to dry air near the automatic processing machine. On the other hand, water produced due to condensation by means of dehumidifier 960 is supplied to tank 43 as replenishing water and utilized as replenishing water by means of the above-mentioned means.

In addition, when the shortage of condensed replenishing water occurs, it is so structured that replenishing water 961 for covering the shortage can be replenished from tap water in order to make up the difference. However, in the present invention, the need for tap water for augmenting replenishing water 961 can be reduced noticeably.

Waters for this replenishment include not only ordinary waters such as well water and tap water but also those containing fungicides such as isothiazoline and chlorine-releasing compounds, a small amount of sulfite chelating agent, and ammonia or inorganic salt, as long as it does not affect photographic performance.

This replenishing water supply control means controls the replenishing water supplying means 32 by programmed evaporated water replenishing setting means 23 and/or controls the replenishing water supplying means 32 according to the information on the amount of processing detected by processing amount information detecting means 8. The base of control by this replenishing water supply control means is not confined to the information on the amount of processing detected by processing amount information detecting means 8; it may be the information of supply of the processing agent by processing agent supplying means 17.

Figure 10:
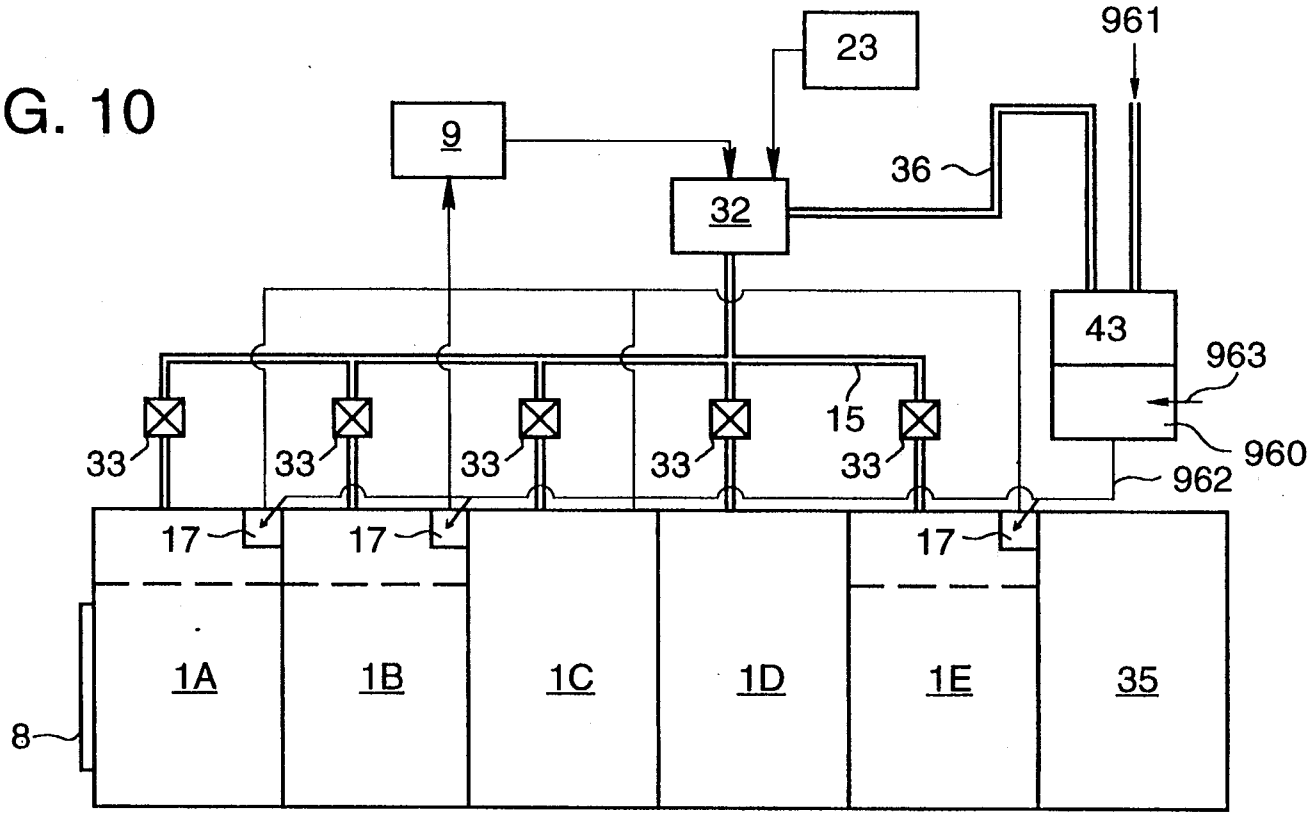
FIG. 10 is a plane view of the above-mentioned automatic processing machine wherein a means for introducing dry air to the processing agent supplying means.

FIG. 10 is a schematic diagram showing another example of the automatic processing machine of the present invention. The processing apparatus shown in this figure has the same structure as an apparatus shown in FIG. 4 except for sending air dehumidified by dehumidifier 960 subjected to modification to solid processing agent supplying means 17 for preventing moisture absorption of the solid processing agent more completely. No. 962 is a duct for feeding the above-mentioned dehumidified air to solid processing agent supplying means 17.

Figure 11:
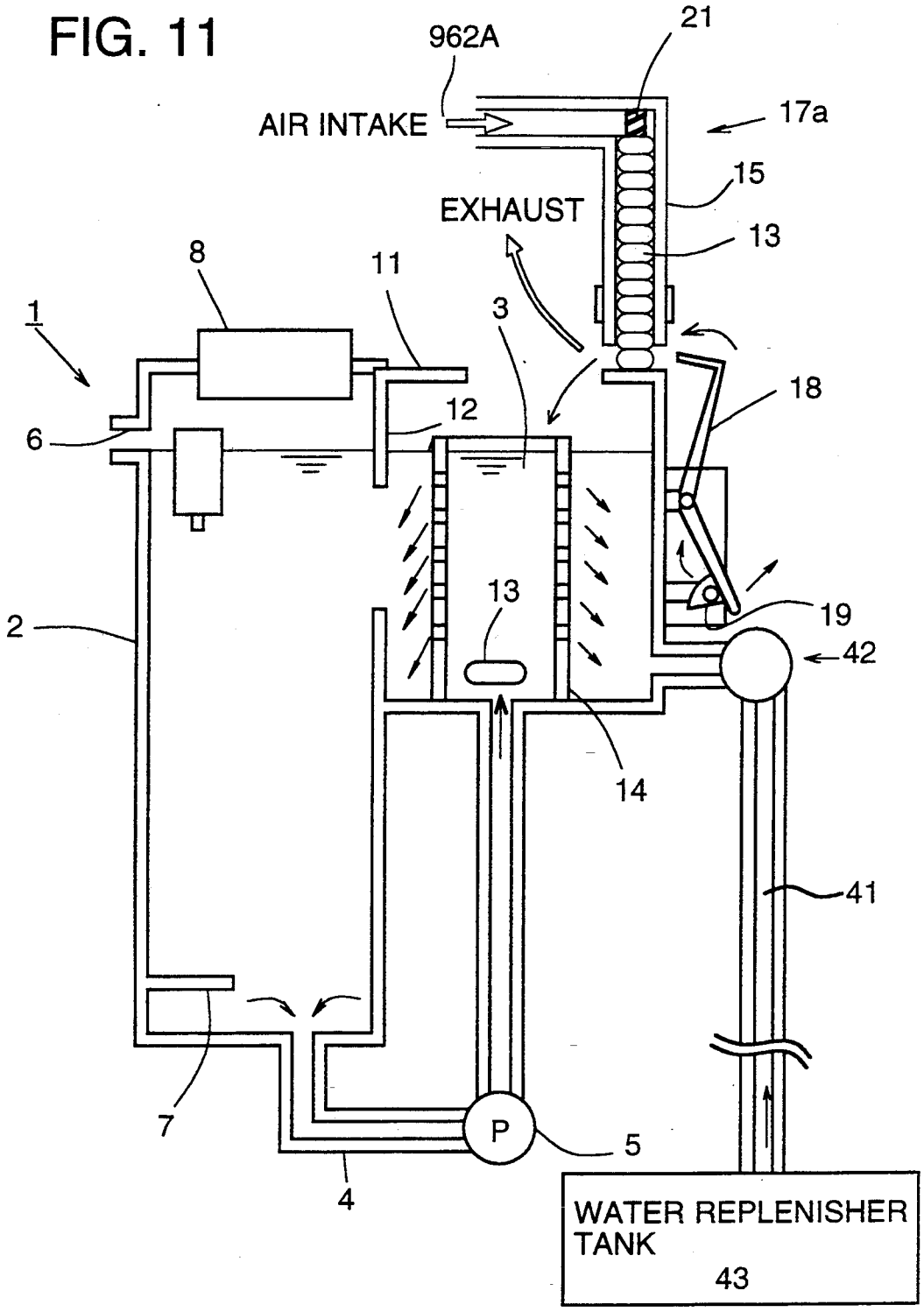
FIG. 11 is a cross sectional view of the processing agent supplying means in the above-mentioned automatic processing machine.

FIG. 11 is a schematic diagram showing an example of solid processing agent supplying means 17 shown in FIG. 10. It is structured in the same manner as the apparatus shown in FIG. 4 except that solid processing agent 13 is dried by feeding dry air 962A condensed by dehumidifier 960 (FIG. 10) to solid processing agent supplying means 17 shown in FIG. 11. Air fed thereto is exhausted by an exhaust port. The amount of dry air 962A fed can be adjusted through measuring humidity in solid processing agent supplying means 17. Due to the above-mentioned structure, deformation of each solid agent 13 housed in solid processing agent supplying means 17, caused by humidity, can be minimized.

The best timing of the operation of dehumidifier 960 is when humidity inside solid processing agent supplying means 17 is sensed for starting operation. The dehumidifier is controlled to serve such a purpose.

Figure 12:
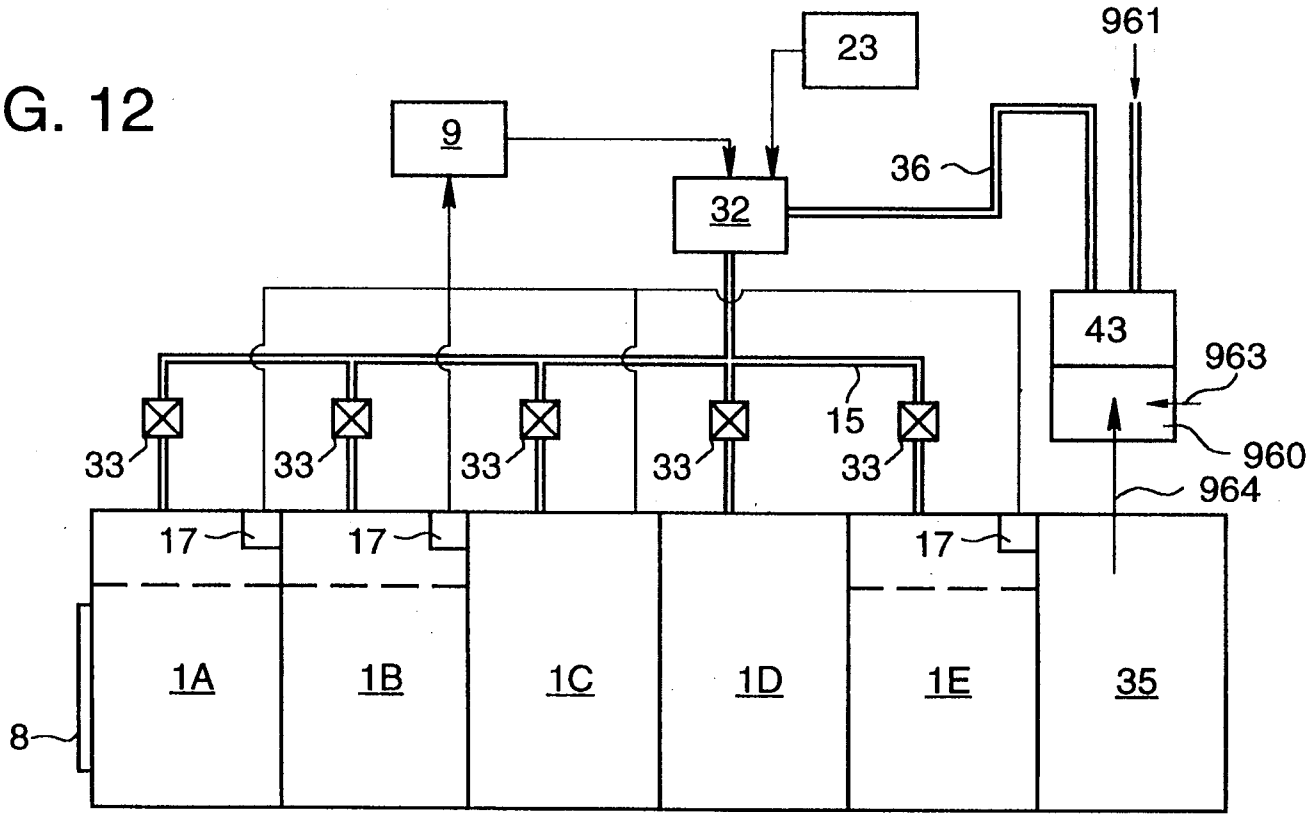
FIG. 12 is a plane view of an automatic processing machine where a means for intaking air from the drier section has been added.

FIG. 12 is a schematic diagram of another example of the automatic processing machine of the present invention. This machine shows a means for intaking vapor exhausted from the drier section of the processing unit and separating moisture therefrom. The unit shown in FIG. 9 has the same mechanism as the processing unit as shown in FIG. 7 except that the intaking section of dehumidifier 960 and exhausting section of the drier unit 35 are connected through duct 964. The good timing for the operation of dehumidifier 960 is when the humidity inside the drier unit 35 is high. In other words, when the processing unit (the automatic processing machine) is operated, moisture can be obtained most effectively. Accordingly, the dehumidifier is so controlled as to operate in conjunction with the processing unit.

FIG. 3 is a schematic diagram of another example of the automatic processing machine of the present invention. This machine shows an example having a means for intaking vapor existing above the processing tank of the processing unit and separating moisture therefrom. The machine shown in FIG. 10 has the same mechanism as the processing unit shown in FIG. 4 except that the intaking section of dehumidifier 960 and the exhausting section exhausting vapor above each processing tank of the processing unit are connected through duct 965.

The good timing for operating dehumidifier 960 is when the humidity inside each processing tank 1A through 1E is high. In other words, when the processing unit (the automatic processing machine) is operated, moisture can be obtained most effectively. Accordingly, it is so controlled as to operate in conjunction with the processing unit.

FIG. 4 is a schematic diagram showing further another example of the automatic processing machine of the present invention. This machine shows an example of a means for intaking air exhausted from solid processing agent supplying means and separating moisture therefrom. The machine shown in FIG. 4 has the same structure as the processing unit shown in FIG. 10 except that the intaking section of dehumidifier 960 and the exhausting port of solid processing agent supplying device 17 are connected through duct 966.

Dehumidifier 960 used in the present example is as follows:

As a heat pump type dehumidifier, a dehumidifier SAD-140R produced by SANYO ELECTRIC Co., Ltd. (having dehumidifying capacity of 12 l/day) was used after being modified for meeting the present example.

Even when a dehumidifier wherein Peltier element is used was used after being modified, similar effects could be achieved. FIG. 5 shows a schematic diagram of aforesaid dehumidifier, wherein 1200 is a intaking port for air, 1201 is a route where air passes, 1202 is an exhausting port of dry air, 1203 is a condenser composed of Peltier element, 1203A is a chilling surface, 1203B is a heating surface and 1204 is a piping introducing condensed solution to tank 43. While metals or semiconductors can be used for Peltier element, bismuth tellurium alloy was used in the present example.

Figure 6:
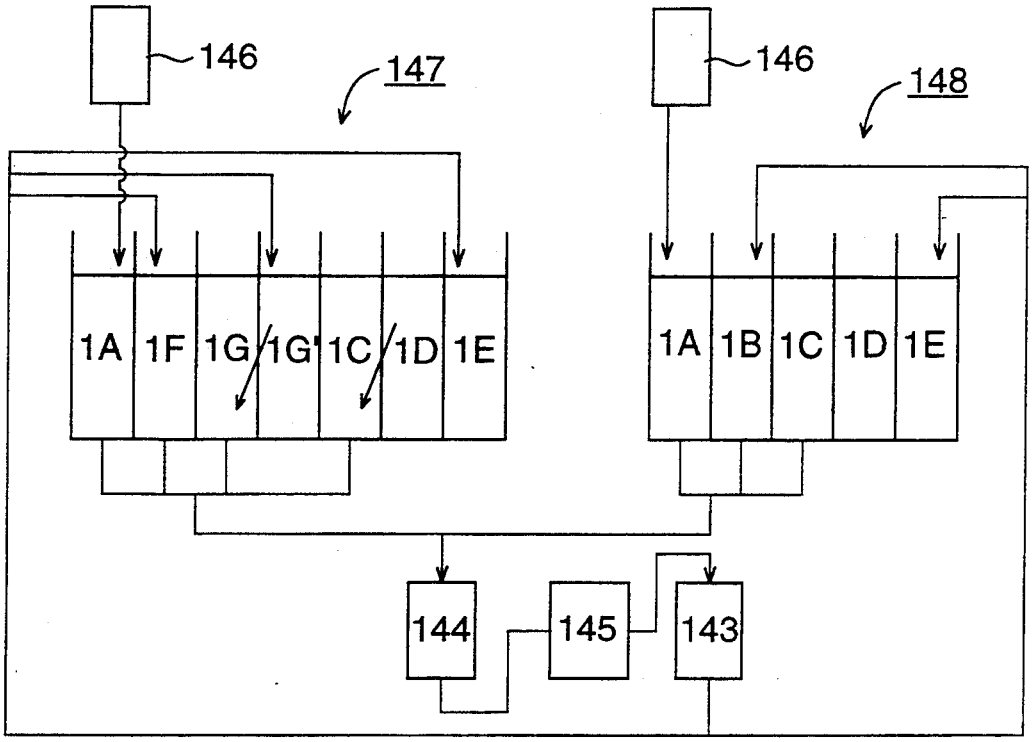
FIG. 6(A) is a block diagram showing an embodiment of a film-and-paper-commonly-using type automatic processing machine.
FIG. 6(B) is a block diagram showing another example of an automatic processing machine for paper use.
Figure 6:
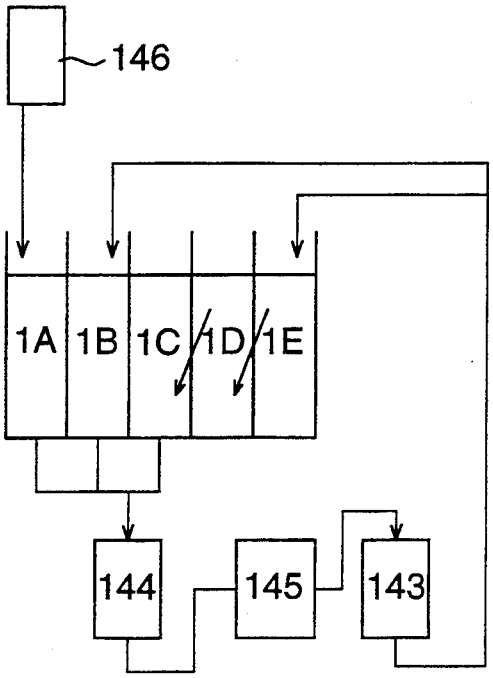
Figure 13:
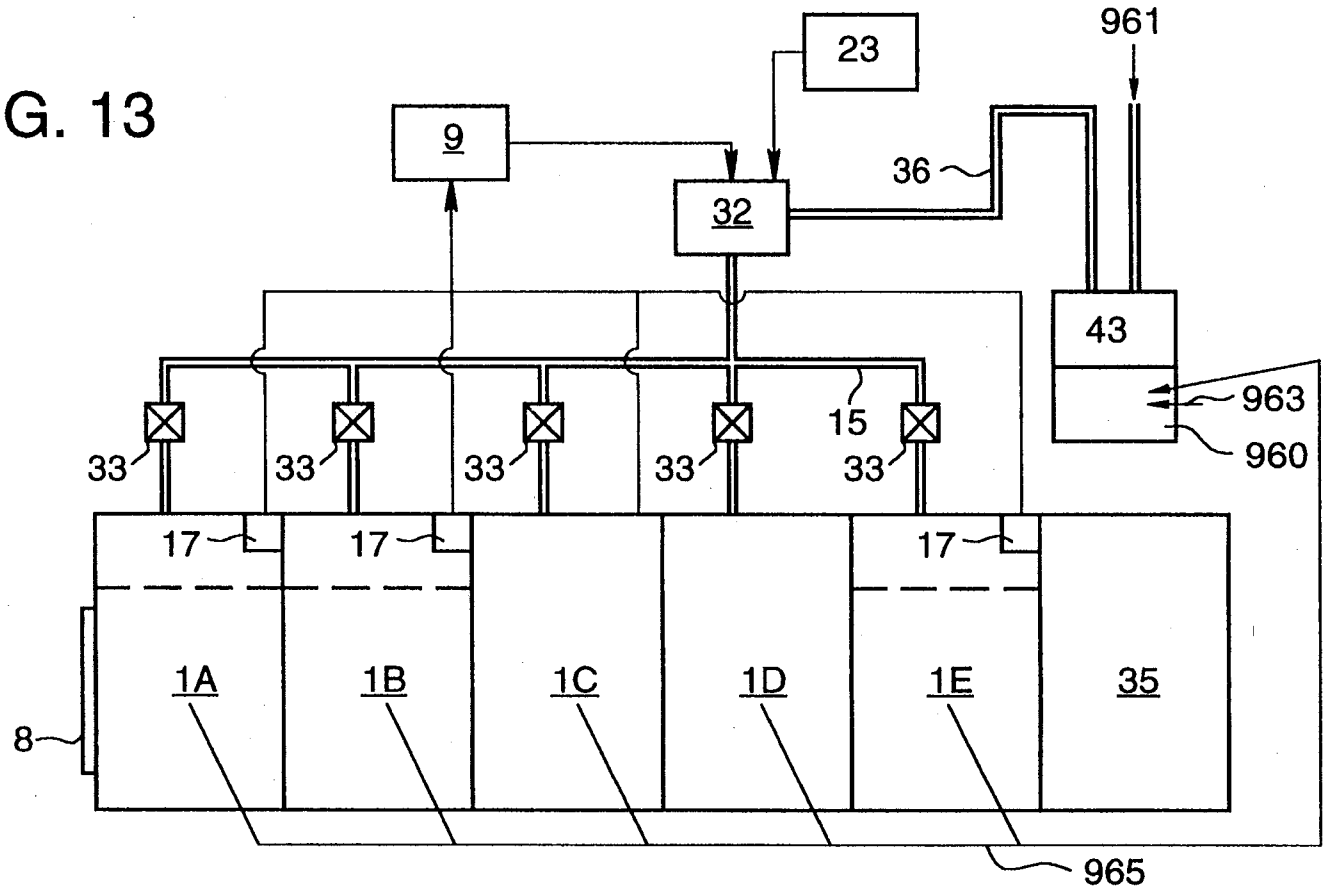
FIG. 13 shows a plane view of an automatic processing machine where a means for intaking air from the upper portion of a processing tank.

Even when a dehumidifier wherein semi-permeable membrane separating moisture is used was used after being modified, similar effects could be achieved. FIG. 6 shows the structure of the dehumidifier using the above-mentioned semi-permeable membrane. In FIG. 13, 1210 is a membrane module. Inside the outer tube 1211, plural semi-permeable polyimide hollow membrane (UBE Membrane Drier UM-A1, produced by Ube Kosan Co., Ltd.) which removes moisture are placed in the vertical direction. 1212 is an exhausting port of air dehumidified. 1215 is a supplying port of air to the shell side. 1216 is an exhausting port of wet air. Air with high humidity exhausted from exhausting port 1216 is introduced to the dehumidifier which uses Peltier element so that dry air and condensed solution are obtained.

Example 2

Tables 1, 2 and 3 show example kit elements of conventional processing agents.

TABLE 1

(1) Color developer replenisher (for mini-lab use)
Per liter of replenisher (12.35 $m^2$ to be processed)

| Part | Ingredients | Amount of addition | Finished quantity | pH/ specific gravity |
|---|---|---|---|---|
| A | Water | 30 g | 53 g | 11.0/1.058 |
| | Diethylene glycol | 14 g | (50 ml) | |
| | Brightening agent | 2.5 g | | |
| | Diethylhydroxylamine | 5.5 g | | |
| | 40% solution of pentasodium diethylenetriamine pentaacetate | 1.0 g | | |
| B | Water | 23 g | 61 g | 0/1.2200 |
| | p-toluenesulfonic acid | 28 g | (51 ml) | |
| | 50% solution of potassium sulfite | 0.75 ml | | |
| | CD-3 | 9.3 g | | |
| C | Water | 16.0 g | 104 g | 14/1.405 |
| | KBr | 0.05 g | (74 ml) | |
| | 40% solution of pentasodium diethylenetriamine pentaacetate | 6.1 g | | |
| | 50% $K_2CO_3$ | 63.0 g | | |
| | 50% KOH | 19.0 g | | |
| Total weight | | | 218 g | |

TABLE 2

(2) Bleach-fixer replenisher (for color printing paper)
Per liter of replenisher (18.5 $m^2$ to be processed)

| Part | Ingredients | Amount of addition | Finished quantity | pH/ specific gravity |
|---|---|---|---|---|
| A | Water | 334 g | 558 g | 5.70/1.250 |
| | Ammonium thiosulfate | 164 g | (450 ml) | |
| | Ammonium sulfite | 40 g | | |
| | Ammonium metabisulfite | 20 g | | |
| B | Water | 184 g | 438.5 g | 6.80/1.1450 |
| | 50% EDTA-Fe salt | 250 g | (380 ml) | |
| | EDTA-4H | 4.5 g | | |
| C | Water | 96 g | 178 g | 0.70/1.050 |
| | Acetic acid | 82 g | (170 ml) | |
| Total weight | | | 1174.5 g | |

In the table above, the EDTA-Fe salt is ammonium ferric ethylenediaminetetraacetate, and DETA-4H is ethylenediaminetetraacetic acid.

TABLE 3

(3) Superstabilizer (for color printing paper)
Per liter of replenisher (4 $m^2$ to be processed)

| Part | Ingredients | Amount of addition | Finished quantity | pH/ specific gravity |
|---|---|---|---|---|
| A | Water | 29 g | 30.5 g | 11.0/1.022 |
| | 48.5% KOH | 0.07 g | (30 ml) | |
| | 50% potassium sulfite | 0.32 g | | |
| | Antifungal agent | 0.10 g | | |

TABLE 3-continued (3) Superstabilizer (for color printing paper)
Per liter of replenisher (4 $m^2$ to be processed)

| Part | Ingredients | Amount of addition | Finished quantity | pH/ specific gravity |
|---|---|---|---|---|
| | Brightening agent | 1.00 g | | |
| B | Water | 9.00 g | 22.6 g | 7.00/1.140 |
| | $ZnSO_4 7H_2O$ | 0.10 g | (20 ml) | |
| | 40% ammonium sulfite | 6.00 g | | |
| | Aqueous ammonia | 3.00 g | | |
| | EDTA-4H | 1.50 g | | |
| | 40% solution of 1-hydroxyethylidene-1,1-diphosphonic acid | 3.00 g | | |
| Total weight | | | 53.1 g | |

Tables 4, 5 and 6 show the kit elements of processing agents of the present invention.

TABLE 4

(1) Color developer replenisher (for color printing paper)
Per unit of solid processing agent

| Part | Ingredients | Amount of addition | Solid weight/ diameter | Number of units required (for comparison with conventional products) |
|---|---|---|---|---|
| A | Brightening agent (diaminostilbene) | 0.244 g | 3.20 g/ 15 mm | 12.35 $m^2$ to be processed |
| | Sodium sulfite | 0.030 g | | 12.3 |
| | KBr | 0.0024 g | | |
| A | Diethylenetriaminepenta acetic acid | 0.203 g | | |
| | Sodium p-toluenesulfonate | 2.439 g | | |
| | KOH | 0.163 g | | |
| | PEG-6000 | 0.119 g | | |
| B | Disodium N,N-bis(sulfonatoethyl) hydroxylamine | 0.974 | 1.00 g/ 15 mm | 12.3 |
| | PEG-6000 | 0.026 g | | |
| C | CD-3 | 0.974 g | 1.00 g/ 15 mm | 12.3 |
| | PEG-6000 | 0.026 g | | |
| D | $K_2CO_3$ | 2.845 g | 3.00 g/ 15 mm | 12.3 |
| | PEG-6000 | 0,154 g | | |
| Total weight | | | | 100.86 |

TABLE 5

(2) Bleach-fixer replenisher (for color printing paper)

| Part | Ingredients | Amount of addition | Solid weight/diameter per unit of solid processing agent | |
|---|---|---|---|---|
| A | EDTA-Fe salt | 3.38 g | | 18.5 $m^2$ to be treated |
| | Ethylenediaminetetraacetic acid | 0.12 g | 4.29 g/20 mm | 24.8 |
| | Maleic acid | 0.67 g | | |
| | Laurylsarcosine sodium | 0.12 g | | |
| B | Ammonium thiosulfate | 2.22 g | 3.45 g/20 mm | 49.6 |
| | Sodium sulfite | 1.01 g | | |
| | Potassium bromide | 0.05 g | | |
| | p-toluenesulfinic acid | 0.07 g | | |
| | Laurylsarcosine sodium | 0.10 g | | |
| Total weight | | | | 277.5 g |

In the table above, the EDTA-Fe salt is ammonium ferric ethylenediaminetetraacetate.

TABLE 6

(3) Superstabilizer (for color printing paper)

| Part | Ingredients | Amount of addition | Solid weight/diameter per unit of solid processing agent | Number of units required (for comparison with conventional products) |
|---|---|---|---|---|
| A | $Na_2CO_3H_2O$ | 0.025 g | | 4 $m^2$ to be processed |
| | 1-hydroxy-ethylidene-1,1-diphosphonic acid | 0.50 | 3.13 g/20 mm | 4 |
| | Brightening agent | 0.375 g | | |
| | Sodium sulfite | 0.75 g | | |

TABLE 6-continued

| (3) Superstabilizer (for color printing paper) | | | | |
|---|---|---|---|---|
| Part | Ingredients | Amount of addition | Solid weight/diameter per unit of solid processing agent | Number of units required (for comparison with conventional products) |
| | $ZnSO_4 7H_2O$ | 0.50 g | | |
| | EDTA-2Na2$H_2O$ | 0.375 g | | |
| | $(NH_4)_2SO_4$ | 0.50 g | | |
| | Antifungal agent orthophenylphenol | 0.025 g | | |
| | PEG-6000 | 0.087 g | | |
| Total weight | | | | 12.52 g |

Processing agents according to the present invention are described with reference to Tables 7 and 8.

TABLE 7

| | Process | | Form | Amount of addition: Tank solution | Amount of addition: Replenisher | pH of the replenishing agent kit | Density of the dissolved material in a kit (%) | Transport safety | Transport |
|---|---|---|---|---|---|---|---|---|---|
| Inventive | Color development | Mini-lab type/ large-lab type | Solid A | 15 | | 1 piece of 3.2 g solid processing agent per $m^2$ added | | ○ | ○ |
| | | | Solid B | 8 | | 1 piece of 1.0 g solid processing agent per $m^2$ added | | ○ | ○ |
| | | | Solid C | 55 | | 1 piece of 1.0 g solid processing agent per $m^2$ added | | ○ | ○ |
| | | | Solid D | 30 | | 1 piece of 3.0 g solid processing agent per $m^2$ added | | ○ | ○ |
| | Bleach-fixation | Mini-lab type/ large-lab type | Solid A | 90 | | 1 piece of 4.2 g solid processing agent per 0.5 $m^2$ added | | ○ | ○ |
| | | | Solid B | 60 | | 2 pieces of 3.45 g solid processing agent per 0.5 $m^2$ added | | ○ | ○ |
| | Super-stabilizer | Mini-lab type/ Large-lab type | Solid A | 1.0<br>3.0 | | 1 piece of 3.13 g solid processing agent per $m^2$ added | | ○ | ○ |

TABLE 8

| | Process | | Form | Main component | Amount of addition: Tank solution | Amount of addition: Replenisher |
|---|---|---|---|---|---|---|
| Conventional | Color development | mini-lab type | Solution A | Anti-oxidation agent Diethylhydroxylamine | 3.85 | 5.5 |
| | | | Solution B | Color developing agent SD-3 | 5.60 | 8.0 |
| | | | Solution C | Alkaline agent $K_2CO_3$ | 30.0 | 30.0 |
| | | Mini-lab quick type | Solution A | Anti-oxidation agent Diethylhydroxylamine | 3.25 | 5.5 |
| | | | Solution B | Color developing agent SD-3 | 5.50 | 9.3 |
| | | | Solution C | Alkaline agent $K_2CO_3$ | 30.0 | 30.0 |
| | | Large-lab low replenishing rate type | Solution A | Anti-oxidation agent Diethylhydroxylamine | 3.64 | 5.6 |
| | | | Powder B | Color developing agent SD-3 | 5.50 | 9.3 |
| | | | Powder C | Alkaline agent $K_2CO_3$ | 33.0 | 33.0 |
| | Bleach-fixation | Mini-lab type | Solution A | Fixer Thiosulfate | 67 | 72 |
| | | | Solution B | Oxidant EDTA-Fe salt | 48 | 52 |
| | | | Solution C | pH regulator Acetic acid | 12 | 13 |
| | | Mini-lab quick type | Solution A | Fixer Thiosulfate | 75 | 164 |
| | | | Solution B | Oxidant EDTA-Fe salt | 60 | 125 |
| | | | Solution C | pH regulator Acetic acid | 15 | 27 |
| | | Large-lab low replenishing rate type | Solution A | Fixer Thiosulfate | 90 | 170 |
| | | | Powder B | Oxidant EDTA-Fe salt | 66 | 125 |
| | | | Powder C | pH regulator Acetic acid | 10 | 20 |
| | Super-stabilizer | Mini-lab type/Large-lab type | Solution A | Fluorescent brightening agent Chinopal SPF | 1.0 | 1.0 |
| | | | Solution B | Chelating agent D-2010 | 3.0 | 3.0 |
| | | | Powder A | Fluorescent brightening agent Chinopal SFP | 1.0 | 1.0 |

TABLE 8-continued

| | Process | | Form | Replenishing agent kit pH | Replenishing agent kit concentration (%) | Corrosivity | Transport safety |
|---|---|---|---|---|---|---|---|
| Conventional | Color ment | mini-lab type | Solution A | 11.10 | 104.5 | Good | Good |
| | | | Solution B | 1.23 | 107 | Bad | Bad |
| | | | Solution C | more than 14 | 142 | Bad | Bad |
| | | Mini-lab | Solution A | 11.00 | 106.8 | Good | Good |
| | | | Solution B | 1.05 | 117 | Bad | Bad |
| | | | Solution C | more than 14 | 143 | Bad | Bad |
| | | Large-lab low rate type | Solution A | 13.18 | 112 | Bad | Bad |
| | | | Powder B | — | — | Good | Good |
| | | | Powder C | — | — | Good | Good |
| | Bleach-fixation | Mini-lab type | Solution A | 6.65 | 121.6 | Good | Good |
| | | | Solution B | 6.64 | 112.8 | Bad | Bad |
| | | | Solution C | 1.29 | 105.4 | Bad | Bad |
| | | Mini-lab quick type | Solution A | 5.70 | 124 | Good | Good |
| | | | Solution B | 6.80 | 115 | Bad | Bad |
| | | | Solution C | 2.02 | 105 | Bad | Bad |
| | | Large-lab low replenishing rate type | Solution A | 5.97 | 126.2 | Good | Good |
| | | | Powder B | — | — | Good | Good |
| | | | Powder C | — | — | Good | Good |
| | Super- | Mini-lab lab type | Solution A | 12.15 | 101.7 | Good | Good |
| | | | Solution B | 7.28 | 112.7 | Good | Good |
| | | | Powder A | — | — | Good | Good |

Processing agents for color printing paper are described. To prepare a conventional processing agent, concentrated components are used in liquid parts for the purpose of simplifying dissolution operation at minilabs. In this case, long stable materials are used in combination to form several parts.

These kits are subject to limitation by the solubility of the chemicals, even if they are concentrated, so that water must be added in addition to the essential chemical components.

Adding unnecessary water results in increased transport cost.

In contrast, the processing agent of the present invention is solidified, requiring no water, and can comprise the essential chemicals only. Therefore, as seen in the comparison of Tables 1 through 3 and Tables 4 through 6, the weight of replenishing agent relative to the same processing amount of light-sensitive material can be reduced to 46% for color developer replenishing agents and to 23% for bleach-fixer replenishing agent, and to 23% for superstabilizer.

Table 7 gives features of the processing agent of the present invention. It is a common practice to form a part configuration as shown in Table 7 with a mini-lab processing agent, a mini-lab quick processing agent and a large-lab processing agent.

In conventional processing agents, particularly mini-lab quick processing agents and large-lab type processing agents, which are added as replenishing solutions according to the amount of processing of light-sensitive material, the concentration difference between the tank solution and the replenishing solution has widened steadily with the trend toward lower replenishing rates.

There is limitation in increasing the concentration of a replenisher. Upper limits are about 1.7 times the tank solution concentration for color developers, and about 2.2 times the tank solution concentration for bleach-fixers (the same applies to solutions capable of bleaching for negative film processing), posed by solubility limits.

If the concentration exceeds the above level, the replenisher will undergo undesirable phenomena, such as color developing agent crystal separation in the color developer replenisher or ferric ethylenediaminetetraacetate crystal separation in the bleach-fixer, during storage. These are susceptible to temperature; troubles occur particularly in winter when ambient temperature is under 10° C.

Also, since the kit parts are configured in view of liquid kit storage stability, pH is extremely low or high in some cases, necessitating care in handling the kit solutions by the operator.

Kit solution spillage, cloth contact and skin contact can cause serious accidents. Specifically, spillage of a low or high pH kit solution can cause rust in metal portions; cloth contact damages the contacted area; skin contact causes skin poisoning or eczema.

Also, processing agent transportation is subject to legal regulation.

Specifically, in accordance with the rules specified by the United Nations Codes, the Ship Safety and Hygiene Law and the Civil Aeronautics Law should be observed. For some types of parts in aircraft transport, the IATA Rules should also be observed. The items marked with "X" for corrosivity and transport safety in the table above must not be transported, unless they are packaged in containers meeting the requirements of a container test etc.

Also, as a solid, the processing agent of the present invention requires no dissolution for a replenisher, and can be supplied to the tank solution according to the amount of processing of light-sensitive material; therefore, it is free of component crystal separation and other troubles, since it can take an advantageous configuration free of solubility limitation solely by increasing the ratio of consumed components even at low replenishing rates.

Because of the non-liquid kit form, weight reduction is possible and transport cost reduction is also possible. Moreover, consideration of corrosivity and transport safety is unnecessary.

Example 3

Next, processing tablets for color printing paper were prepared in accordance with procedures A through G as follows:

1) Color Developer Replenisher Tablets for Color Printing Paper

Procedure (A)

1200 g of the developing agent CD-3 [4-amino-3-methyl-N-ethyl-N-[β-(methanesulfonamido)ethyl]aniline sulfate] was milled in a commercially available bandamu mill to a final average grain size of 10 μm. The fine powder thus obtained was granulated in a commercially available mixer granulator at room temperature for about 7 minutes while adding 50 ml of water. The granulation product was then dried in a fluidized bed dryer at 40° C. for 2 hours to remove almost all the water therefrom. To the granulation product, 150 g of polyethylene glycol 6000 was added, followed by uniform mixing for 10 minutes in a room kept at 25° C. and under 40% RH using a mixer. Next, 4 g of N-lauloylalanine sodium was added, followed by mixing for 3 minutes. The resulting mixture was subjected to compressive tabulating using a tabulating machine, a modification of Tough Press Correct 1527HU, produced by Kikusui Seisakusho, at a packing rate of 3.2 g per tablet, to yield 400 tablets of color developer replenisher tablet agent A for color printing paper.

Procedure (B)

120 g of disodium disulfoethylhydroxylamine was milled, mixed and granulated in the same manner as procedure (A). The amount of water added was 6.0 ml. The granulation product was then dried at 50° C. for 30 minutes to remove almost all the water therefrom. To the granulation product, 4 g of N-lauloylalanine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 1.0 g per tablet, to yield 100 tablets of color developer replenisher tablet agent B for color printing paper.

Procedure (C)

30.0 g of Tinopal SFP (produced by Ciba-Geigy), 3.7 g of sodium sulfite, 0.3 g of potassium bromide, 25 g of diethylenetriaminepentaacetic acid, 280 g of sodium p-toluenesulfonate, 20 g of potassium hydroxide and 10.6 g of mannitol were milled in the same manner as procedure (A) and then uniformly mixed in a commercially available mixer, after which the mixture was granulated in the same manner as procedure (A). The amount of water added was 20 ml. Granulation was followed by drying at 60° C. for 30 minutes to remove almost all the water from the granulation product. To the granulation product, 4 g of N-lauloylalanine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 1.0 g per tablet, to yield 100 tablets of color developer replenisher tablet agent C for color printing paper.

Procedure (D)

350 g of potassium carbonate was milled and granulated in the same manner as procedure (A). After granulation while adding 20 ml of water, the granulation product was dried at 700° C. for 30 minutes to remove almost all the water therefrom. To the granulation product, 15 g of polyethylene glycol 6000 was added and mixed uniformly therein for 10 minutes in a room kept at 25° C. and under 40% RH using a mixer. Next, 4 g of N-lauloylalanine sodium was added, followed by mixing for 3 minutes. The resulting mixture was subjected to compressive tabulating using a tabulating machine, a modification of Tough Press Correct 1527HU, produced by Kikusui Seisakusho, at a packing rate of 3.0 g per tablet, to yield 110 tablets of color developer replenisher tablet agent D for color printing paper.

2) Bleach-Fixer Replenisher Tablets for Color Printing Paper

Procedure (E)

1250 g of ammonium ferric diethylenediaminepentaacetate monohydrate, 25 g of ethylenediaminetetraacetic acid, 250 g of maleic acid and 46 g of Pineflow (Matsutani Chemical Industry Co., Ltd.) were milled, mixed and granulated in the same manner as procedure (C). After granulation while adding 80 ml of water, the granulation product was dried at 60° C. for 2 hours to remove almost all the water therefrom. To the granulation product, 15 g of N-lauloylsalcosine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 8.6 g per tablet, to yield 170 tablets of bleach-fixer replenisher tablet agent A for color printing paper.

Procedure (F)

1640 g of ammonium thiosulfate, 750 g of sodium sulfite, 40 g of potassium bromide and 50 g of p-toluenesulfinic acid were milled, mixed and granulated in the same manner as procedure (C). After granulation while spraying 100 ml of water, the granulation product was dried at 60° C. for 120 minutes to remove almost all the water therefrom. To the granulation product, 20 g of N-lauloylsalcosine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 13.4 g per tablet, to yield 180 tablets of bleach-fixer replenisher tablet agent B for color printing paper.

3) Stabilizer Replenisher Tablets for Color Printing Paper

Procedure (G)

10 g of sodium carbonate monohydrate, 200 g of disodium 1-hydroxyethane-1,1-diphosphonate, 150 g of Tinopal SFP, 300 g of sodium sulfite, 20 g of zinc sulfate heptahydrate, 150 g of disodium ethylenediaminetetraacetate, 200 g of ammonium sulfate, 10 g of o-phenylphenol and 25 g of Pineflow were milled, mixed and granulated in the same manner as procedure (C). After granulation while adding 60 ml of water, the granulation product was dried at 70° C. for 60 minutes to remove almost all the water therefrom. To the granulation product, 10 g of N-lauloylsalcosine sodium was added, followed by uniform mixing for 3 minutes in a room kept at 25° C. and under 40% RH using a mixer.

The resulting mixture was subjected to compressive tabulating using a tabulating machine, a modification of Tough Press Correct 1527HU, produced by Kikusui Seisakusho, at a packing rate of 3.1 g per tablet, to yield 360 tablets of stabilizer replenisher tablet agent for color printing paper.

Next, with respect to the above tablet agents, a total of four tablets, i.e., one tablet of each of agents A, B, C and D, were packaged for 1 unit; successive 20 units were packaged in a four-side sealed package of peel open packaging material. For the bleach-fixer replenishing tablet agents, one tablet of agent A and two tablets of agent B were packaged for 1 unit; successive 20 units were packaged in the same manner as for the above color developer replenishing tablets.

For the stabilizer replenishing tablet agents, each tablet was packaged for 1 unit in the same manner as above.

The peel open package material used was the sealant film Tocello CMPSO11C laminated with a non-stretched polypropylene/stretched polypropylene film with the non-stretched polypropylene film surface in contact with the sealant film.

The peel open film and non-stretched polypropylene/stretched polypropylene film were heat sealed to package the above tablets.

Figure 17:
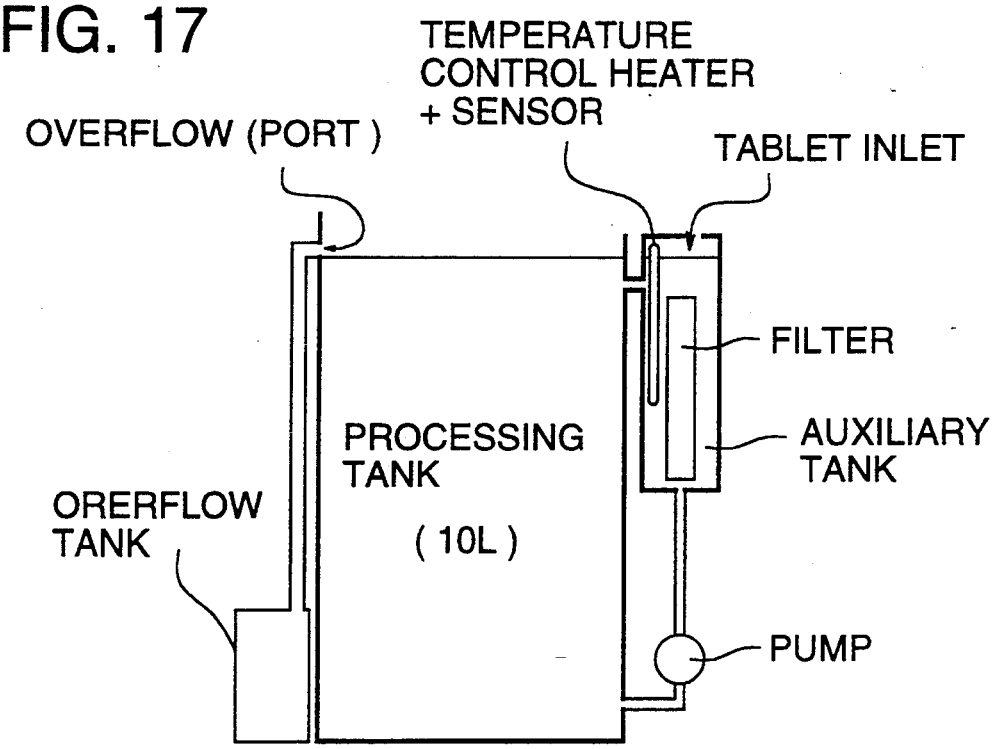
FIG. 17 is a construction diagram of a dissolution testing unit.

After imagewise exposure, the Konica QA paper type A5 (produced by Konica Corporation) was continuously processed using the Konica Big Mini-lab BM-101 (produced by Konica Corporation), modified to allow the use of the peel open method illustrated in FIG. 17 and to allow the processes shown in Table 9.

TABLE 9

| Process | Processing time | Processing temperature |
|---|---|---|
| Color development | 27 seconds | 37.5° C. |
| Bleach-fixation | 27 seconds | 37.5° C. |
| Stabilization 1 | 27 seconds | 35° C. |
| Stabilization 2 | 27 seconds | 35° C. |
| Stabilization 3 | 27 seconds | 35° C. |
| Drying | 50 seconds | |

Stabilization was achieved by the counterflow method from 3 to 1. The entire overflow from stabilization 1 was allowed to enter the bleach-fixing bath. Carry-over per $m^2$ of light-sensitive material was 50 ml/$m^2$ in all baths.

The water loss due to evaporation was compensated at 9.0 ml/hr, 7.2 ml/hr and 14.1 ml/hr for color development, bleach-fixation and stabilization, respectively, while warming the solution. The non-warming hours were summed and multiplied by 3.8 ml/hr, 3.1 ml/hr and 6.1 ml/hr, and the respective cumulative amounts were added at a time upon initiation of warming.

Starting tank solutions were prepared using the Konica Color QA paper color developing starter 82P-1B, the Konica Color QA paper bleach-fixing starter 82P-2B and the Konica Color QA paper stabilizing starter 82P-3B, all produced by Konica Corporation.

For comparison, the tablets and a corresponding amount of replenishing water were placed in the replenishing tank to yield 10 liter of a replenisher.

In this case, the replenisher was used to compensate the water loss due to evaporation in the comparative processing.

The solution overflow from the color developing tank, the bleach-fixing tank and the stabilizing tank was distilled using the distilling device for processing solutions as shown in FIG. 1 (the distilling temperature was 40° C. and the distilling pressure was 55 mm Hg). The resulting distilled solution was reused as replenishing water when the tablets of the present invention was used. In addition, when a shortage of distilled water exists, tap water can be used to augment it.

Processing rate was 5 $m^2$ of color printing paper daily, continued until the overflow reached 2 times the tank solution volume, whereafter the days until sulfation in the bleach-fixing tank were counted, and a sample subjected to exposure through an optical wedge was developed and the maximum reflective blue color density was determined.

In addition, the occurrence of mildew and bacteria were evaluated. Furthermore, the degree of image deterioration of processed color paper after being stored for 7 days under conditions of 30° C. and 80% RH was also evaluated.

The color developing agent content in the color developer was changed to 1.2 times for a replenishing rate of 50 ml/$m^2$, to 1.45 times for 25 ml/$m^2$ and to 0.9 times for 150 ml/$m^2$, to compensate the consumption.

In preparing the bleach-fixer, the maleic acid content was increased to compensate the pH rise due to entry of the color developer when the replenishing rate was low. Table 10 compares these methods.

TABLE 10

| | Color development | | | Bleach-fixation | | |
|---|---|---|---|---|---|---|
| | Replenishing rate (ml/$m^2$) | Timing of addition of 1 package ($m^2$/package) | Amount of replenishing water per package (ml) | Replenishing rate (ml/$m^2$) | Timing of addition of 1 package ($m^2$/package) | Amount of replenishing water per package (ml) |
| 1) Peel open method | Equivalent to 25 ml | 1 | 19.6 | Equivalent to 15 ml | 0.80 $m^2$ | 1.68 ml |
| 2) Peel open method | Equivalent to 50 ml | 1 | 44.6 | Equivalent to 20 mil | 0.75 $m^2$ | 4.18 ml |
| 3) Peel open method | Equivalent to 100 ml | 1 | 94.6 | Equivalent to 50 ml | 0.52 $m^2$ | 21.2 ml |
| 4) Replenishing solution method | 25 ml | — | — | 15 ml | — | — |
| 5) Replenishing solution method | 50 ml | — | — | 20 ml | — | — |
| 6) Replenishing solution method | 100 ml | — | — | 50 ml | — | — |
| 7) Replenishing solution method | Equivalent to 25 ml | 1 | 19.6 | Equivalent to 15 ml | 0.80 $m^2$ | 1.68 ml |
| 8) Replenishing solution method | Equivalent to 50 ml | 1 | 44.6 | Equivalent to 20 ml | 0.75 $m^2$ | 4.18 ml |
| 9) Replenishing | Equivalent | 1 | 94.6 | Equivalent | 0.52 $m^2$ | 21.2 ml |

TABLE 10-continued

| solution method⁻ to 100 ml | | to 50 ml | | |
|---|---|---|---|---|
| | Stabilization | | | |
| | Replenishing rate (ml/m²) | Timing of addition of 1 package (m²/package) | Amount of replenishing water per package (ml) | Replenishing water or dissolved water |
| 1) Peel open method | Equivalent to 50 ml | 1 | 47.2 | Tap water |
| 2) Peel open method | Equivalent to 100 ml | 1 | 97.6 | Tap water |
| 3) Peel open method | Equivalent to 200 ml | 1 | 196.9 | Tap water |
| 4) Replenishing solution method | 50 ml | — | — | Tap water |
| 5) Replenishing solution method | 100 ml | — | — | Tap water |
| 6) Replenishing solution method | 200 ml | — | — | Tap water |
| 7) Replenishing solution method | Equivalent to 50 ml | 1 | 47.2 | Distilled water |
| 8) Replenishing solution method | Equivalent to 100 ml | 1 | 97.6 | Distilled water |
| 9) Replenishing solution method | Equivalent to 200 ml | 1 | 196.9 | Distilled water |

For replenishing water for color developer, tap water was used in all cases.

Continuous processing was carried out at various replenishing rates and exchange rates to compare the inventive solid processing agent adding method and the conventional replenisher preparation method. The degree of bleach-fixer concentration was also determined. The concentration rate was calculated from the iron ion concentration in the tank solution determined by atomic absorption spectrometry.

The solid processing agent was dissolved in the color developing agent to prepare a replenisher and observed for the dissolution state.

tive deterioration of the replenisher as well, hampering the obtaining of sufficient photographic density.

In contrast, the direct addition method of the present invention undergoes neither dissolution failure nor deterioration because no replenisher is prepared.

Another finding was that the bleach-fixer is low in storage stability due to the low pH of the replenisher to be added at low replenishing rates so that it undergoes sulfation in several weeks. On the other hand, the present method undergoes no bleach-fixer sulfation because it is unnecessary to prepare a replenisher.

TABLE 11

| | Bleach-fixer Sulfation | Replenisher solubility | Color Developing Agent: Maximum blue color density Dmax (B) | Occurrence of bacteria in the replenishing water tank or the dissolution tank | Image stability | Remarks |
|---|---|---|---|---|---|---|
| 1 | No sulfation | — | 2.28 | Occurred | X | Inventive |
| 2 | No sulfation | — | 2.28 | Occurred | X | Inventive |
| 3 | No sulfation | — | 2.29 | Occurred | X | Inventive |
| 4 | Sulfation occurred in 2 weeks | Poor dissolution | 1.75 | Occurred | X | Comparative |
| 5 | Sulfation occurred in 3 weeks | Poor dissolution | 1.81 | Occurred | X | Comparative |
| 6 | Sulfation occurred in 7 weeks | No problem | 2.16 | Occurred | X | Comparative |
| 7 | No sulfation | — | 2.28 | Not occurred | ○ | Inventive |
| 8 | No sulfation | — | 2.28 | Not occurred | ○ | Inventive |
| 9 | No sulfation | — | 2.29 | Not occurred | ○ | Inventive |

With regard to image preservability, deterioration of images was observed visually. The above-mentioned symbols means as follows:

O: Little fading was observed.

Δ: Fading was observed visually. However, it is fading slightly.

X: considerable fading was observed throughout the image.

From Table 11 above, it is seen that in the conventional replenisher preparation method, replenishing rate reduction necessitates increasing the replenisher solution concentration, resulting in the residence of insoluble matter after preparation of the replenisher. Another drawback is that low replenishing rates lead to oxida- In addition, the conventional replenisher preparation method results in a significantly concentrated bleach-fixer at low replenishing rates. Particularly, the concentration rate increases when the replenisher is used to compensate the water loss due to evaporation when the replenishing rate is lower than the evaporation rate.

Figure 19:
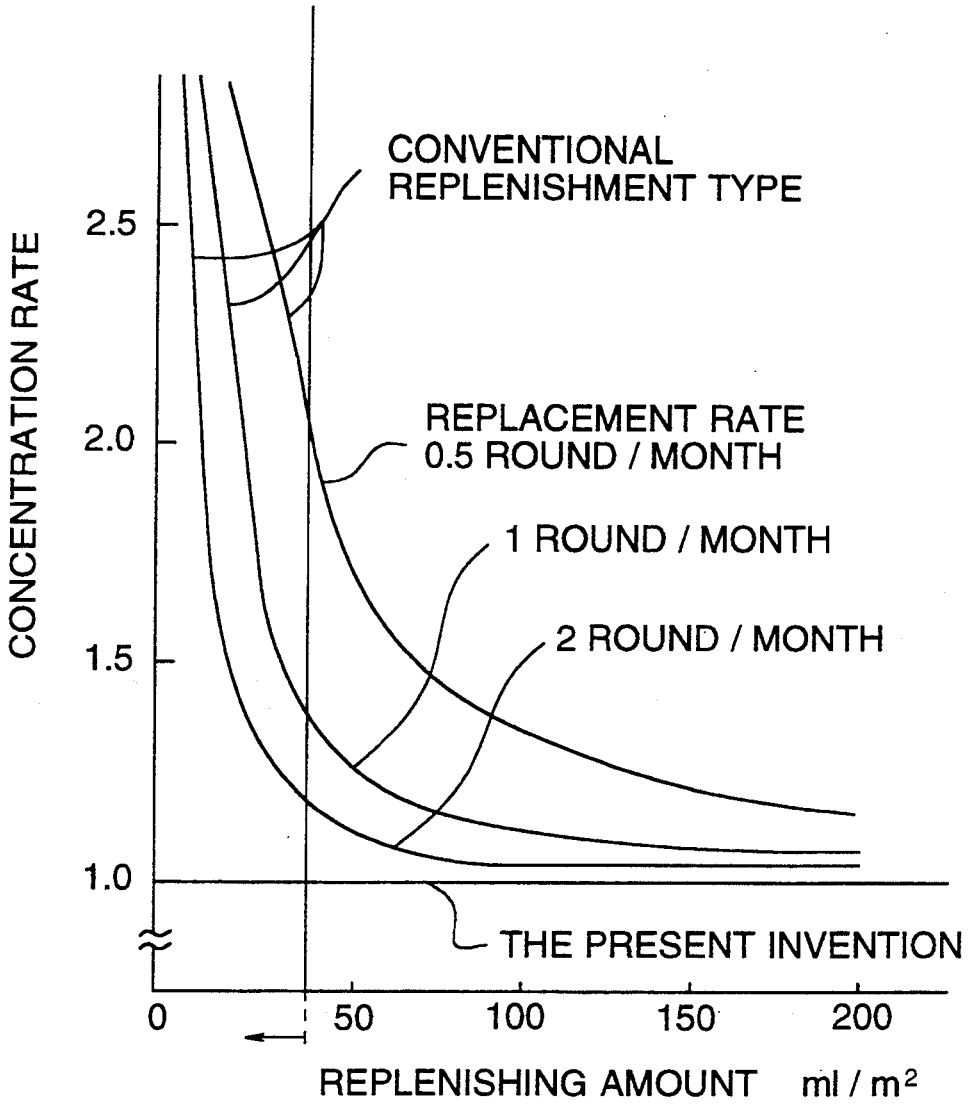
FIG. 19 is a characteristic curve of the relationship between replenishing rate and concentration rate.

In contrast, the present invention undergoes no such concentration, since compensation for the water loss due to evaporation is removely achieved. FIG. 19 shows characteristic curves of replenishing rates versus concentration rate to compare the prior art and the present invention.

In addition, it can be understood that, when distilled water produced by an effluent-processing device, which is a structural requirements of the present invention, as replenishing water, mildew and bacteria never occur after being stored and also that image stability is desirable so that the distilled water can be favorably used as replenishing water.

Example 4

After imagewise exposure, the Konica QA paper type A5 (produced by Konica Corporation) was continuously processed using the NPS-808 (produced by Konica Corporation), modified to have the configuration illustrated in FIG. 1. The replenishing water in the replenishing tank was deionized water.

| Process | Processing time | Processing temperature | Tank capacity |
|---|---|---|---|
| Color development | 22 seconds | 38.0° C. | 12 l |
| Bleach-fixation | 22 seconds | 37.5° C. | 12 l |
| Stabilization 1 | 22 seconds | 35° C. | 12 l |
| Stabilization 2 | 22 seconds | 35° C. | 12 l |
| Stabilization 3 | 22 seconds | 35° C. | 12 l |
| Drying | 50 seconds | 55° C. | |

Stabilization was achieved by the counterflow method from 3 to 1. The entire overflow from stabilization 1 was allowed to enter the bleach-fixing bath. Carry-over per $m^2$ of light-sensitive material was 45 ml from the color developing tank to the bleach-fixing tank, 50 ml from the bleach-fixing tank to the stabilizing tank and 40 ml from stabilization 1 to 2, from stabilization 2 to 3 and from stabilization 3 to drying.

The opening area of each of the color developing, bleach-fixing and stabilizing tanks was 4.5 $cm^2$ per liter of processing solution.

The ambient conditions for the automatic processing machine were 27° C. temperature and 60% RH, and replenishing water was supplied upon the water loss due to evaporation reached 100 ml.

The amount of replenishing water was calculated using the equation (1) shown in Japanese Patent O.P.I. Publication No. 280042/1991. The light-sensitive material was processed constantly at 2.0 $m^2$ per day for 2 months.

The compositions of the processing solutions used are as follows:

| Color developer | |
|---|---|
| Potassium bromide | 0.02 g |
| Potassium chloride | 3.2 g |
| Potassium carbonate | 30 g |
| Potassium sulfite | 0.2 g |
| Sodium diethylenetriaminepentaacetate | 2 g |
| Sodium nitrilotrimethylenephosphonate | 2 g |
| Tinopal SFP | 2 g |
| Disodium N,N-bis(sulfonatoethyl)hydroxylamine | 5 g |
| 4-amino-3-methyl-N-ethyl-N-(β-methanesulfonamidoethyl)aniline sulfate CD-3 | 7 g |

Water was added to make a total quantity of 1 l, and pH was adjusted to 10.10.

| Bleach-fixer | |
|---|---|
| Ammonium ferric diethylenetriaminepentaacetate | 100 g |
| Diethylenetriaminepentaacetic acid | 2 g |
| Ammonium thiosulfate | 120 g |

-continued

| Bleach-fixer | |
|---|---|
| Ammonium sulfite | 40 g |
| Sulfinic acid | 5 g |
| Ammonium bromide | 10 g |

Water was added to make a total quantity of 1 l, and pH was adjusted to 7.0.

| Stabilizer | |
|---|---|
| Water | 800 g |
| 1,2-benzisothiazolin-3-one | 0.1 g |
| 1-hydroxyethylidene-1,1-diphosphonic acid | 5.0 g |
| Ethylenediaminetetraacetic acid | 1.0 g |
| Tinopal SFP (produced by Ciba-Geigy) | 2.0 g |
| Ammonium sulfate | 2.5 g |
| Zinc chloride | 1.0 g |
| Magnesium chloride | 0.5 g |
| o-phenylphenol | 1.0 g |
| Sodium sulfite | 2.0 g |

Water was added to make a total quantity of 1 l, and 50% sulfuric acid or 25% aqueous ammonia was added to obtain a pH of 8.0.

The processing tablets used were identical with those prepared in Example 2.

Figure 18:
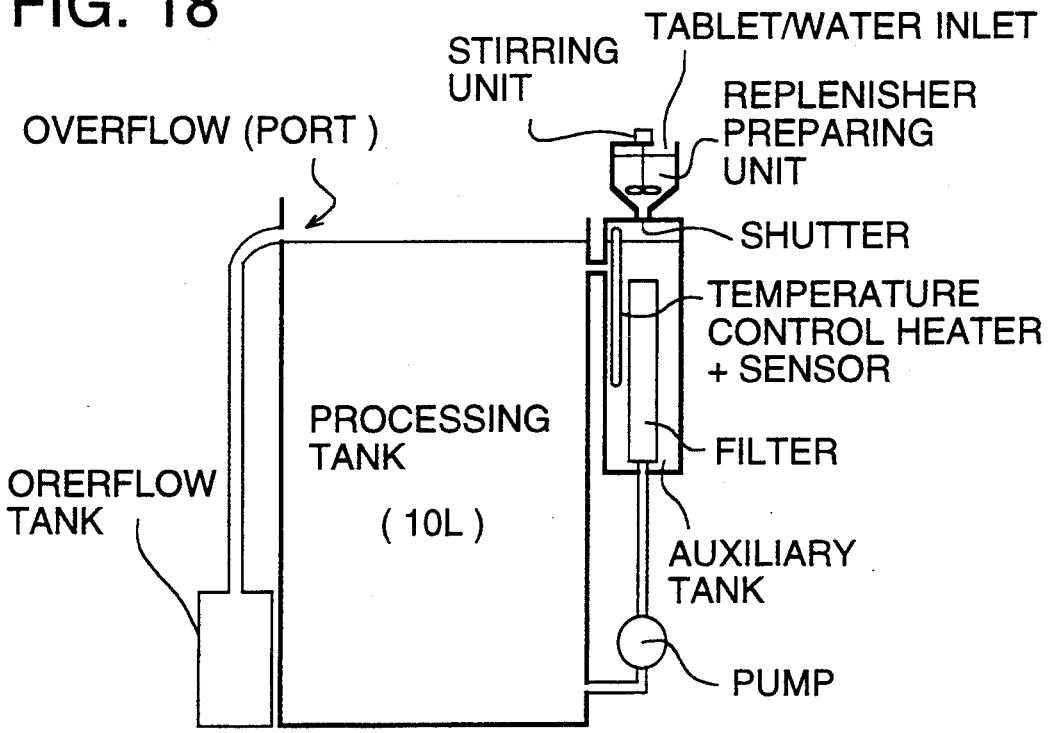
FIG. 18 is another construction diagram of a dissolution testing unit.

Next, each tablet was sealed in a laminated polymeric resin film of PET/polyvinyl alcohol-ethylene copolymer/polyethylene, and added using the supplying apparatus illustrated in FIG. 18. The setting was such that one tablet was added upon processing of 1 $m^2$ of color printing paper, and 76 ml of replenishing water for the color developing bath, 42 ml of replenishing water for the bleach-fixing bath and 247 ml of replenishing water for the stabilizing bath would be supplied from the replenishing water tank simultaneously.

For comparison, the same running test was conducted in which water was added to the color developing, bleach-fixing and stabilizing baths until the overflow outlet level was reached once every morning and every evening.

It was found that the sensitivity fluctuation was ±1% in the present invention, while it was ±4% in the case where replenishing water was added until the overflow outlet level was reached once every morning and evening. This finding demonstrates that the evaporated water compensating method of the present invention offers stable photographic performance.

Example 5

Processing tablets for color printing paper were prepared as follows:

1) Color Developer Replenisher Tablets for Color Printing Paper

Procedure (A)

1200 g of the developing agent CD-3 [4-amino-3-methyl-N-ethyl-N-[β-(methanesulfonamido)ethyl]aniline sulfate] was milled in a commercial bandamu mill to a final average grain size of 10 μm. The fine powder thus obtained was granulated in a commercially available mixer granulator at room temperature for about 7 minutes while adding 50 ml of water. The granulation product was then dried in a fluidized bed dryer at 40° C. for 2 hours to remove almost all the water therefrom. To the granulation product, 150 g of polyethylene glycol 6000 was added, followed by uniform mixing for 10 minutes in a room kept at 25° C. and under 40% RH using a mixer. Next, 4 g of N-lauloylalanine sodium was added, followed by mixing for 3 minutes. The resulting mixture was subjected to compressive tabulating using a tabulating machine, a modification of Tough Press Correct 1527HU, produced by Kikusui Seisakusho, at a packing rate of 3.2 g per tablet, to yield 400 tablets of color developer replenisher tablet agent A for color printing paper.

Procedure (B)

120 g of disodium disulfoethylhydroxylamine was milled and granulated in the same manner as procedure (A). After granulation while adding 6.0 ml of water, the granulation product was dried at 50° C. for 30 minutes to remove almost all the water therefrom. To the granulation product, 4 g of N-lauloylalanine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 1.0 g per tablet, to yield 100 tablets of color developer replenisher tablet agent B for color printing paper.

Procedure (C)

30.0 g of Tinopal SFP (produced by Ciba-Geigy), 3.7 g of sodium sulfite, 0.3 g of potassium bromide, 25 g of diethylenetriaminepentaacetic acid, 280 g of sodium p-toluenesulfonate, 20 g of potassium hydroxide and 10.6 g of mannitol were milled in the same manner as procedure (A) and then uniformly mixed in a commercially available mixer, after which the mixture was granulated in the same manner as procedure (A), while adding 20 ml of water. Granulation was followed by drying at 60° C. for 30 minutes to remove almost all the water from the granulation product. To the granulation product, 4 g of N-lauloylalanine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 1.0 g per tablet, to yield 100 tablets of color developer replenisher tablet agent C for color printing paper.

Procedure (D)

350 g of potassium carbonate was milled and granulated in the same manner as procedure (A). After granulation while adding 20 ml of water, the granulation product was dried at 700° C. for 30 minutes to remove almost all the water therefrom. To the granulation product, 15 g of polyethylene glycol 6000 was added, followed by uniform mixing for 10 minutes in a room kept at 25° C. and under 40% RH using a mixer. Next, 4 g of N-lauloylalanine sodium was added, followed by mixing for 3 minutes. The resulting mixture was subjected to compressive tabulating using a tabulating machine, a modification of Tough Press Correct 1527HU, produced by Kikusui Seisakusho, at a packing rate as shown in Table 1, to yield 110 tablets of color developer replenisher tablet agent D for color printing paper.

2) Bleach-Fixer Replenisher Tablets for Color Printing Paper

Procedure (E)

1250 g of ammonium ferric ethylenediaminetetraacetate monohydrate, 25 g of ethylenediaminetetraacetic acid, 250 g of maleic acid and 46 g of Pineflow (Matsutani Chemical Industry, Co. Ltd.) were milled, mixed and granulated in the same manner as procedure (C). After granulation while adding 80 ml of water, the granulation product was dried at 60° C. for 2 hours to remove almost all the water therefrom. To the granulation product, 15 g of N-lauloylsalcosine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 8.6 g per tablet, to yield 170 tablets of bleach-fixer replenisher tablet agent A for color printing paper.

Procedure (F)

1640 g of ammonium thiosulfate, 750 g of sodium sulfite, 40 g of potassium bromide and 50 g of p-toluenesulfinic acid were milled, mixed and granulated in the same manner as procedure (C). After granulation while spraying 100 ml of water, the granulation product was dried at 60° C. for 120 minutes to remove almost all the water therefrom. To the granulation product, 20 g of N-lauloylsalcosine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate as shown in Table 1, to yield bleach-fixer replenisher tablet agent B for color printing paper.

3) Stabilizer Replenisher Tablets for Color Printing Paper

Procedure (G)

10 g of sodium carbonate monohydrate, 200 g of disodium 1-hydroxyethane-1,1-diphosphonate, 150 g of Tinopal SFP, 300 g of sodium sulfite, 20 g of zinc sulfate heptahydrate, 150 g of disodium ethylenediaminetetraacetate, 200 g of ammonium sulfate, 10 g of o-phenylphenol and 25 g of Pineflow were milled, mixed and granulated in the same manner as procedure (C). After granulation while spraying 60 ml of water, the granulation product was dried at 70° C. for 60 minutes to remove almost all the water therefrom. To the granulation product, 10 g of N-lauloylsalcosine sodium was added, followed by uniform mixing for 3 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate as shown in Table 1, to yield a stabilizer replenisher tablet agent for color printing paper.

Each tablet of the above replenishing tablet agents for color printing paper was packaged in a four-side sealed package of laminated polymer resin film of PET/polyvinyl alcohol-ethylene copolymer/polyethylene in amounts as shown in Tables 7 and 8. Also, tabulating was carried out for each part of each replenishing agent, so that the total amount would correspond to the same composition ratio for a single tablet, as shown in Table 2, and four-side sealed packaging was carried out in the same manner as above. The number of units per cartridge was 20.

Next, after imagewise exposure, the Konica QA paper type 5 (produced by Konica Corporation) was continuously processed using the NPS-808 (produced by Konica Corporation), modified to have the configuration illustrated in FIG. 3. Incidentally, for replenishing water in the replenishing tank, distilled water prepared by the use of a effluent-distilling device (ACR-40: produced by Konica Corporation). For the replenishing water for color developing, tap water wherein 4 sodium salt ehylenediamine tetraacetate of 0.1 g/l was added.

| Process | Processing time | Processing temperature | Tank capacity |
|---|---|---|---|
| Color development | 22 seconds | 38.0° C. | 12 l |
| Bleach-fixation | 22 seconds | 37.5° C. | 12 l |
| Stabilization 1 | 22 seconds | 35° C. | 12 l |
| Stabilization 2 | 22 seconds | 35° C. | 12 l |
| Stabilization 3 | 22 seconds | 35° C. | 12 l |
| Drying | 50 seconds | 55° C. | |

Stabilization was achieved by the counterflow method from 3 to 1. The entire overflow from stabilization 1 was allowed to enter the bleach-fixing bath. Carry-over per $m^2$ of light-sensitive material was 45 ml from the color developing bath to the bleach-fixing bath, 50 ml from the bleach-fixing bath to the stabilizing bath and 40 ml from stabilization 1 to 2, from stabilization 2 to 3 and from stabilization 3 to drying.

The opening area of each of the color developing, bleach-fixing and stabilizing baths was 4.5 $cm^2$ per liter of processing solution.

The compositions of the processing solutions are as follows:

| Color developer | |
|---|---|
| Potassium bromide | 0.02 g |
| Potassium chloride | 3.2 g |
| Potassium carbonate | 30 g |
| Potassium sulfite | 0.2 g |
| Sodium diethylenetriaminepentaacetate | 2 g |
| Sodium nitrilotrimethylenephosphonate | 2 g |
| Tinopal SFP | 2 g |
| Disodium N,N-bis(sulfonatoethyl)hydroxylamine | 5 g |
| 4-amino-3-methyl-N-ethyl-N-[β-(methanesulfonamidoethyl] aniline sulfate CD-3 | 7 g |

Water was added to make a total quantity of 1 l, and pH was adjusted to 10.10.

| Bleach-fixer | |
|---|---|
| Ammonium ferric diethylenetriaminepentaacetate | 100 g |
| Diethylenetriaminepentaacetic acid | 2 g |
| Ammonium thiosulfate | 120 g |
| Ammonium sulfite | 40 g |
| Sulfinic acid | 5 g |
| Ammonium bromide | 10 g |

Water was added to make a total quantity of 1 l, and pH was adjusted to 7.0.

| Stabilizer | |
|---|---|
| Water | 800 g |
| 1,2-benzisothiazolin-3-one | 0.1 g |
| 1-hydroxyethylidene-1,1-diphosphonic acid | 5.0 g |
| Ethylenediaminetetraacetic acid | 1.0 g |
| Tinopal SFP (produced by Ciba-Geigy) | 2.0 g |
| Ammonium sulfate | 2.5 g |
| Zinc chloride | 1.0 g |
| Magnesium chloride | 0.5 g |
| o-phenylphenol | 1.0 g |
| Sodium sulfite | 2.0 g |

Water was added to make a total quantity of 1 l, and 50% sulfuric acid or 25% aqueous ammonia was added to obtain a pH of 8.0.

A running experiment was conducted in which 50 rolls of 24-EXP color film per hour were processed for 3 hours to obtain 3750 prints of size E. Tablet solubility, photographic performance, handling quality, etc. were evaluated.

Table 12 shows the amounts of tablets and the amounts of replenishing water.

TABLE 12

| Amount of tablets (g) | | 0.3 g | 0.5 g | 10 g | 30 g | 50 g |
|---|---|---|---|---|---|---|
| Replenishing water (ml) | CD | 3.1 | 5.2 | 103.2 | 309.6 | 516.0 |
| | BF | 15.1 | 2.5 | 50.4 | 151.2 | 252 |
| | STB | 28.9 | 48.1 | 916.5 | 2884.5 | 4807.5 |

Note:
CD denotes a color developer; BF, a bleach-fixer; STB, a stabilizer.

Timing of entry of tablets and replenishing water was such that 80 ml of replenishing water for 7.85 g of color developer replenisher tablets, 200 ml of replenishing water for 39.7 g of bleach-fixer replenisher tablets and 250 ml of replenishing water for 2.6 g of stabilizer replenisher tablets were supplied upon 1 $m^2$ of color printing paper was processed. Using these amounts as a basis, adding time (Table 12) was varied according to the amount of tablets, and 80 ml, 200 ml and 250 ml of replenishing water were supplied upon the above amounts of tablets were reached.

TABLE 13

| Amount (g) of each tablet | 0.3 g | 0.5 g | 10 g | 30 g | 50 g |
|---|---|---|---|---|---|
| CD | | | | | |
| Number of tablets added | 961 | 577 | 29 | 10 | 6 |
| Number of tablets added per min | 5.4 | 3.2 | 0.7 | 0.06 | 0.03 |
| BF | | | | | |
| Number of tablets added | 4864 | 2198 | 146 | 49 | 30 |
| Number of tablets added per min | 27 | 16.2 | 0.8 | 0.27 | 0.17 |
| STB | | | | | |
| Number of tablets added | 319 | 192 | 10 | 4 | 2 |
| Number of tablets added per min | 1.8 | 1.1 | 0.06 | 0.02 | 0.01 |
| Total cartridge exchange frequency per min | 1.7 | 1.0 | 0.05 | 0.02 | 0.01 |

From the viewpoint of tablet cartridge exchange operation, tablet adhesion to the packaging material, tablet solubility and processing stability, 0.5 to 30 g is particularly preferable when the entire replenisher is in a solid form and supplied removely from replenishing water.

Example 6

Tablets for fixing were prepared as follows:

500 g of ammonium thiosulfate, 150 g of sodium sulfite, 150 g of potassium carbonate and 20 g of disodium ethylenediaminetetraacetate were milled and granulated. The amount of water sprayed was 30 ml. Granulation was followed by drying at 60° C. for 60 minutes, and the granulation product was further dried in a vacuum at 40° C. for 8 hours to remove almost all the water therefrom.

The resulting granulation product was uniformly mixed for 10 minutes in a room kept at 25° C. and under 40% RH using a mixer. The resulting mixture was subjected to compressive tabulating using a tabulating machine, a modification of Tough Press Correct 1527HU, produced by Kikusui Seisakusho, at a packing rate of 9.0 g per tablet, to yield 200 tablets of a fixer replenisher tablet agent for color negative films.

10 liter of the following fixer was prepared.

| Fixer composition | per liter |
|---|---|
| Ammonium thiosulfate | 250 g |
| Sodium sulfite | 15 g |
| Potassium carbonate | 15 g |
| EDTA-2Na | 2 g |

This fixer was placed in the processing tank of dissolution test unit (A) illustrated in FIG. 7 below, and while circulating it using the magnet pump MD-5, produced by Iwaki, the above tablets were added to the auxiliary tank at 1 tablet per minute. 20 ml of tap water was simultaneously add to the processing tank.

Using a warming unit, the temperatures of the processing solutions in the processing tank and auxiliary tank were varied as shown in Table 14 below, and 100 tablets were continuously added. The tablet dissolution state in the auxiliary tank was observed.

For comparison, using dissolution test unit (B) illustrated in FIG. 18, the same tablets as above and 20 ml of solvent water were simultaneously added at 1 tablet per minute to the replenisher preparing unit, followed by stirring in a stirring unit for 30 seconds, after which the mixture was added to the auxiliary tank. The temperature of the solvent water (tap water) was 25° C.

TABLE 14

| | Timing of replenishing for one tablet agent package and for one replenishing of water | Amount of replenishing for each time |
|---|---|---|
| Color developing | Every 8 rolls of film (24 EX) | 161.4 |
| Bleaching | Every 8 rolls of film (24 EX) | 235.5 |
| Fixing | Every 8 rolls of film (24 EX) | 223.6 |
| Stabilizing | Every 8 rolls of film (24 EX) | 320 |

This experiment was conducted to test high speed dissolution on condition that the replenishing rate was equivalent to 60 rolls per hour of film processed by an automatic processing machine, wherein evaluations were made with a fixing agent, which ranks highest in the frequency of dissolution among the processing solutions.

From Table 14 above, it is seen that the dissolution method of the present invention, wherein the processing agent is added directly to the processing solution, makes it possible to dissolve the processing agent free of insoluble matter residence at processing tank temperatures of over 25° C. and allows control of dissolution speed by temperature.

Also, at 20° C., a small amount of insoluble matter remained, but it is of almost no concern for practical use.

In contrast, in the method using a replenisher preparing filter to dissolve the processing agent as illustrated in unit (B) illustrated in FIG. 18, the entire processing agent clogged the filter because it did not dissolve within the specified time, causing action failure.

Also, to test the case where tablets are added before completion of warming with the heater, addition was started 10 minutes before completion of warming, but dissolution had no problem when unit A was used.

Example 7

After imagewise exposure, the Konica Color Super DD-100 film was continuously processed using the color negative film processor CL-KP-50QA, modified to allow the use of peel open package material. Solution overflow from each processing tank was processed by the use of a effluent processing device ACR-40 (produced by Konica Corporation).

TABLE 15

| | Maximum density | | | | | |
|---|---|---|---|---|---|---|
| | When processing was started | | | After 2 months | | |
| | B | G | R | B | G | R |
| Peel open type (Invention) | 3.02 | 2.40 | 2.01 | 3.00 | 2.39 | 2.00 |
| Replenishing solution type (Comparative) | 3.01 | 2.69 | 2.01 | 2.87 | 2.30 | 1.86 |

Fixation and stabilization were achieved by the counterflow method from 2 to 1 for fixation and from 3 to 2 and from 2 to 1 for stabilization. The bleaching bath was aerated using an air pump.

The water loss due to evaporation was compensated by adding 10 ml, 6.5 ml, 7 ml, 7 ml, 8.6 ml, 8.6 ml and 9.3 ml of replenishing water, per hour, to the color developing tank, bleaching tank, fixing tank 1, fixing tank 2, stabilizing tank 1, stabilizing tank 2 and stabilizing tank 3, respectively while warming the solution. Non-warming hours were summed and multiplied by 7.5 ml, 5 ml, 6 ml, 6 ml, 5 ml, 5 ml and 5 ml of replenishing water, per hour, were added to the color developing tank, bleaching tank, fixing tank 1, fixing tank 2, stabilizing tank 1, stabilizing tank 2 and stabilizing tank 3, respectively, at a time upon initiation of warming. Starting tank solutions were prepared using a replenisher and a starter for the Konica color negative film processing agent CNK-4-52.

Processing tablets for color negative films were prepared as follows:

1) Color Developer Replenisher Tablets for Color Negative Films

Procedure (1)

150 g of the developing agent CD-4 [4-amino-3-methyl-N-ethyl-$\beta$-(hydroxy)ethylaniline sulfate] was milled in a commercially available bandamu mill to a final average grain size of 10 $\mu$m. The fine powder thus obtained was granulated in a commercially available mixer granulator at room temperature for about 7 minutes while adding 10 ml of water. The granulation product was then dried in a fluidized bed dryer at 40° C. for 2 hours to remove almost all the water therefrom. To the granulation product, 0.3 g of N-lauloylalanine sodium and 1.9 g of polyethylene glycol 6000 were added, followed by uniform mixing for 10 minutes in a room kept at 25° C. and under 40% RH using a mixer. Next, the resulting mixture was subjected to compressive tabulating using a tabulating machine, a modification of Tough Press Correct 1527HU, produced by Kikusui Seisakusho, at a packing rate of 1.1 g per tablet, to yield 126 tablets of color developer replenisher tablet agent A for color negative films.

Procedure (2)

69.4 g of hydroxylamine sulfate and 4 g of Pineflow (Matsutani Chemical Industry Co., Ltd.) were milled, mixed and granulated in the same manner as procedure (1). The amount of water added was 3.5 ml. The granulation product was dried at 60° C. for 30 minutes to remove almost all the water therefrom. To the granulation product, 0.3 g of N-lauloylalanine sodium was added, followed by uniform mixing for 3 minutes in a room kept at 25° C. and under 40% RH using a mixer. The resulting mixture was subjected to compressive tabulating using a tabulating machine at a packing rate of 0.56 g per tablet in the same manner as procedure (1), to yield 120 tablets of color developer replenisher tablet agent B for color negative films.

Procedure (3)

15 g of disodium 1-hydroxyethane-1,1-diphosphonate, 72.8 g of potassium sulfite, 375 g of potassium carbonate, 3 g of sodium hydrogen carbonate, 3.7 g of sodium bromide and 22 g of mannitol were milled and mixed in the same manner as procedure (1), after which they were granulated while adding 40 ml of water. The granulation product was then dried at 70° C. for 60 minutes to remove almost all the water therefrom. To the granulation product, 2 g of N-lauloylalanine sodium was added, followed by mixing for 3 minutes in a room kept at 25° C. and under 40% RH using a mixer. The resulting mixture was subjected to compressive tabulating using a tabulating machine at a packing rate of 3.9 g per tablet in the same manner as procedure (1), to yield 120 tablets of color developer replenisher tablet agent C for color negative films.

2) Bleacher Replenisher Tablets for Color Negative Films

Procedure (4)

175 g of ammonium ferric 1,3-propanediaminetetraacetate monohydrate, 2 g of 1,3-propanediaminetetraacetate and 17 g of Pineflow (Matsutani Chemical Industry Co., Ltd.) were milled, mixed and granulated in the same manner as procedure (1). The amount of water added was 8 ml. The granulation product was then dried at 60° C. for 30 minutes to remove almost all the water therefrom.

Procedure (5)

133 g of succinic acid, 200 g of ammonium bromide and 10.2 g of Pineflow were milled, mixed and granulated in the same manner as procedure (1). The amount of water added was 17 ml. The granulation product was then dried at 70° C. for 60 minutes to remove almost all the water therefrom.

Procedure (6)

66.7 g of potassium sulfate, 60 g of potassium hydrogen carbonate and 8 g of mannitol were milled, mixed and granulated in the same manner as procedure (1). The amount of water added was 13 ml. The granulation product was then dried at 60° C. for 60 minutes to remove almost all the water therefrom.

Procedure (7)

The granulation products obtained in the above procedures (4) through (6) were uniformly mixed in a mixer for about 10 minutes in a room conditioned at 25° C. temperature and under 40% RH. To this mixture, 6 g of N-lauloylsalcosine sodium was added, followed by mixing for 3 minutes. The resulting mixture was subjected to compressive tabulating at a packing rate of 6.5 g per tablet using a tabulating machine, a modification of Tough Press Correct 1527HU, produced by Kikusui Seisakusho, to yield 80 tablets of a bleacher replenisher tablet agent for color negative films.

3) Fixer Replenisher Tablets for Color Negative Films

Procedure (8)

2500 g of ammonium thiosulfate, 150 g of sodium sulfite, 150 g of potassium carbonate, 20 g of disodium ethylenediaminetetraacetate and 65 g of Pineflow (Matsutani Chemical Industry Co., Ltd.) were milled, mixed and granulated in the same manner as procedure (1). The amount of water added was 50 ml. Granulation was followed by drying at 60° C. for 120 minutes to remove almost all the water from the granulation product.

Procedure (9)

The granulation product prepared in the above procedure (8) and 13 g of N-lauloylsalcosine sodium were mixed in a mixer for about 3 minutes in a room conditioned at 25° C. temperature and under 40% RH. The mixture was subjected to compressive tabulating at a packing rate of 9.3 g per tablet using a tabulating machine, a modification of Tough Press Correct 1527HU, produced by Kikusui Seisakusho, to yield 280 tablets of a fixer replenisher tablet agent for color negative films.

4) Stabilizer Replenisher Tablets for Color Negative Films

Procedure (10)

150 g of m-hydroxybenzaldehyde, 20 g of sodium laulyl sulfate, 60 g of disodium ethylenediaminetetraacetate, 65 g of lithium hydroxide monohydrate and 10 g of Pineflow were milled, mixed and granulated in the same manner as procedure (1). The amount of water added was 10 ml. Granulation was followed by drying at 50° C. for 2 hours to remove almost all the water from the granulation product.

Procedure (11)

The granulation product prepared in the above procedure (10) was subjected to compressive tabulating at a packing rate of 0.48 g per tablet using a tabulating machine, a modification of Tough Press Correct 1527HU, produced by Kikusui Seisakusho, in a room conditioned at 25° C. temperature and under 40% RH. to yield 280 tablets of a stabilizer replenisher tablet agent for color negative films.

Next, with respect to the above tablet agents, two tablets of each of agents A, B and C, two tablets of the bleach-fixer replenisher tablet agent, three tablets of the fixer replenisher tablet agent and one tablet of the stabilizer replenisher tablet agent were packaged for 1 unit;

successive 20 units were packaged in a four-side sealed package of peel open packaging material. The peel open packing material used was the same as in Example 3.

Timing of tablet and replenishing water addition is as shown in Table 16.

For replenishing water and supplementing water for processing solutions due to evaporation, distilled water from effluent was used except for a color developing solution.

Processing was carried out so that the overflow from the color developing tank would be 5% of the tank solution per day.

TABLE 16

| | Temperature | Remaining condition of tablet | Note |
|---|---|---|---|
| Unit (A) | 20° C. | Δ | Invention |
| | 25° C. | ○ (12 pcs remained) | Invention |
| | 30° C. | ◎ (8 pcs remained) | Invention |
| | 35° C. | ◎ (6 pcs remained) | Invention |
| | 38° C. | ◎ (3 pcs remained) | Invention |
| | 40° C. | ◎ (3 pcs remained) | Invention |
| Unit (B) | 20° C. | X | Comparative |
| | 25° C. | X | Comparative |
| | 30° C. | X | Comparative |
| | 35° C. | X | Comparative |
| | 38° C. | X | Comparative |
| | 40° C. | X | Comparative |

◎The number of ordinarily remaining tablets is less than 10. (desirable)
○The number of ordinarily remaining tablets is 10 to 20 pcs. (fully occupying the replenishing tank)
ΔThe number of ordinarily remaining tablets is 10 to 20 pcs. (fully occupying the replenishing tank + unsolved component (finely))X Tablets are not solved in the replenishing solution For comparison, 10 liter of each of the above tablet replenishers, dissolved in replenishing water in a replenisher tank, was supplied from the replenisher tank at the same replenishing rate as above.

The water loss due to evaporation was compensated every morning until the overflow outlet level was reached. Photographic densities at the maximum density portion were compared 2 months after initiation of processing.

The results are given in Table 17.

TABLE 17

| Processing step | Processing time | Processing temperature |
|---|---|---|
| Color developing | 3 min. 15 sec. | 38° C. |
| Bleaching | 45 sec. | 38° C. |
| Fixing-1 | 45 sec. | 38° C. |
| Fixing-2 | 45 sec. | 38° C. |
| Stabilizing-1 | 20 sec. | 38° C. |
| Stabilizing-2 | 20 sec. | 38° C. |
| Stabilizing-3 | 20 sec. | 38° C. |
| Drying | 20 sec. | 55° C. |

From Table 17, it is seen that the color developer deteriorated and photographic density reduction occurred when using the comparative conventional processing method, while no such change occurred when using the method of the present invention.

Also, similar results were obtained when using the following solution for each package in place of the above stabilizer replenisher tablet agent in the method of the present invention.

| | |
|---|---|
| Diethylene glycol | 2.9 g |
| m-hydroxybenzaldehyde | 0.65 g |
| Emulgen 810 (Kao Corporation) | 0.2 g |

Example 8

An experiment was conducted in the same manner as experiment (7) of Example 3 except that the distilling temperature and distilling pressure were changed as shown below.

TABLE 18

| Experiment No. | Distilling temperature (°C.) | Distilling pressure (mmHg) | Reflective density Dmax (B) | Note |
|---|---|---|---|---|
| 2-1 | 100 | 760 | 1.55 | Comparative |
| 2-2 | 90 | 700 | 1.98 | Invention |
| 2-3 | 90 | 500 | 2.10 | Invention |
| 2-4 | 70 | 240 | 2.14 | Invention |
| 2-5 | 60 | 200 | 2.15 | Invention |
| 2-6 | 50 | 100 | 2.20 | Invention |
| 2-7 | 40 | 55 | 2.30 | Invention |
| 2-8 | 35 | 45 | 2.32 | Invention |
| 2-9 | 25 | 25 | 2.32 | Invention |
| 2-10 | 15 | 15 | 2.32 | Invention |

The conditions for the distilling method of Experiment No. 2-1 were the same as those described in Example 1 of Japanese Patent Publication Open to Public Inspection No. 20144/1987.

From Table 18, it can be understood that the present invention is preferred due to having no reduction in Dmax.

In addition, Table 18 shows that a temperature of 90° C. and a distilling pressure of 500 mmHg are acceptable, a temperature of 60° C. and a distilling pressure of 200 mmHg are more acceptable, that the temperature of 40° C. and the distilling pressure of 55 mmHg are still more preferable and that the temperature of 35° C. and a distilling pressure of 45 mmHg are most preferable.

Example 9

Another experiment was conducted in the same manner as experiment (7) of Example 3 except that the distilled water of photo-effluent was reused after being subjected to the secondary treatment as shown in Table 19 and the storage term of light-sensitive materials for evaluating image deterioration was extended from 7 days to 14 days. In addition, experiment 11 was conducted in the same manner as a comparative. Table 19 shows the results thereof.

TABLE 19

| Experiment No. | Secondary treatment | Replenisher | Dmax (B) | Deterioration of image | Note |
|---|---|---|---|---|---|
| 3-1 | — | Water from tap water | 2.20 | X | Comparative |
| 3-2 | — | Distilled water | 2.25 | Δ | Invention |
| 3-3 | Neutralization treatment | Distilled water provided with secondary treatment | 2.30 | ○ | Invention |
| 3-4 | Re-distilling | Distilled water provided with | 2.31 | ○ | Invention |

TABLE 19-continued

| Experiment No. | Secondary treatment | Replenisher | Dmax (B) | Deterioration of image | Note |
|---|---|---|---|---|---|
| | treatment | secondary treatment | | | |
| 3-5 | Aeration treatment | Distilled water provided with secondary treatment | 2.29 | ○ | Invention |
| 3-6 | Ion-exchanging treatment | Distilled water provided with secondary treatment | 2.30 | ○ | Invention |

Neutralization treatment: $NaHSO_4$ was added until pH of the effluent was reduced to 7.0.
Re-distilling treatment: The solution was distilled twice under the same conditions.
aeration treatment: Air in an amount of 10 l/minute was forced through for 10 hours per 20 l of the distilled solution.
Ion-exchanging treatment: The distilled water was subjected to weak-anion-exchanged resin treatment, and then, subjected to weak-cation- exchanged resin treatment As is apparent from Table 19, it is effective to use distilled solution after being subjected to the secondary treatment of the present invention in order to optimize the effects of the present invention.

Example 10

An example control of the supply of replenishing water is given below to describe the relationship between the continuity of processing and the dissolution state of the solid processing agent.

Information on the amount of processing is an indirectly detected index of the state of reduction in the processing agent components in the processing solution according to the amount of processing. Therefore, if the processing agent components in the processing solution in the processing tank decrease rapidly due to continuous processing so that the shortage of the processing agent components cannot be compensated in time by dissolving the replenishing processing agent, supply of replenishing water based solely on the information on the amount of processing will result in the replenishing water to be added in advance of the supplementation of the processing agent components so that replenishing water will be present in excess transiently; this leads to disposal of the processing agent components as an overflow in dilution with the replenishing water in the case of the use of the overflow method to maintain a liquid surface level in the processing tank, which results in an undesirable reduction in the processing agent components. Considering this situation, in the present example, in view of the dissolution time of the processing agent added or the dissolution-dispersion time of the processing agent added, sequential supply of replenishing water is prevented while the processing agent remains dissolved or dissolved-dispersed by controlling the supply of replenishing water by a controlling means.

FIG. 9 is a block diagram of the above example.

Information on the amount of processing is generated by detecting means 8 and enters processing agent supply controlling means 9 and replenishing water supply controlling means 9-*b*, and replenishing water supply means 42 is controlled with reference to the data on the table 9-*c* as to processing agent dissolution time or processing agent dissolution-dispersion time with respect to processing agent supply controlling means 9 and replenishing water supply controlling means 9-*b*. As stated above, when the processing agent components of the processing solution in the processing tank decrease rapidly due to continuous processing, replenishing water is supplied after dissolution or dissolution-dispersion of the processing agent completes.

Figure 21:
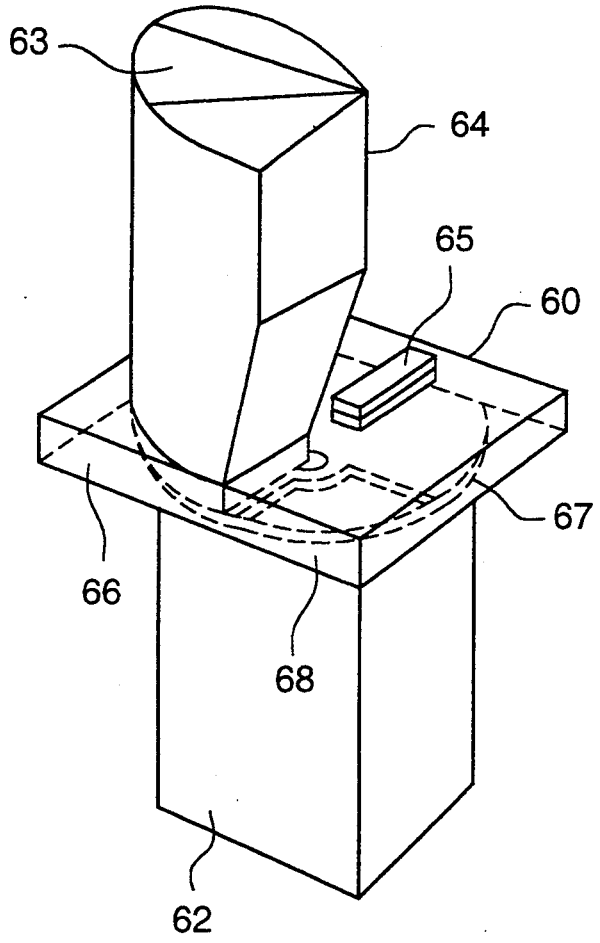
FIG. 21 is a perspective view of a powder-type processing agent supplying device.

FIGS. 20 through 24 show solid processing agents supplying devices preferably used in the present invention. FIG. 20(A) shows a cross-sectional view of a powder type processing agent supplying device. FIG. 20(B) is a perspective view of a package. Supplying device 50 is composed of a hopper housing powder type processing agent or package 51 , measuring hole 53 which measures the amount of powder type processing agent and rotary drum 52 for supplying the given amount of processing agent. This rotary drum has a dehumidifying function due to providing a gap between measuring hole 53 and outlet port 56. The seal on package 51 is cut and the package is mounted on the top of the supplying device. A given amount of the powder chemical is measured in measuring hole 53, drum 52 rotates due to the instruction of a means for sensing the processing amount of light-sensitive material. When the drum is in the state of communicating with outlet port 56, the drum stops rotation. Then, the chemical passes outlet port 56 to be supplied to the constant-temperature section in the automatic processing machine (a filter tank). After emptying, drum 52 rotates, and when measuring hole 53 and the supplying section communicates, the drum 52 stops its rotation. At that time, measuring of powder chemical is started again. FIG. 21 is a perspective view of another supplying device.

In supplying device 60, chemical housing section 63 is divided into plural parts so that chemical can be housed for each parts in the same manner as conventional concentrated kits. In addition, dehumidifier 65 is provided in order to improve preservability of powder chemical located in the housing section.

Receiving information on the processing of light-sensitive materials, rotary member 67 conveys given amounts of each component of powder processing agent to outlet port 68.

Figure 22:
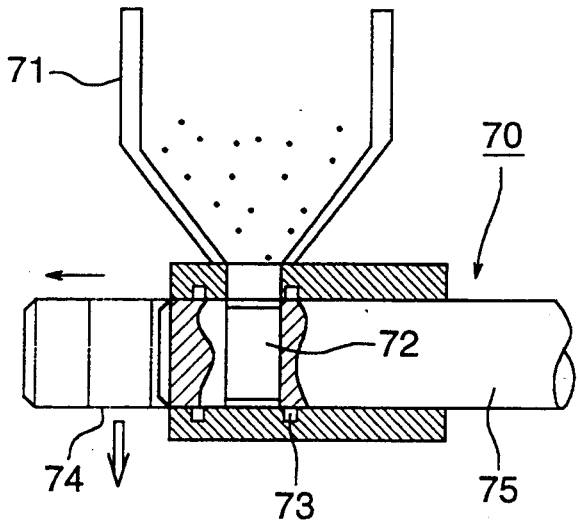
FIG. 22 is another example of a cross-sectional view of a powder-type processing agent supplying device.

FIG. 22 is a cross-sectional view of another supplying device of powder processing agent.

Supplying device 70 pours powder processing agent into hopper 71. Depending upon the processing amount of light-sensitive material, piston 75 moves horizontally (to the right direction) so that a given amount of powder agent is inserted into measuring hole 72. Then, piston 75 moves reversely (to the left direction) so that the given amount of powder agent is supplied to the constant-temperature tank (the filter tank) by means of outlet port 74.

Figure 23:
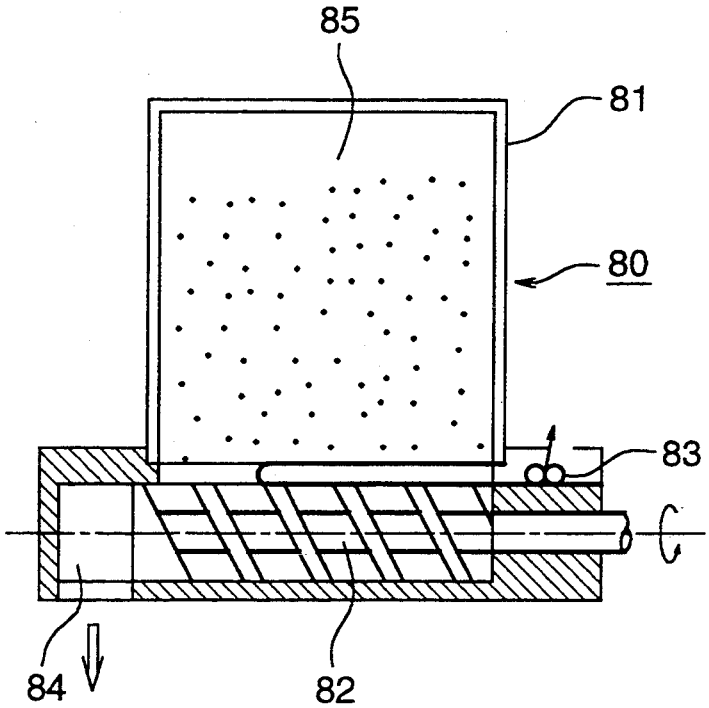
FIG. 23 shows another example of a cross-sectional view of a powder-type processing agent supplying device.

FIG. 23 is a cross-sectional view of still another supplying device of powder processing agents.

Package 85 containing powder processing agent 85 is loaded in supplying device 80. Supplying device has a function to open the package automatically by means of roller 83. By controlling the number of the rotation of screw 82, powder chemical is supplied through outlet port 84.

Since the supplying device has a function to open the package, it is desirable because fine powder never soars when opening or loading the package.

Figure 24:
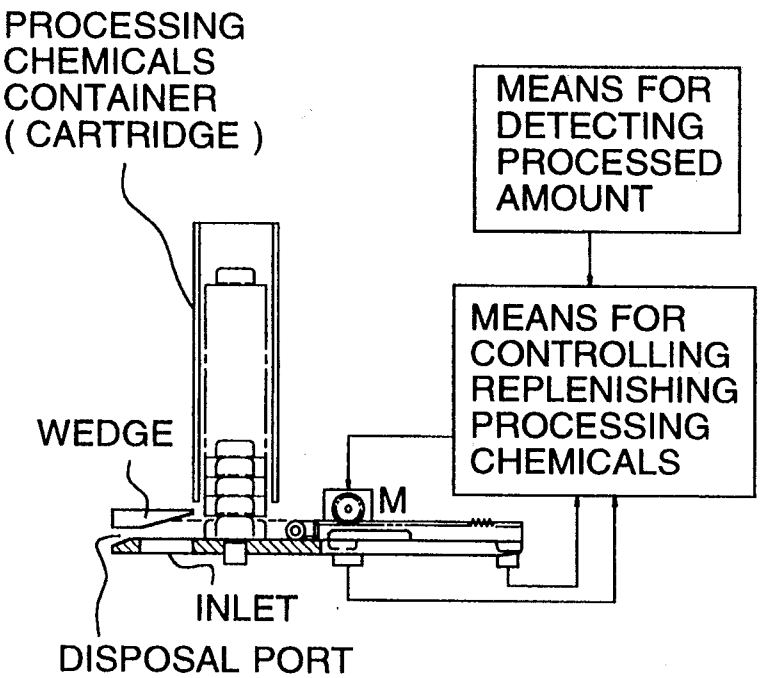
FIGS. 24(A) to 24(D) show cross-sectional views and an oblique view of a PTP-packed processing agent supplying apparatus relating to the present invention.
Figure 24:
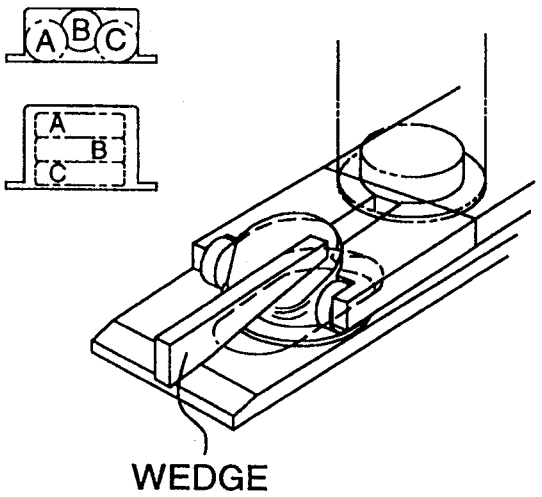
Figure 24:
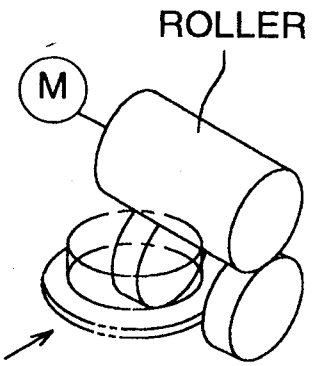
Figure 24:
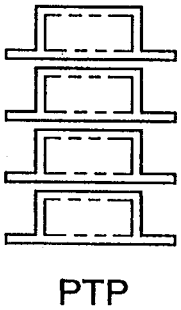

FIG. 24 shows a charging apparatus for a PTP (pressure through package) packaged solid processing agent relating to the present invention, wherein panel (A) is a cross-sectional view of the processing agent supplying apparatus, panel (B) is an oblique view of the package cutting means, panel (C) is another oblique view of the package cutting means, and panel (D) is a cross-sectional view showing the state of loading of a PTP-packaged solid processing agent.

The processing agent storage container contains a PTP-packaged solid processing agent, and it may be of the remove storage type or the cartridge type wherein the solid processing agent is contained in a cartridge. A known material can be used for PTP packaging, and it is preferable to package the solid processing agent in a tablet form.

The PTP-packaged solid processing agent is supplied from the lower portion of the storage container. Upon a given amount of light-sensitive material has been processed, information from the processing amount detecting means is sent to the processing agent supply controlling means, and the PTP-packaged solid processing agent is pushed out to, and crushed on, the fixed wedge-shaped plate by the motor, whereby the lower part of the PTP package (mainly of aluminum) is broken and the solid processing agent is added to the processing tank via the adding port. The PTP package, now empty after addition, is further pushed out to be disposed via the disposal port. In addition to the use of a wedge, a roller may be used as a crushing means, which may be optionally selected.

Figure 25:
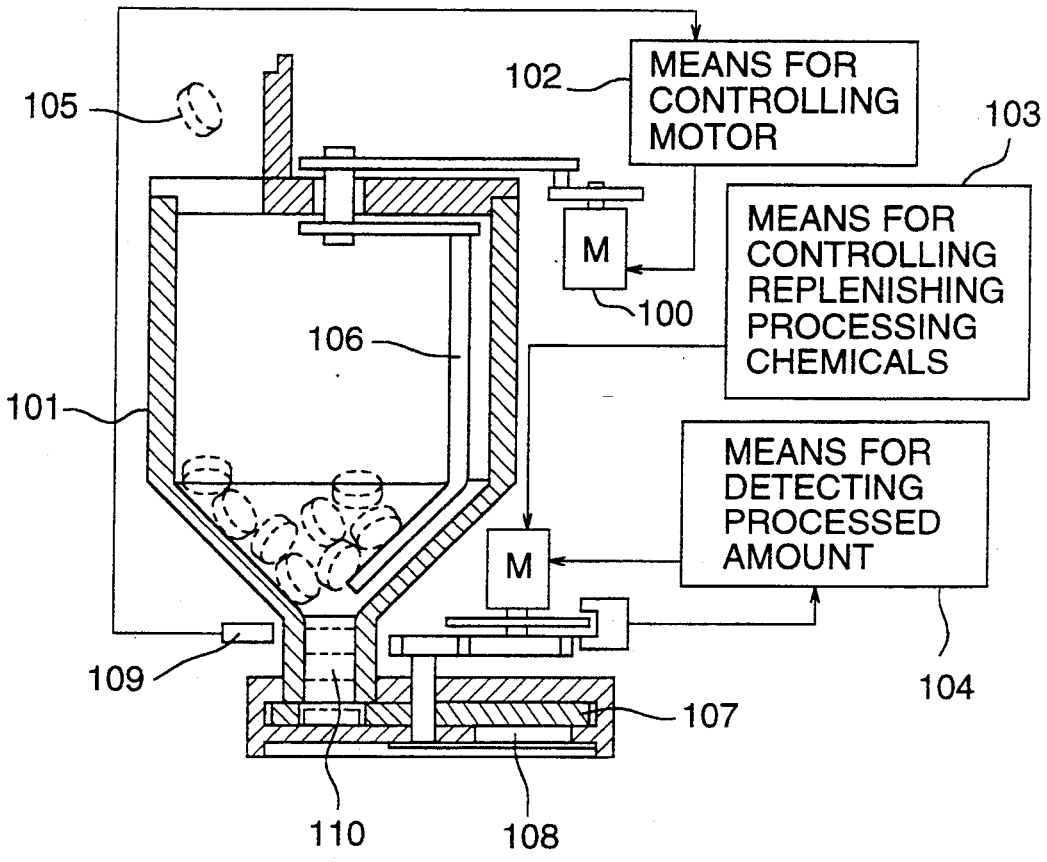
FIGS. 25(A) to 25(C) are cross-sectional views of another supplying apparatus.
Figure 25:
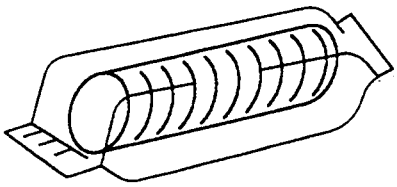
Figure 25:
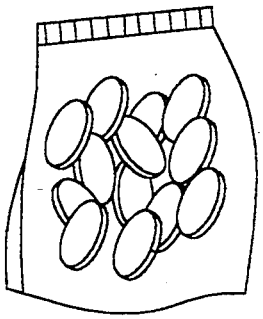

FIG. 25 shows an example of a supplying apparatus based on the part feeder method for bulk-packaged tablets (removely weighed in advance) relating to the present invention.

Package A or B was opened, and the bulk-packaged tablet chemical was placed in hopper 101. At this operation, handling was easy with no dust formation nor caking. Upon signal reception from residual amount detecting means 109, stirrer 106 begins to start, and tablets 105 are arranged in tablet arranging portion 110. According to the amount of light-sensitive material processed, processing agent supply controlling means 103 acts, and turn table 107 transports the tablets from discharge portion 108 to the adding portion. After one rotation, turn table 107 stops upon direction from the turn table controlling means (several times of tablet supply by a single direction is also possible). The tablet enters the opening of turn table 107.

The advantages are that the packaging material is not expensive and easily handlable, that accurate addition is possible, and that the presence of tablet arranging portion 110 prevents faulty supply by the turning table, thus offering high efficiency. Reduction in the use of plastic containers is desirable from the viewpoint of environmental conservation. Freedom of dust formation ensures maintenance-free quality because of no stain in the supplying apparatus.

Figure 26:
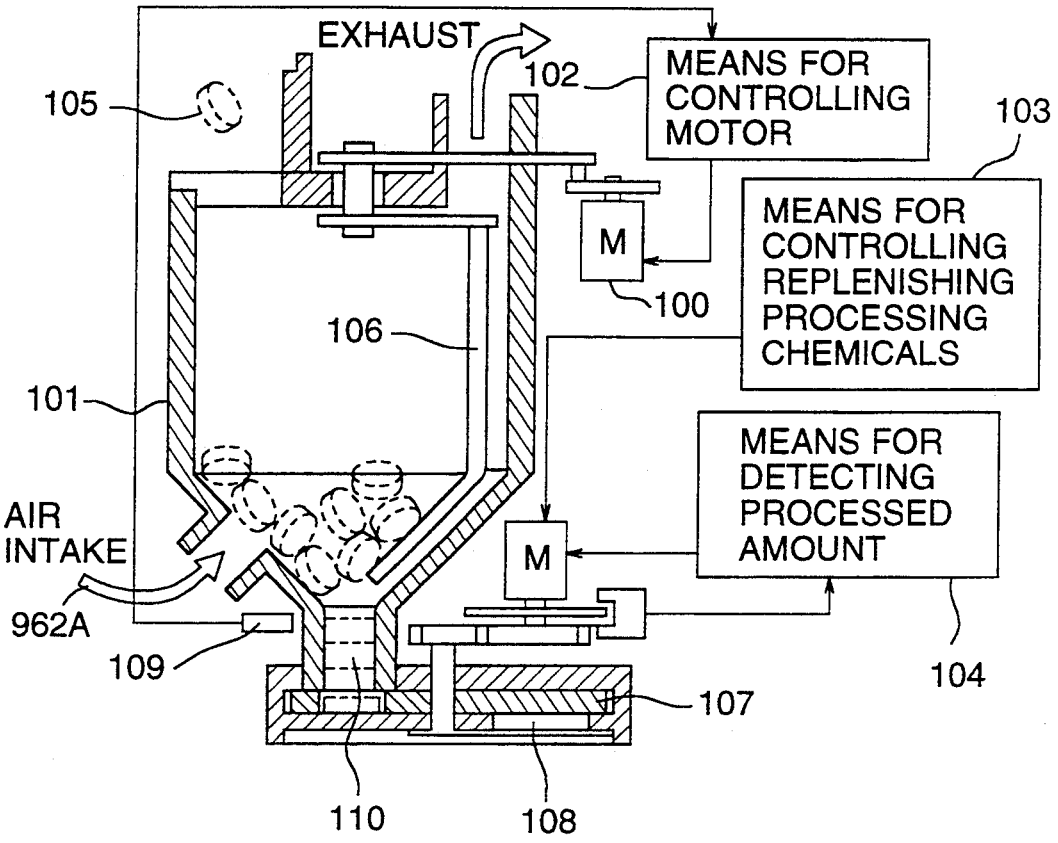
FIG. 26 is a cross-sectional view of still another supplying apparatus.

The apparatus shown in FIG. 26 is the same as that shown in FIG. 25 except that it is so structured that dry air 962A generated from dehumidifier is fed to processing agent supplying means 133 directly through duct 962 as shown in FIG. 10 for effective drying of tablet 13.

Due to this structure, tablet 13 can be stored stably and for a long term.

FIG. 27 shows an example of supplying apparatus 120 based on the parts feeder method for bulk-packaged tablets (removely weighed in advance) relating to the present invention.

Package A or B of the bulk-packaged tablet chemical was opened and the tablets were placed in hopper 133. In this operation, handling was easy with no dust formation nor caking. Upon signal reception from residual amount detecting means 125, mobile element 124 begins to rotate, and a given units of the tablet chemical are arranged in tablet arranging portion 129. When a given number of units have been arranged, mobile element 124 stops. Upon this action, sweeper 123 is very effective for the tablets to enter pocket 122 of mobile element 124 and be arranged in arranging portion 125.

According to the amount of processing of light-sensitive material, processing agent supplying means 126 acts to rotate shutter 131 and drop the tablet chemical. Next, first shutter 131 rotates in the opposite direction and inserts one tablet between shutters 131 and 132. Shutter 132 rotates, and the tablet chemical passes discharge portion 128 to the receiving portion. Next, shutter 132 rotates in the opposite direction, and shutter 131 closes.

The advantages are that the packaging material is not expensive and easily handlable, that accurate addition is possible, and that the presence of tablet arranging portion 129 prevents faulty supply by the turn table, thus offering high efficiency. Reduction in the use of plastic containers is desirable from the viewpoint of environmental conservation. Freedom of dust formation ensures maintenance-free quality because of no stain in the supplying apparatus.

Figure 28:
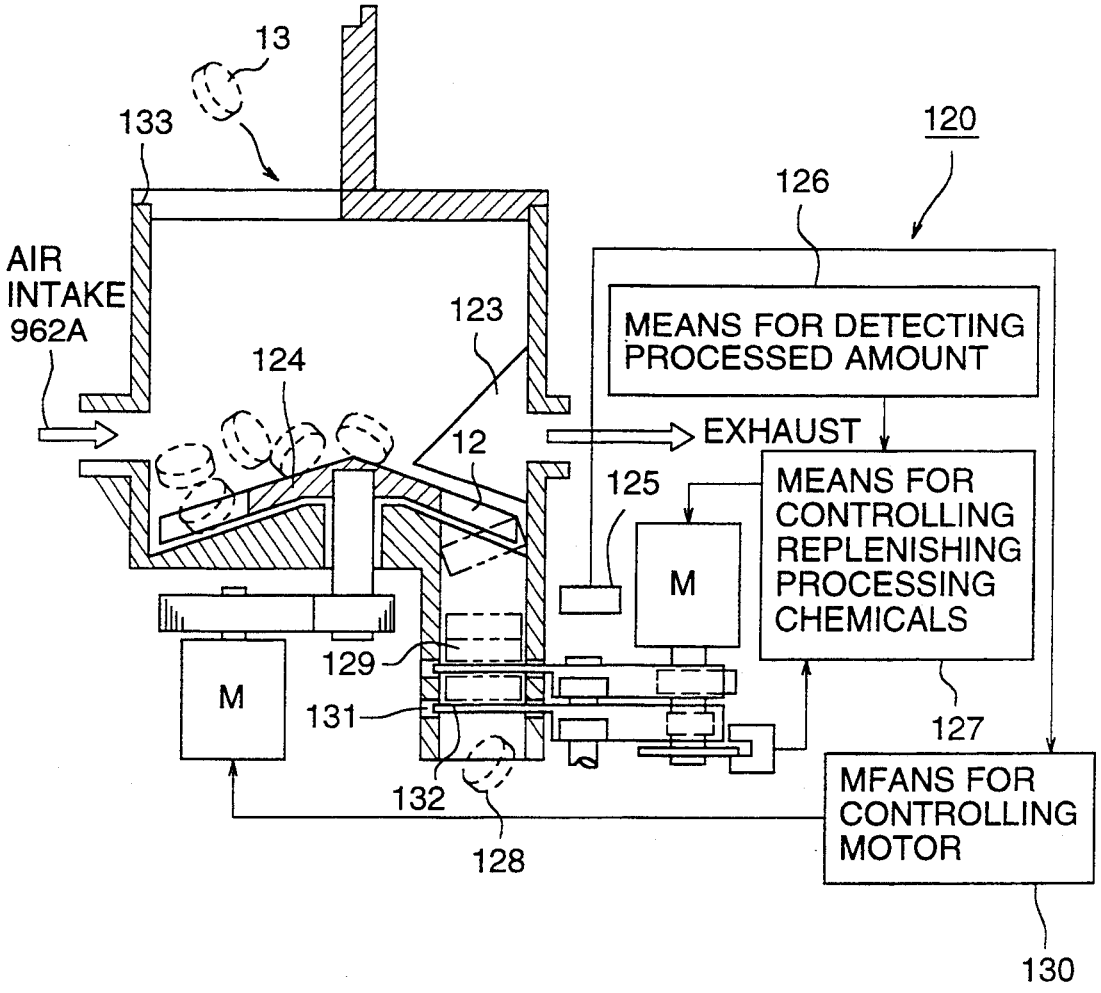
FIG. 28 is a cross-sectional view of still another supplying apparatus.

The apparatus shown in FIG. 28 is the same as that shown in FIG. 27 except that it is so structured that dry air 962A generated from dehumidifier 960 is fed to processing agent supplying means 133 directly through duct 962 for effective drying of tablet 13.

Due to this structure, tablet 13 can be stored stably and for a long term.

Figure 29:
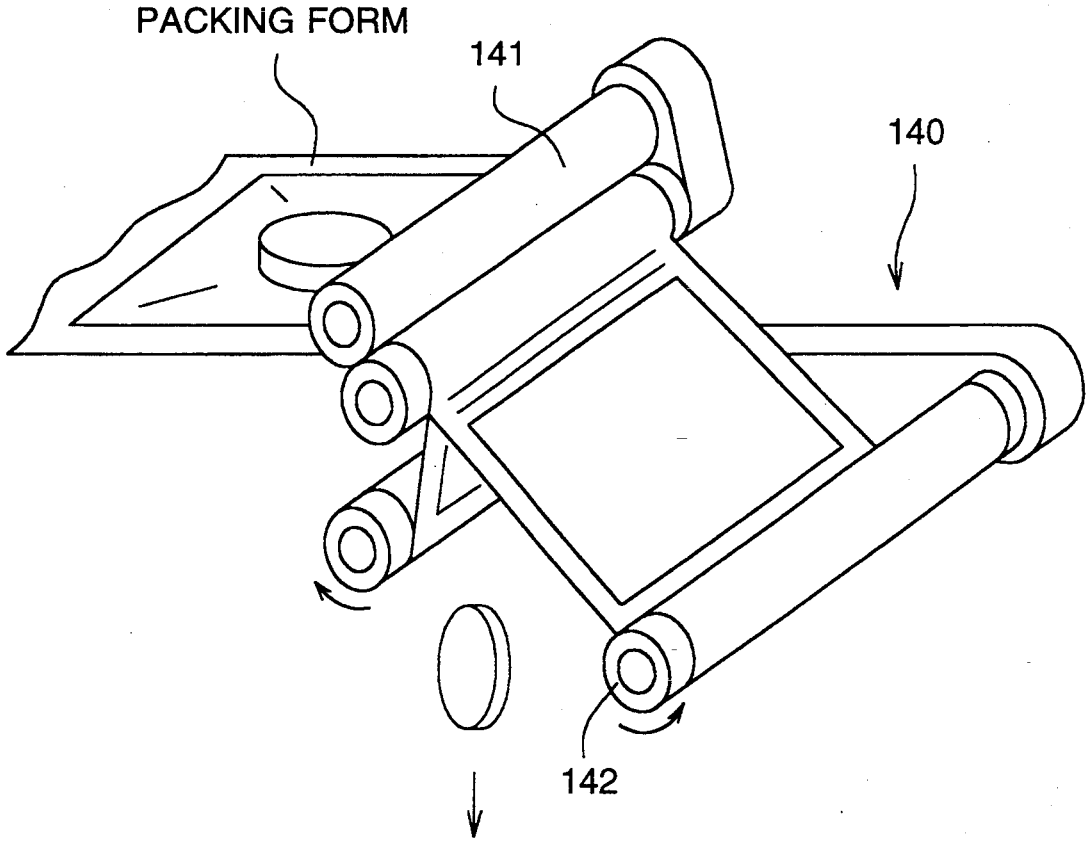
FIG. 29 is an oblique view of still yet another supplying apparatus.

FIG. 29 is an oblique view of an example of the solid processing agent supplying apparatus 140 of the present invention, wherein the solid processing agent is added to the processing tank by breaking the package of the solid processing agent.

The tip of the four-side sealed package containing the solid processing agent is set on winding shaft 142, which is a means for immobilization, via roller 141. When a given amount of light-sensitive material has been processed, as detected by the processing amount information detecting means, the processing agent supply controlling means passes a signal to activate the motor of winding shaft 142 which is also a processing agent supplying means, whereby the package containing the solid processing agent is moved in a given distance and the required number of units of the solid processing agent are added. The package may be moved by any method, including the method in which a notch made in the package is detected, the method in which a printed pattern is detected and the method in which the processing agent in the package is detected; essentially, the required number of units of the solid processing agent are detected accurately and moved by means of roller 141 and winding shaft 142. Roller 141 is provided for immobilizing and positioning the package and for other purposes, having two winding shafts to peel the package and add the solid processing agent.

In this type, the solid processing agent may be in the form of granules, pills, tablets or powder, but the solid processing agent preferably in a tablet form, since it is advantageous that accurate addition is possible and stain is not likely because tablets do not adhere to the seal. After completion of winding, the package may be removed directly from the winding shaft, or may be rewound for disposal along with the cartridge.

Figure 30:
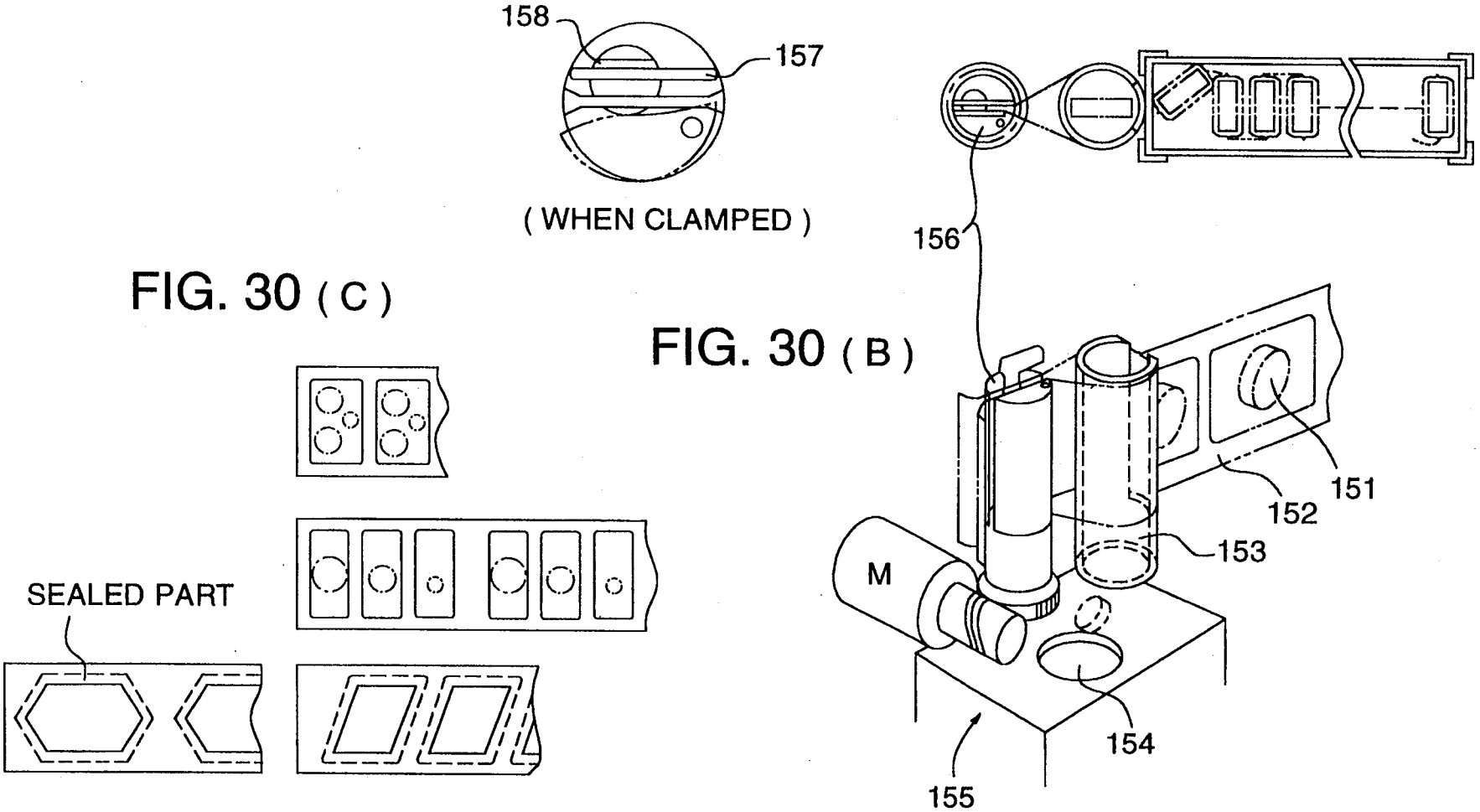
FIGS. 30(A) to 30(C) are plane and an oblique views of a supplying apparatus.

FIG. 30 shows an example of a preferred mode of embodiment of the supplying apparatus of the present invention, wherein panel (A) is a plan, panel (B) is an oblique view, and panel (C) is plans of various packages.

Processing agent 151 is packaged in a four-side sealed package 152 as illustrated in FIG. 30(C).

In the packaging style of FIG. 30(C), the package material may be any commonly used polymer resin package, aluminum or composite material, as long as it possesses good moisture resistance and low oxygen permeability.

The four-side sealed processing agent 151 is peeled via a cylinder 153 and added to adding portion 155 via adding port 154, where cylinder 153 and winding shaft 156 serve as a processing agent supplying means. Package 152 is wound by winding shaft 156, wherein winding is controlled by the processing agent supplying means receiving a signal from the light-sensitive material processing amount detecting means. For winding, the dial is opened, and tip of package 151 is set on winding shaft 156 which is also an immobilizing means for the processing agent storage package via the cylinder, and dial 157 is turned to immobilize the package to clumper 158 and wind it.

Figure 31:
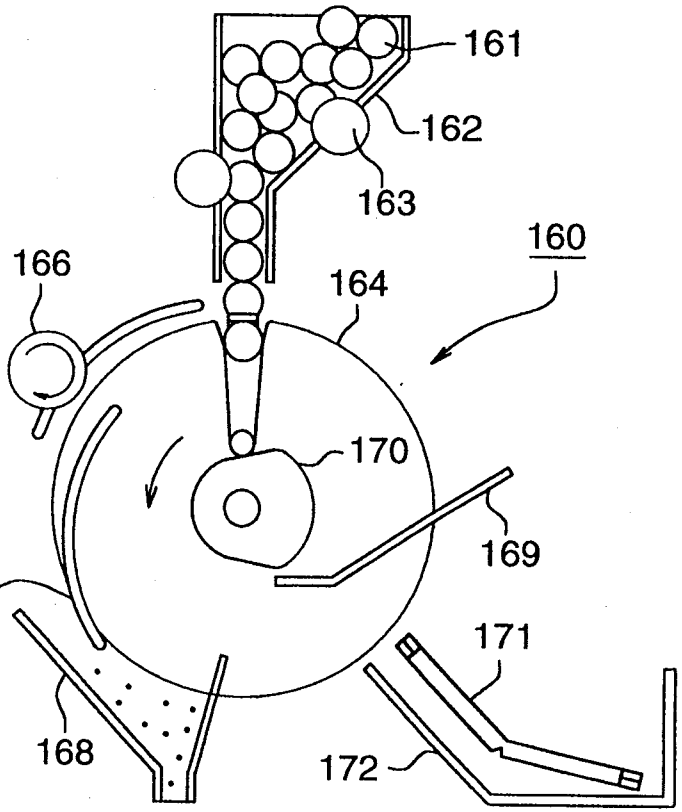
FIGS. 31(A) and 31(B) show a side cross-sectional view and a front cross-sectional view of a supplying apparatus.
Figure 31:
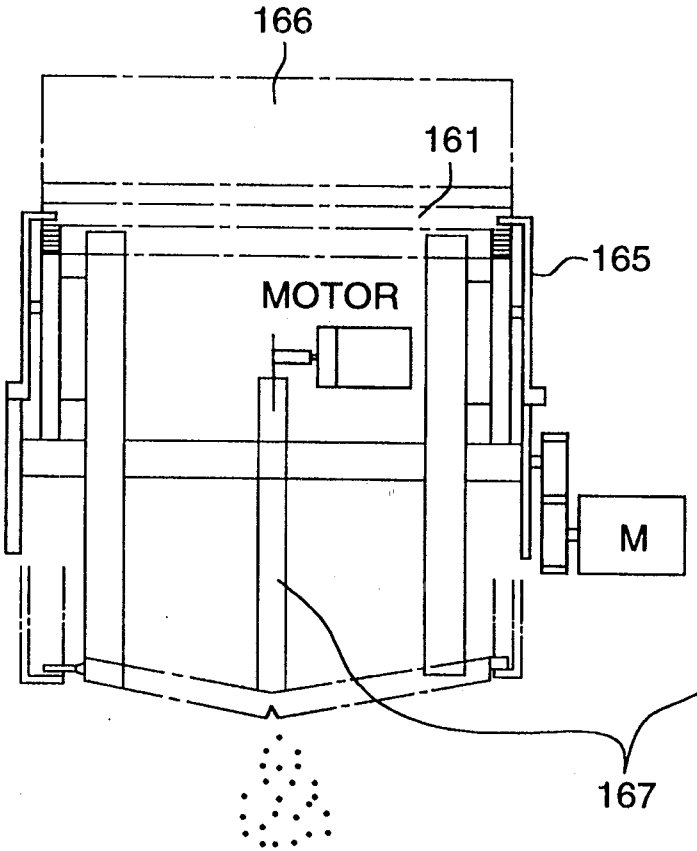

FIG. 31 shows an example of a supplying apparatus 160 wherein a solid processing agent 161 is in a stick package, wherein panel (A) is a side cross-sectional view, and panel (B) is a front cross-sectional view.

Solid processing agent 161 in a stick package is placed in storage container 162. Stick-packaged solid processing agent 161 is then transferred to turret 164 by anti-bridging roller 163 and another roller serving to supply to the turret. Stick-packaged solid processing agent 161 is then immobilized at both ends by clumper 165 and then transferred to a cutter portion by rolling action, where the center of the stick-package is partially or completely cut by cutter 166 and transferred to two-fold plate 167 by rolling action, where stick-packaged solid processing agent 161 is bend and added to chute 168 packaged in the stick package via the cut made by rotary cutter 166. After addition, solid processing agent 161 is transferred to scrap drop bar 169, and clumper 165 is disabled by clamp switching cum 170 to dispose scrap 171 into recovery chute 172.

Figure 32:
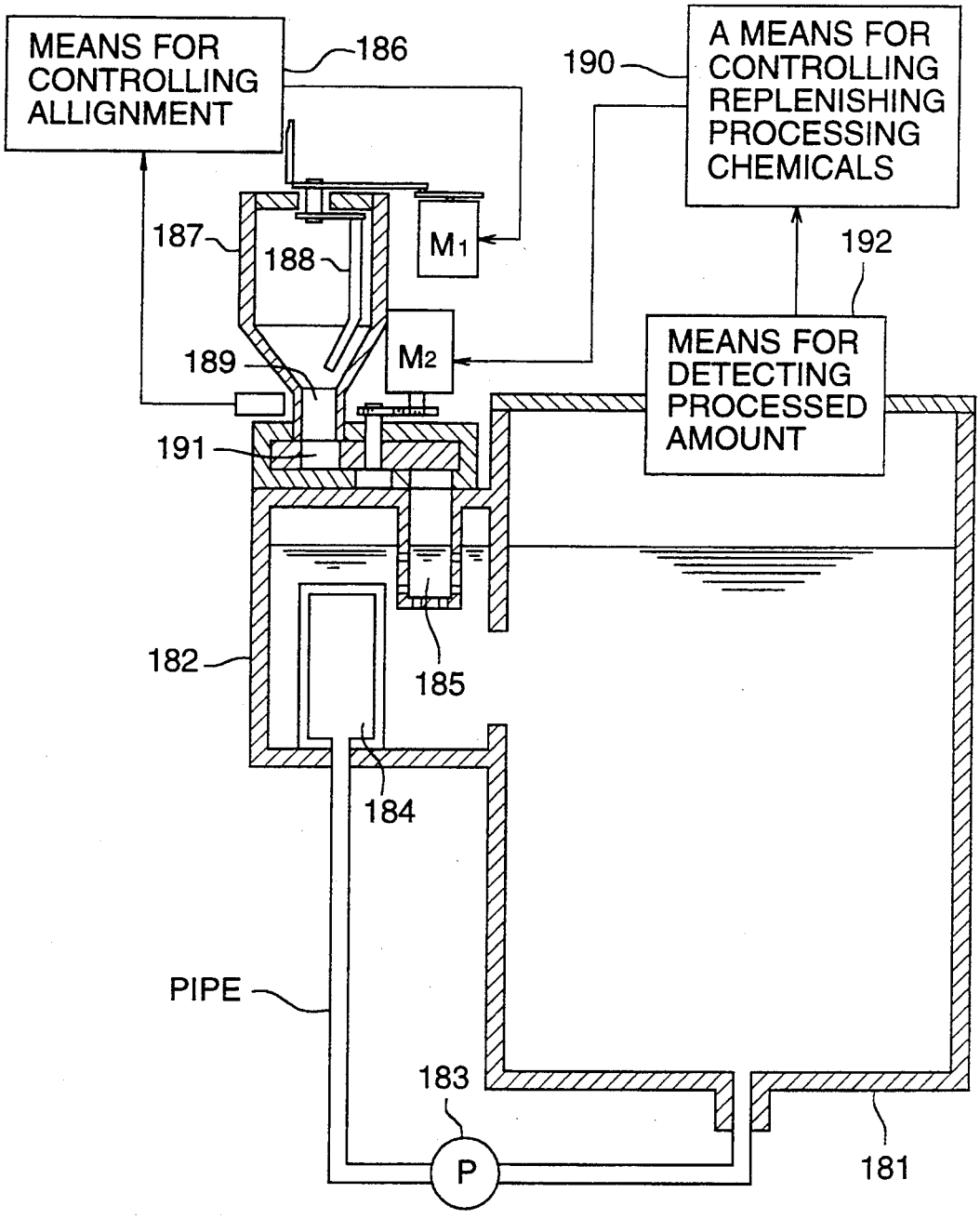
FIGS. 32(A) to 32(C) are cross-sectional views of a supplying apparatus and an oblique view of a package.
Figure 32:
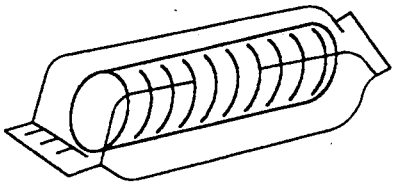
Figure 32:
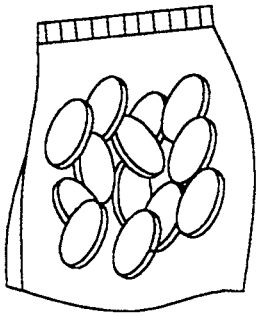

FIG. 32 is a cross-sectional view of a mode of embodiment of the present invention.

Processing portion 181 and receiving portion 185 in the constant temperature chamber 182 constituting the processing tank communicate mutually. The processing solution is forced to be circulated by circulatory pump 183 via the lower portion of the processing tank and discharged into filter portion 182 and then enters processing portion 181 via tablet receiving portion 185.

Upon processing of the light-sensitive material, the amount of processing is detected by processing amount detecting means 192. When a given level of processing amount has been detected, motor M2 is activated by processing amount supply controlling means to supply previously weighed tablets to receiving portion 185 in constant temperature chamber 182.

The tablets are added directly to storage container 187, after which arranging means 188 is driven by motor M1 upon signal reception from arranging amount controlling means 186 to arrange the tablets and supplied to arranging portion 189. The tablets thus supplied to arranging portion 189 are transported to above the receiving portion by the rolling action of the supplying means upon drive of motor M2 upon signal reception from controlling means 190, and added to receiving portion 185. From the viewpoint of tablet moisture resistance, it is preferable to substantially remove processing agent supplying means 191 from constant temperature chamber 182.

The tablets are added to receiving container 187 after breaking its package as illustrated in FIGS. 32 (A) and (B). The packages illustrated in FIGS. 32 (A) and (B) may be of a known material such as paper, polymeric resin or aluminum, with preference given to a material possessing good moisture resistance and low oxygen permeability.

Figure 33:
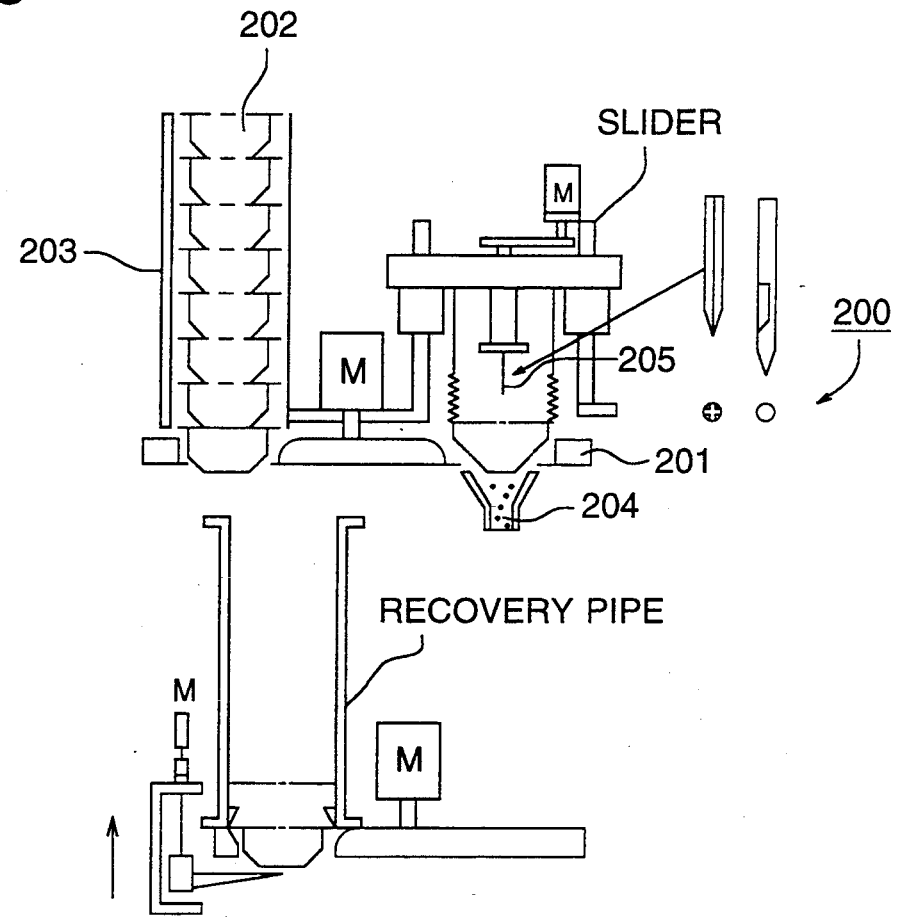
FIG. 33 is a cross-sectional view of a supplying apparatus for a blister-packaged solid processing agent.

FIG. 33 is a cross-sectional view of an example of supplying apparatus 200 for a solid processing agent in blister package.

Single package 202 containing the solid processing agent is set on storage portion 203.

According to the amount of processing of light-sensitive material, disc 201 rotated over an angle of 180°, after which needle 205 penetrates single package 202 to reach discharge portion 204 in package 202 to supply the solid processing agent to the receiving portion. Emptied package 202 is disposed via the disposal port.

Although the solid processing agent may be in powder or granules, granules are preferred, since powder adheres to the container.

Advantages are easy handling and maintenance-free quality owing to the absence of dust stain of supplying apparatus 200.

Figure 34:
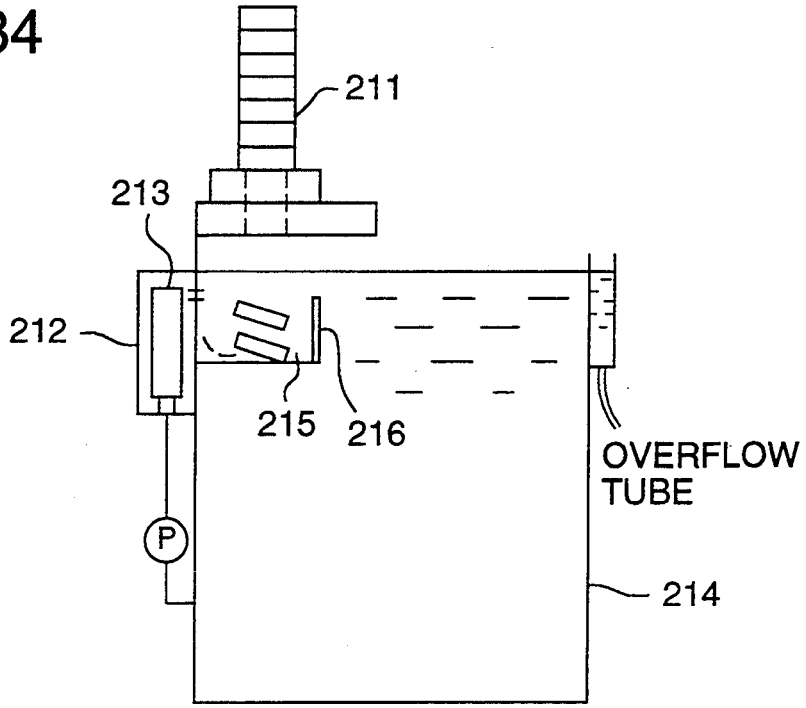
FIG. 34 is a cross-sectional view of an example of a supplying apparatus for adding a solid processing agent directly to a processing tank.

FIG. 34 is a cross-sectional view of an example of the present invention.

According to the amount of light-sensitive material processed, the solid processing agent is supplied directly to receiving portion 215 in the processing tank via tablet chemical storage portion 211. Receiving portion 215 is equipped with a solid processing agent filter 216 to prevent the undissolved processing agent from adhering directly to the light-sensitive material. The material for this filter 216 is not subject to limitation. Although the mesh size is not subject to limitation, preference is given to 10 to 100 μm from the viewpoint of solution passage and filtering efficiency.

Nearly equivalent effect is obtained to the case where the solid processing agent is supplied to constant temperature chamber 212 constituting the processing tank. The only drawback is the inferior compactness due to the separation of receiving portion 215 in the processing tank.

Figure 35:
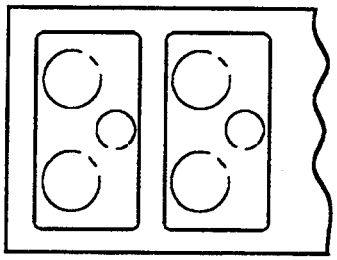
FIGS. 35(A) through 35(X) are plane views of a seal package.
Figure 35:
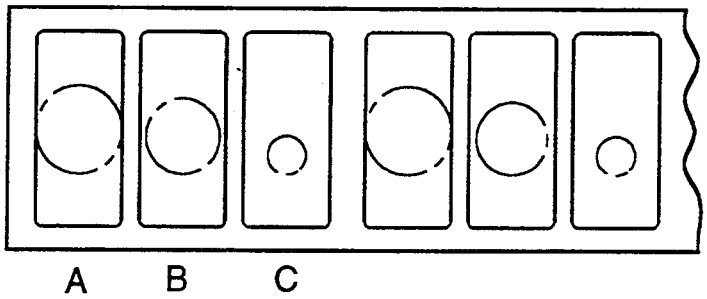
Figure 35:
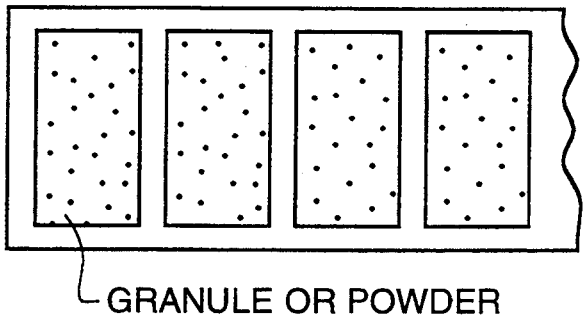
Figure 35:
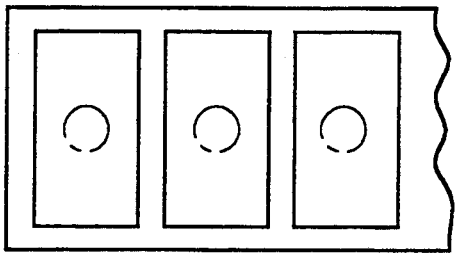
Figure 35:
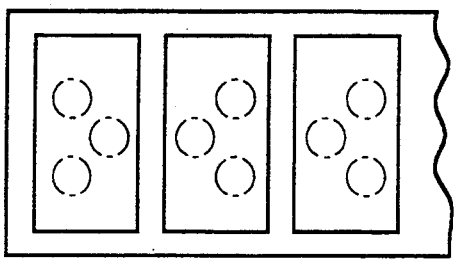
Figure 35:
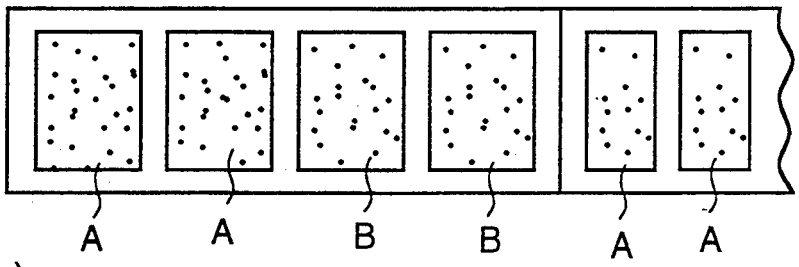
Figure 35:
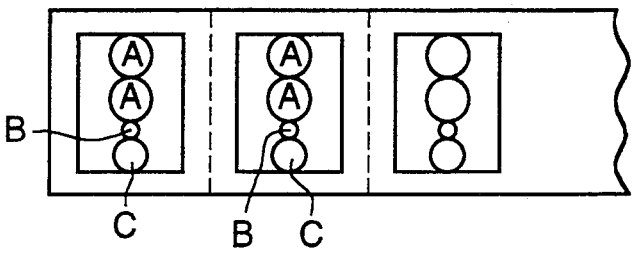
Figure 35:
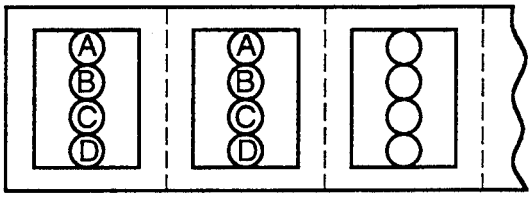
Figure 35:
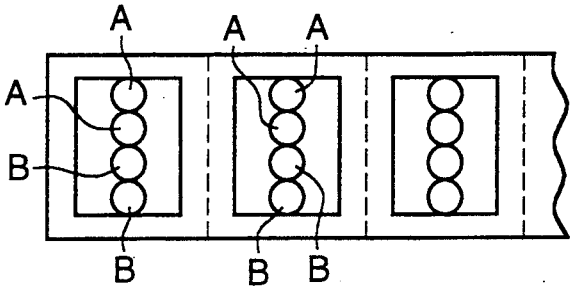
Figure 35:
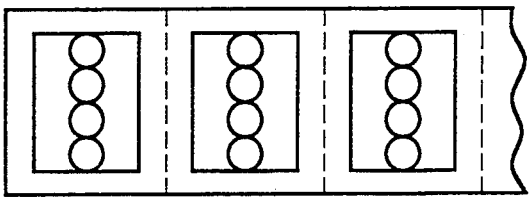
Figure 35:
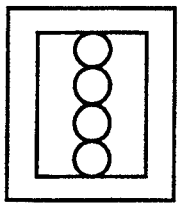
Figure 35:
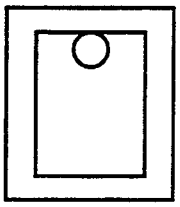
Figure 35:
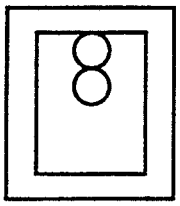
Figure 35:
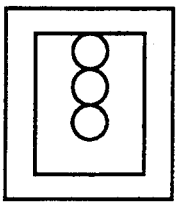
Figure 35:
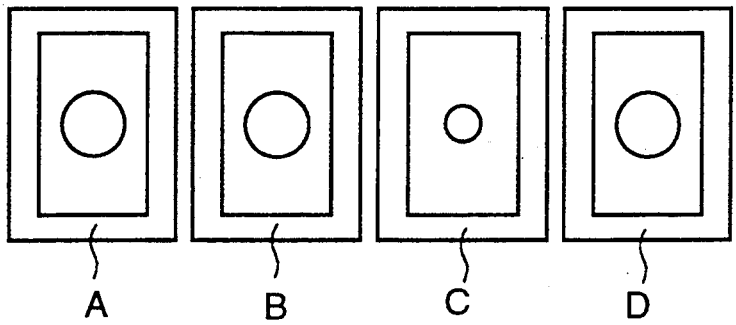

FIG. 35 shows an example of four-side sealed and three-side sealed packages, which are not to be construed as limitative. In the seal package illustrated in FIG. 35(A), several kinds of tablets are contained in a single package unit. In the package of FIG. 35(B), tablets of different sizes are removely contained. In the package of FIG. 35 (C), granules or powder is packaged. In the package of FIG. 35(D), tablets of the same size are removely packaged. In the package of FIG. 35(E), a plurality of small tablets of the same chemical of the same size are contained.

FIG. 35(F) and (G) and FIG. 29(H) are examples of series package having different supplying amount each other wherein powder or granule are contained.

FIGS. 35(I), (J) and (K) are examples of series package having different supplying amount each other wherein the different kinds of tablet are contained in each package.

FIGS. 35(L), (M), (N) and (O) are examples of series package wherein the number of agent contained in each package is changed.

FIG. 35(P) is an example of series package containing powder or granule wherein each package is removed.

FIGS. 35(Q) through (X) are examples of series package containing tablets wherein each package is removed.

Figure 37:
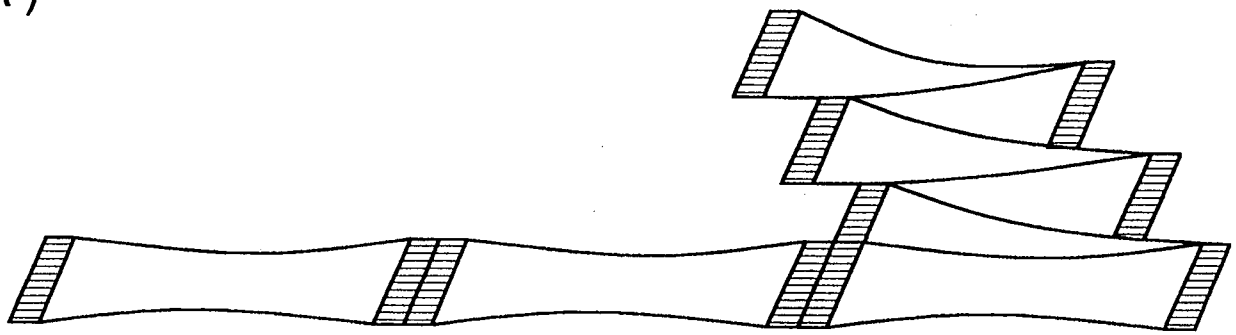
FIG. 37(A) through 37(B) are plane views of a stick package.
Figure 37:
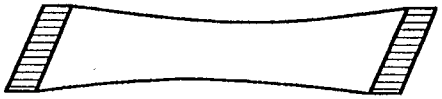

FIGS. 36 (A), (B) and (C) are plans of four-side sealed packages. FIG. 36 (D) shows an example of three-side package. FIGS. 37 (A) and (B) show examples of stick packages. Any of these examples is not to be construed as limitative.

Figure 38:
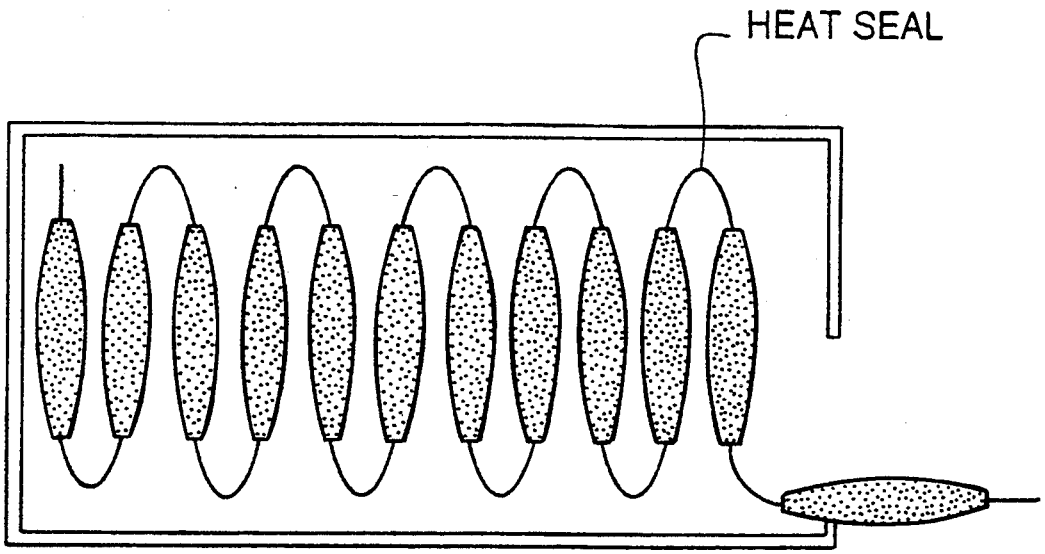
FIG. 38 is a cross-sectional view of another example of stick package.

FIG. 38 is a cross-sectional view showing tablets, granules or powder heat sealed and then folded and housed in the container.

FIG. 39 shows examples of PTP package, which are not to be construed as limitative. FIG. 39(A) shows a pill-formed solid processing agent in PTP package. FIG. 39(B) shows a state of several tablets of processing agent in package. FIG. 39(C) shows a state of longitudinal arrangement of packages containing tablets, granules or powder. FIG. 39 (D) shows a transversal arrangement of these packages. The blister package illustrated in FIG. 39(E) is also acceptable.

FIG. 34 shows examples of bulk packages, which are not to be construed as limitative. FIG. 40(A) shows a solid processing agent contained in a cylindrical container. FIG. 40(B) shows a solid processing agent contained in a soft two-side sealed or three-side sealed bag. FIG. 40(C) shows a solid processing agent contained in a one-side sealed bag.

Figure 41:
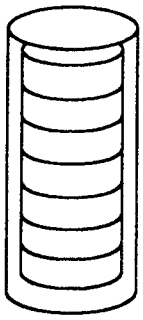
FIGS. 41(A) through 41(D) are examples of an oblique view and a cross sectional view of cartridge.
Figure 41:
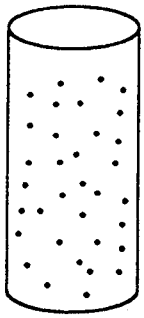
Figure 41:
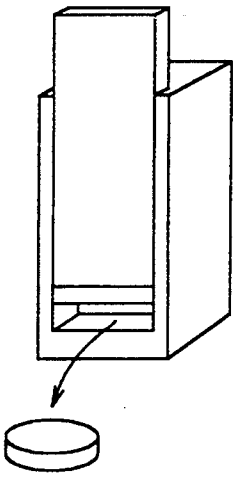
Figure 41:
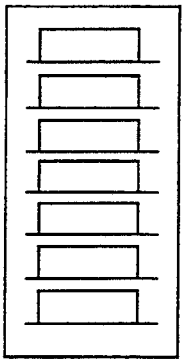
Figure 42:
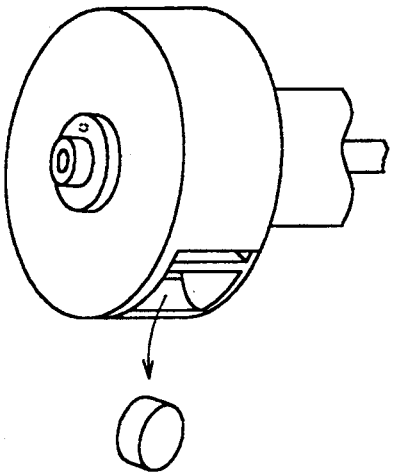
FIGS. 42(A) and 42(B) are oblique views of another example of cartridge.
Figure 42:
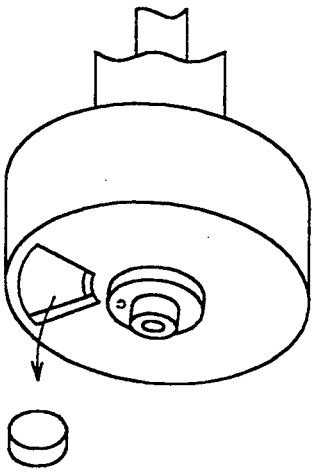

FIGS. 41 and 42 are oblique views of examples of cartridges.

These cartridges may be set onto the supplying apparatus of the automatic processing machine of the present invention as the package material containing the solid processing agent. Any of the above-mentioned compounds can be used as the material therefor, with preference given to a material sufficiently tough to avoid destruction hampering the supply in the case of a decrease in the solid processing agent.

FIG. 41(A) shows tablets contained in a cylindrical cartridge. FIG. 41(B) shows granules or powder contained in a cartridge.

FIGS. 41(C) and (D) are an oblique view and a cross-sectional view showing a state of a solid processing agent contained in a box cartridge with a lid.

FIG. 42(A) and (B) shows states in which tablets, granules or powder is contained in a rotatable container equipped with a partition board, which container is contained in an outer cylinder, and a given amount is dropped via the opening. FIG. 36(A) shows the type wherein the shaft is horizontally supported. FIG. 36(B) shows the type wherein the shaft is vertically supported. The present invention is by no means limited to these examples.

Other examples are described below with reference to FIGS. 43(*a*) and (*b*), 44(*a*) and (*b*), 45, 46 and 47.

Figure 43:
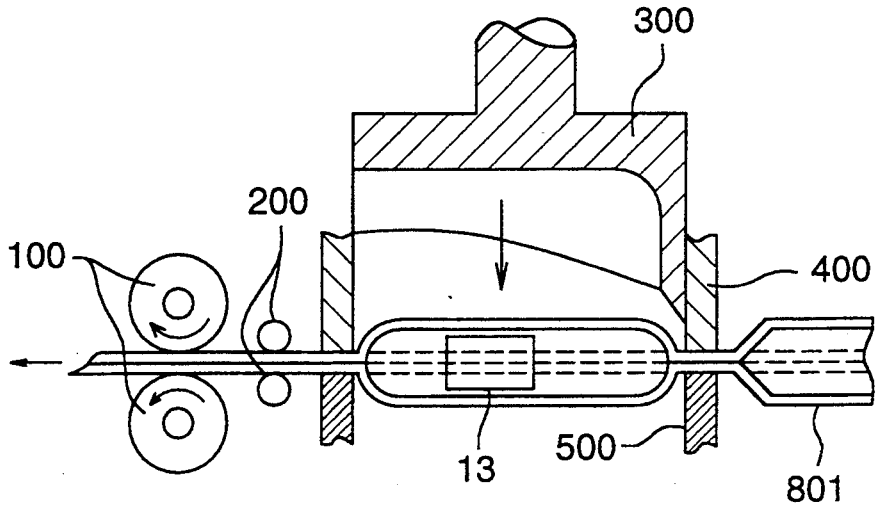
FIGS. 43(A) and 43(B) are cross sectional views of an apparatus for cutting a package in a " " shape.
Figure 43:
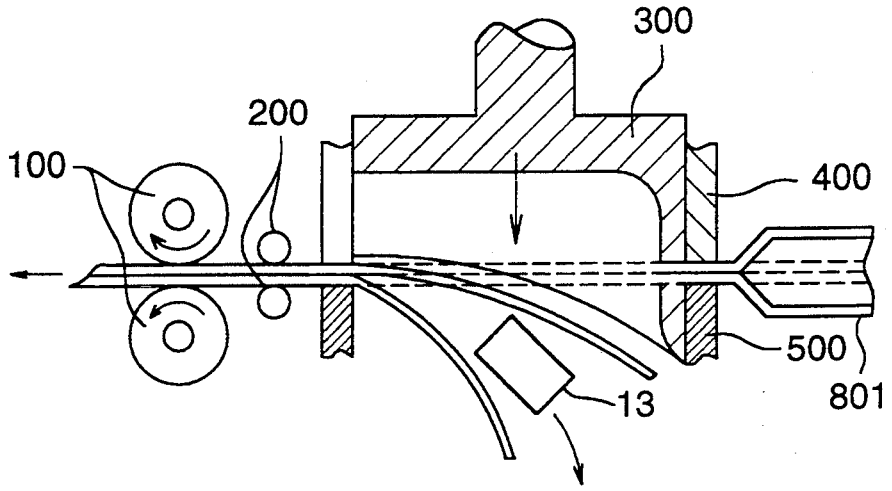

FIGS. 43(*a*) and (*b*) show the "⊐"-shaped punching method.

Figure 44:
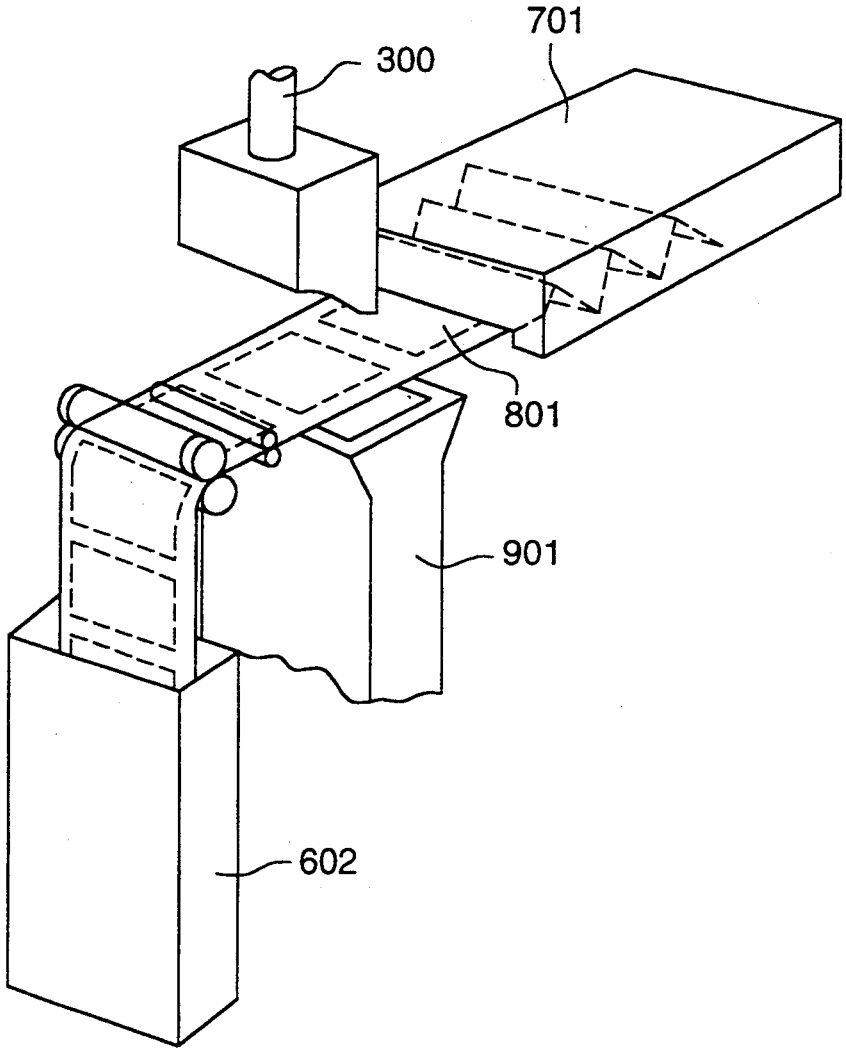
FIGS. 44(A) and 44(B) are respectively an oblique view and a plan of the apparatus for cutting a package in a " " shape of FIG. 37.
Figure 44:
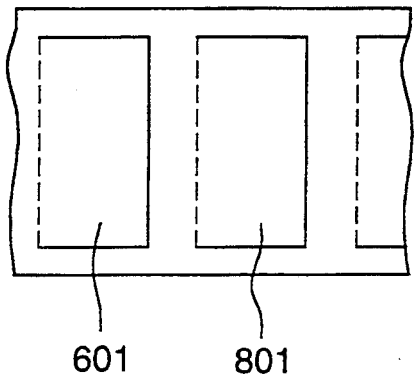

When a given amount of light-sensitive material has been processed as detected by the processing amount information detecting means, the processing agent supply controlling means passes a signal to activate transport roller 100, whereby package 801 of FIG. 43(*a*) containing solid processing agent 13 is moved to a position as shown in FIG. 43(*a*) and stopped there. Package 801 may be moved by any method, including the method in which a notch made in package 801 is detected, the method in which a printed pattern or an eye mark is detected and the method in which processing agent 13 in package 801 is detected; essentially, the required number of units of solid processing agent 13 are detected accurately. Next, as illustrated in FIG. 43(*b*), puncher 300 descends and cuts package 801, and solid processing agent 13 is added to the processing tank of the automatic processing machine via receiving portion 901 of FIG. 44(*a*). The cut made by puncher 300 is of a "⊐" shape corresponding to punch shape 601, as illustrated in FIG. 44(*b*).

In this type, solid processing agent 13 may be in the form of powder, granules or tablets, but solid processing agent 13 preferably has a tablet form, since the chemical is not likely to adhere to the puncher. Other advantages of the tablet form are that stain is not likely because tablets do not adhere to the package, and that tablets are safe in handling by the user. Used package 802 may be disposed in disposal box 602, which is preferably recycled package storage box 701.

Figure 45:
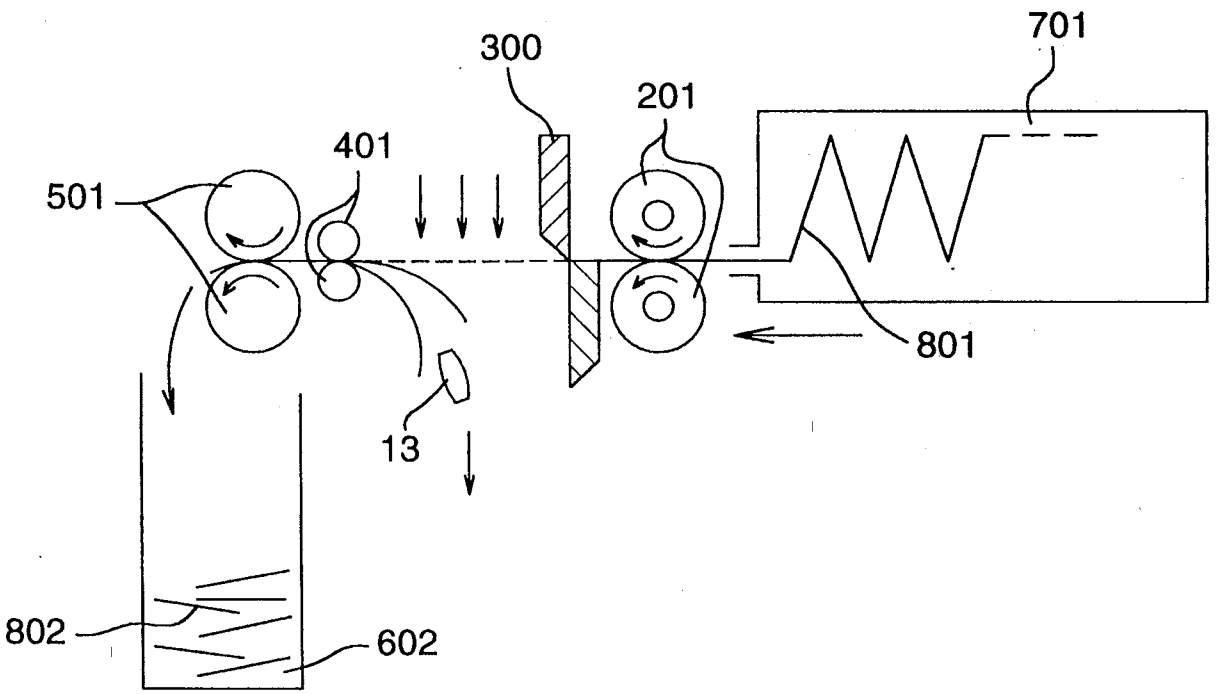
FIG. 45 shows a cross sectional view of an apparatus for cutting down a package.
Figure 46:
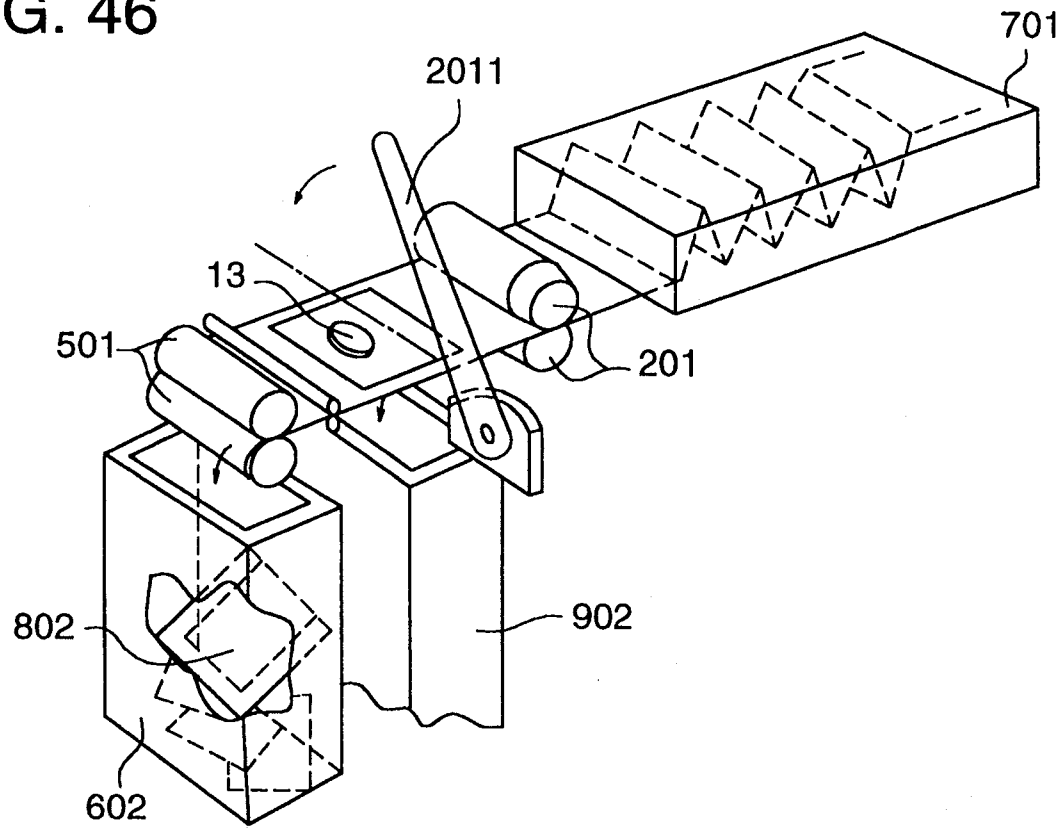
FIG. 46 is an oblique view of the apparatus for cutting down a package of FIG. 33.

FIGS. 45 and 46 show how to cut down package 801.

When a given amount of light-sensitive material has been processed as detected by the processing amount information detecting means, the processing agent supply controlling means passes a signal to activate transport roller 201, whereby package 801 containing solid processing agent 13 is moved to above processing tank filter portion 902 and stopped there. In this operation, the tip of package 801 is in squeezing roller 401.

The package may be moved by any method, including the method in which a notch made in package 801 is detected, the method in which a printed pattern is detected and the method in which the processing agent in package 801 is detected; essentially, the required number of units of solid processing agent 13 are detected accurately. Next, ceramic cutter 201 cuts package 801. Upon completion of cutting, squeezing roller 401 and transport roller 501 rotate, and solid processing agent 13 is passed through the discharge port and added to processing tank filter portion 902 of the automatic processing machine while being squeezed by squeezing roller 401. Cut waste package 802 is discharged via transport roller 501 into disposal box 602, which is preferably recycled package storage box.

In this type, solid processing agent 13 may be in the form of powder, granules or tablets, but solid processing agent 13 is preferably in a tablet form, since the chemical is not likely to adhere to ceramic cutter 201. Another advantage of the tablet form are that stain is not likely because tablets do not adhere to package 802.

Used package 11 may be disposed in disposal box 602.

Figure 47:
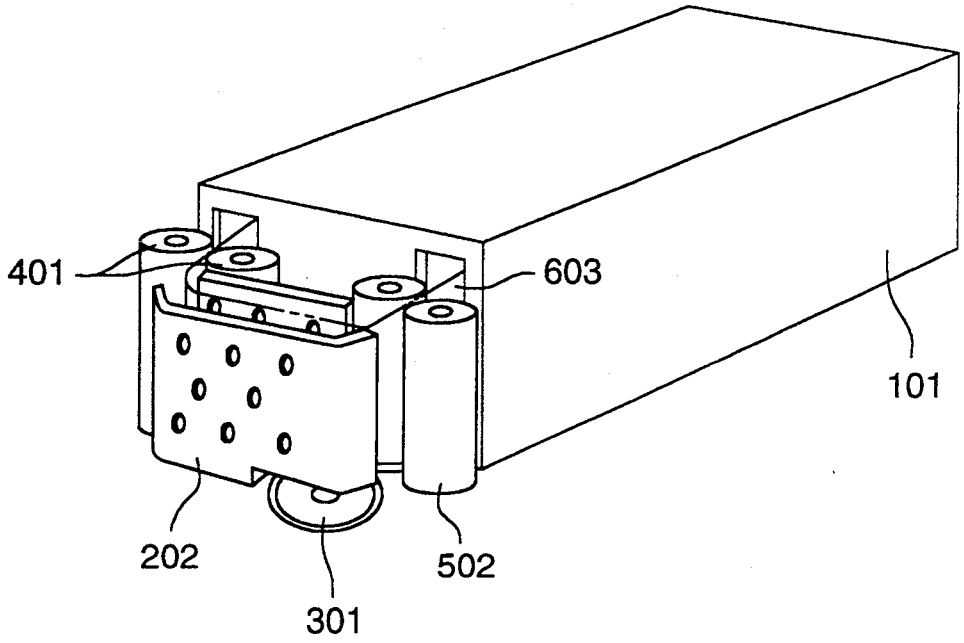
FIGS. 47(A) through 47(C) respectively show an oblique view and a cross sectional view of an apparatus for cutting a series of packages in two steps.
Figure 47:
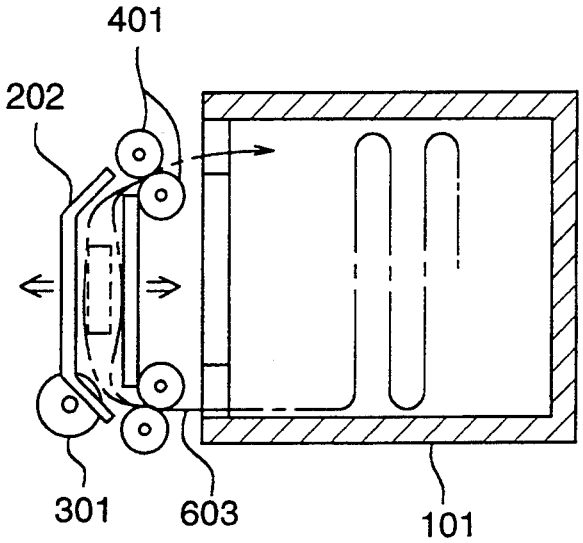
Figure 47:
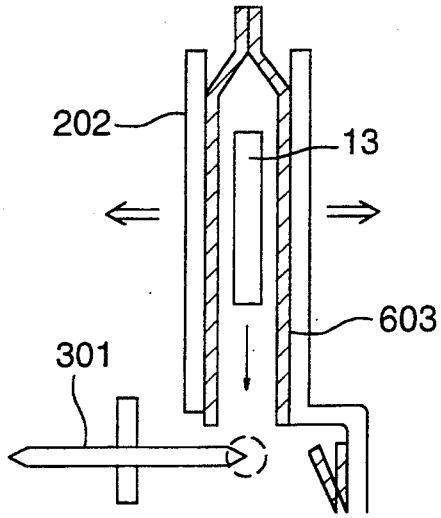

FIGS. 47(A) through (C) show how to cut successive package 603 in two steps.

When a given amount of light-sensitive material has been processed as detected by the processing amount information detecting means, the processing agent supply controlling means passes a signal to activate transport roller 502 and simultaneously rotate ceramic or stainless steel round cutter 301 to cut the lower portion of successive package 603 into two portions and add solid processing agent 13. Double-divided package 603 is widened by suction by suction guide 202 to allow easy drop of solid processing agent 13. Emptied package 603 containing no solid processing agent 13 is then moved to package storage box 101 by transport roller 401 upon addition of the next unit of solid processing agent 13.

For this double division, in addition to the above method, the successive package, provided with a notch etc., may be broken while being wound by a roller.

In this type, solid processing agent 13 may be in the form of powder, granules or tablets, but solid processing agent 13 is preferably in a tablet form, since the chemical is not likely to adhere to the seal of the package. Another advantage of the tablet form is that stain is not likely because tablets do not adhere to the package seal.

Used package 603 may be disposed in package disposal box 101.

As described above, the automatic processing machine for silver halide photographic light-sensitive materials of the present invention offers constant photographic performance by adding a previously removely weighed solid processing agent directly to the processing tank and dissolve it therein, compensating the lacked or dissolved components by the photographic material and removely supplying the required amount of replenishing water as necessary.

The necessity of replenisher preparing operation at given intervals by the user as in the prior art, and processing solution performance is kept constant by automatically adding the solid processing agent according to the amount of photographic material processed solely by presetting the solid processing agent.

By setting the device for removing moisture from air to remove moisture by intaking air outside the automatic processing machine, air near the automatic processing machine is dehumidified so that deformation of each solid processing agent housed in the solid processing agent supplying means due to humidity can be inhibited.

In addition, by introducing dry air generated in the device for removing moisture from air, deformation of each solid processing agent housed in the solid processing agent supplying means due to humidity can be inhibited more strictly.

Since water removed by the device for removing moisture from air can be used in the device for replenishing water in the automatic processing machine for a solid processig agent, labor for supplying work necessary for processing can be saved without preventing reducing the size of the automatic processing machine.

Another advantage is system size reduction in the case of color negative film processing; a 40 to 50 liter of replenisher tank volume is saved, since four or five kinds of processing solutions are required. Also, a complete solution is offered to the critical problem of low storage stability of replenishers in this age of the tendency toward lower replenishing rates, when a 10-liter replenisher is used over a period of over 1 months, in contrast to the prior art, wherein 2 weeks of storage stability is sufficient for a replenisher in a replenisher tank with a lid.

Prepared to meet the current demand for low replenishing rates, all replenishers as 1.4 to 2 times dense as the tank solutions, since the chemical is concentrated up to its maximum solubility, indicating supersaturation. This poses problems of crystal separation and tar formation in winter storage, which can damage the photographic material processed. These problems have been totally solved by the present invention.

Accordingly, the present invention involves the use of nothing other than as thin solutions as the processing tank solution. This is because basically the replenisher never exceeds the processing tank solution in concentration, since the solid processing agent is used to compensate the shortage only.

For the reason described above, the conventional replenishing methods do not allow replenishing rate reduction because the concentration of replenisher is limited by the limit of solubility. Particularly for color developer replenishers for color printing paper and bleach-fixer replenishers, which are too low in stability to allow replenishing rate reduction, the solid processing agent replenishing method of the present invention, which is free of replenishers, allows replenishing rate reduction.

The solid processing agent is not dangerous in transport, so that it does not necessitate the use of tough containers. It is also free of transport safety regulation as for dangerous liquid products, thus permitting simplified packaging. Other advantages are high handling safety and freedom of damage or contamination of the human body or clothing.

However, since the solid processing agent is faulty that much time is required to dissolve it due to difficulty in its dissolution, liquid processing agents are predominant, though solid processing agent kits were common. The present inventors made investigations with an emphasis on this respect, and found that replenishing operation is possible for constant photographic performance free of any problems even when the solid processing agent is dissolved over a long period by adding a small amount of removely weighed solid processing agent directly to a processing solution tank kept at a given temperature. Accordingly, in contrast to the conventional idea of replenisher kits that a replenisher, in complete solution, is stored in a replenishing tank, and is injected to the processing tank as necessary to maintain a constant composition, the present invention has eliminated the troublesome chemical replenisher dissolving operation by the user, replenishing tanks of automatic developers, and dangerous dense liquid chemical kits and conventional chemical bottles containing them by regularly adding a solid processing agent, previously removely weighed according to the information on the amount of processing of silver halide photographic light-sensitive material, to at least part of the processing tank kept at a constant temperature and supplying a given amount of replenishing water periodically to part of the processing tank as necessary, and the absence of replenishing tanks makes it possible to markedly improve processing stability owing to remarkable improvement in the life time of processing solutions.

In another currently available method, known as AR replenishment, the replenisher is prepared in solution before using, and dense solution kit elements A, B and C and replenishing water are supplied by direct collection by a bellows constant discharge pump. The four components are added before mixing them, rather than removely added directly to the processing tank. This has not been attempted with a solid processing agent.

What is claimed is:

1. An apparatus for processing a light-sensitive silver halide photographic material, comprising:

a processing tank for containing a processing solution to process the photographic material;

solid agent replenishing means for storing solid replenishing agents and delivering the solid agents to the processing tank to replenish a processing agent in the processing solution;

detector for detecting the amount of the processed photographic materials;

a controller for controlling the solid agent replenishing means so as to deliver the solid agent to the processing tank to replenish the processing agent in the processing solution in accordance with the detected amount of the processed photographic material;

a distillation device;

means for delivering processing solution from the processing tank to the distillation device;

said distillation device being operable for distillation of the processing solution delivered from the processing tank, into a distillate comprising distilled water, and including a pressure reducer operable to maintain a reduced pressure in the distillation device whereby the distillation occurs under reduced pressure; and water replenishing means for delivering the distilled water to the processing tank to replenish the processing solution.

2. The apparatus of claim 1, further comprising a water producing device wherein the water producing device comprises a separator for separating water from air and for producing dry air and said separator sucks air from outside around the apparatus.

3. The apparatus of claim 1, wherein the solid replenishing agent comprises one of a powder, granules and tablets and said solid agent replenishing means is operable to store and deliver said powder, granules or tablets to the processing tank.

4. The apparatus of claim 2, wherein the separator comprises a heat pump for condensing moisture from the sucked-in air.

5. The apparatus of claim 2, wherein the separator comprises an electric cooling element for condensing moisture in the sucked air.

6. The apparatus of claim 1, wherein a distillation device distills the processing solution to produce quantity of distilled water.

7. The apparatus of claim 6, wherein the distillation device includes a pressure reducer.

8. The apparatus of claim 7, wherein the pressure pressure reducing means comprises an ejector.

9. The apparatus of claim 8, wherein the pressure reducing means reducer is operable to reduce the a pressure to a value that is lower than 200 mmHg.

10. The apparatus of claim 6, wherein the distillation device includes a heater.

11. The apparatus of claim 10, wherein the apparatus includes a heat pump, the heater being a heat radiating section of the heat pump.

12. The apparatus of claim 10, wherein the apparatus includes a peltier element, the heater being a heat radiating section of the peltier element.

13. The apparatus of claim 6, wherein the distillation device distills the waste processing solution.

14. The apparatus of claim 6, wherein the distillation device distills the processing solution with a temperature lower than 60° C.

15. The apparatus of claim 6, wherein the distillation device includes a storage tank to store the distilled water.

16. The apparatus of claim 15, wherein the apparatus further comprises a pump to transfer a quantity of distilled water to the processing tank.

17. An apparatus of claim 1, wherein the processing tank is a color developing tank and the processing solution includes a color developing solution.

18. The apparatus of claim 1, wherein the processing tank is a bleach tank and the processing solution includes a bleach solution.

19. The apparatus of claim 1, wherein the processing tank is a fixing tank and the processing solution includes a fixing solution.

20. The apparatus of claim 1, wherein the processing tank is a bleach-fixing tank and the processing solution includes a bleach fixing solution.

21. The apparatus of claim 1, wherein the control means further controls the water replenisher to replenish the distilled water to the processing tank in accordance with the detected amount of the processed photographic materials.

22. An apparatus for processing light-sensitive silver halide photographic materials, comprising:

a processing tank for containing a processing solution to process a photographic material;

a solid agent replenishing means for storing solid replenishing agents and delivering the solid agents to the processing tank to replenish a processing agent in the processing solution;

a detector for detecting the amount of processed photographic materials;

a controller for controlling the solid agent replenishing means so as to deliver the solid agent to the processing tank to replenish the processing agent in the processing solution in accordance with the detected amount of the processed photographic materials;

a water producing device; and a water replenishing means for delivering the water produced by the water producing device to the processing tank, and wherein:

the water producing device comprises a separator for separating water from air and for producing dry air, and said separator sucks air from an outside around the apparatus.

23. The apparatus of claim 22, wherein the separator comprises a semi-permeable membrane for separating moisture in the sucked-in air.

24. An apparatus for processing light-sensitive silver halide photographic materials, comprising:

a processing tank for containing a processing solution to process a photographic material;

a solid agent replenishing means for storing solid replenishing agents and delivering the solid agents to the processing tank to replenish a processing agent in the processing solution;

a detector for detecting the amount of processed photographic materials;

a controller for controlling the solid agent replenishing means so as to deliver the solid agent to the processing tank to replenish the processing agent in the processing solution in accordance with the detected amount of the processed photographic materials;

a water producing device; and a water replenishing means for delivering the water produced by the water producing device to the processing tank, and wherein the water producing device comprises a separator for separating water from air the apparatus further comprises a drying section; and the separator sucks air from the drying section.

25. An apparatus for processing light-sensitive silver halide photographic materials, comprising:

a processing tank for containing a processing solution to process a photographic material;

a solid agent replenishing means for storing solid replenishing agents and delivering the solid agents to the processing tank to replenish a processing agent in the processing solution;

a detector for detecting the amount of processed photographic materials;

a controller for controlling the solid agent replenishing means so as to deliver the solid agent to the processing tank to replenish the processing agent in the processing solution in accordance with the detected amount of the processed photographic materials;

a water producing device; and a water replenishing means for delivering the water produced by the water producing device to the processing tank, and wherein the water producing device comprises a separator for separating water from air the separator sucks air from an upper portion of the processing tank.

26. An apparatus for processing light-sensitive silver halide photographic materials, comprising:

a processing tank for containing a processing solution to process a photographic material;

a solid agent replenishing means for storing solid replenishing agents and delivering the solid agents to the processing tank to replenish a processing agent in the processing solution;

a detector for detecting the amount of processed photographic materials;

a controller for controlling the solid agent replenishing means so as to deliver the solid agent to the processing tank to replenish the processing agent in the processing solution in accordance with the detected amount of the processed photographic materials;

a water producing device; and a water replenishing means for delivering the water produced by the water producing device to the processing tank, and wherein the water producing device comprises a separator for separating water from air; and the dry air produced by the separator is introduced to the solid agent replenisher.

* * * * *